US012441523B2

(12) United States Patent
O'Nan et al.

(10) Patent No.: US 12,441,523 B2
(45) Date of Patent: Oct. 14, 2025

(54) DRINK CUP LID

(71) Applicant: Berry Global, Inc., Evansville, IN (US)

(72) Inventors: David Y. O'Nan, Henderson, KY (US); David C. Arnold, Evansville, IN (US); Douglas E. Klueh, Evansville, IN (US)

(73) Assignee: Berry Global, Inc., Evansville, IN (US)

( * ) Notice: Subject to any disclaimer, the term of this patent is extended or adjusted under 35 U.S.C. 154(b) by 93 days.

(21) Appl. No.: 17/856,124

(22) Filed: Jul. 1, 2022

(65) Prior Publication Data

US 2023/0012397 A1 Jan. 12, 2023

Related U.S. Application Data

(60) Provisional application No. 63/218,672, filed on Jul. 6, 2021.

(51) Int. Cl.
*B65D 47/08* (2006.01)

(52) U.S. Cl.
CPC .. *B65D 47/0804* (2013.01); *B65D 2251/1008* (2013.01); *B65D 2547/06* (2013.01)

(58) Field of Classification Search
CPC ..... B65D 47/0804; B65D 2251/1008; B65D 2547/06; B65D 2543/00027; B65D 2543/00296; B65D 2543/00685; B65D 2543/00731; B65D 43/0212; B65D 2203/12; B65D 2251/04; B65D 2543/00046; B65D 2543/00092; B65D 2543/00796
See application file for complete search history.

(56) References Cited

U.S. PATENT DOCUMENTS

| | | | |
|---|---|---|---|
| D7,248 | S | 3/1874 | Elstrand |
| D53,911 | S | 10/1919 | Humphrey |
| D58,571 | S | 8/1921 | Hyatt |
| 1,395,594 | A | 11/1921 | Pfefferle |
| D62,268 | S | 4/1923 | Stern |
| D64,091 | S | 2/1924 | Weintraub |
| D65,193 | S | 7/1924 | Leveridge |
| 1,624,849 | A | 4/1927 | Steele |
| D78,805 | S | 6/1929 | Burke |

(Continued)

FOREIGN PATENT DOCUMENTS

| | | |
|---|---|---|
| CA | 3059250 A1 | 10/2018 |
| CN | 3107990 | 1/1999 |

(Continued)

OTHER PUBLICATIONS

DART Hot/Cold Cup Lid: Site Visited (Nov. 30, 2022). Available from URL: :https://www.grainger.com/product/1UCV4?gucic :N:PS:Paid:GGL:CSM-2295:4P7A1P:20501231&gclid=EAIaIQobChMIps6Jzu7W-wIVIYXICh0npwZYEAKYCyABEgKSkfD_BwE& gclsrc=aw.ds.

(Continued)

*Primary Examiner* — James N Smalley
(74) *Attorney, Agent, or Firm* — Barnes & Thornburg LLP

(57) ABSTRACT

A drink cup lid includes a ring-shaped brim mount adapted to mate with a brim of a drink cup and a central closure surrounded by the ring-shaped brim mount and including an annular top wall formed to include a top aperture and an adjacent liquid-discharge outlet. The drink cup lid further includes an outlet closure configured to close the liquid-discharge outlet.

20 Claims, 21 Drawing Sheets

(56) References Cited

U.S. PATENT DOCUMENTS

| | | | |
|---|---|---|---|
| 1,755,042 | A | 4/1930 | Zoller |
| 1,773,972 | A | 8/1930 | Eberhart |
| 1,940,088 | A | 12/1933 | Harrison |
| 2,015,028 | A | 9/1935 | Gillette |
| 2,050,487 | A | 8/1936 | Durrant |
| 2,120,403 | A | 6/1938 | Godfrey |
| D111,097 | S | 8/1938 | White |
| 2,174,618 | A | 10/1939 | Burdick |
| 2,271,589 | A | 2/1942 | Hendrickson |
| 2,313,801 | A | 3/1943 | Carll |
| 2,374,092 | A | 4/1945 | Glaser |
| D141,225 | S | 5/1945 | Ray |
| 2,447,407 | A | 8/1948 | Grain |
| 2,649,984 | A | 8/1953 | Abt |
| D172,089 | S | 5/1954 | Pree |
| 2,766,796 | A | 10/1956 | Tupper |
| 2,985,354 | A | 5/1961 | Aldington |
| 3,027,596 | A | 4/1962 | Knowles |
| 3,048,317 | A | 8/1962 | Cochrane |
| 3,055,540 | A | 9/1962 | Ringlen |
| 3,065,875 | A | 11/1962 | Negoro |
| 3,071,281 | A | 1/1963 | Sawai |
| 3,103,224 | A | 9/1963 | Dearling |
| 3,128,903 | A | 4/1964 | Crisci |
| 3,245,691 | A | 4/1966 | Gorman |
| 3,262,602 | A | 7/1966 | McConnell |
| 3,269,734 | A | 8/1966 | Ottofy |
| 3,301,459 | A | 1/1967 | Gardner |
| 3,329,304 | A | 7/1967 | Crisci |
| 3,329,305 | A | 7/1967 | Crisci |
| 3,349,950 | A | 10/1967 | Wanderer |
| 3,392,468 | A | 7/1968 | Wolf |
| 3,421,653 | A | 1/1969 | Whaley |
| 3,433,378 | A | 3/1969 | Ross |
| 3,502,765 | A | 3/1970 | Spencer |
| 3,524,566 | A | 8/1970 | Parks |
| 3,561,668 | A | 2/1971 | Bergstrom |
| 3,583,596 | A | 6/1971 | Brewer |
| D221,420 | S | 8/1971 | Davis |
| 3,604,588 | A | 9/1971 | Winnick |
| 3,609,263 | A | 9/1971 | Clementi |
| 3,610,306 | A | 10/1971 | Summers |
| 3,612,342 | A | 10/1971 | Bun |
| 3,624,787 | A | 11/1971 | Newman |
| D222,905 | S | 2/1972 | Kinney |
| 3,676,089 | A | 7/1972 | Swett |
| 3,677,435 | A | 7/1972 | Davis |
| 3,679,088 | A | 7/1972 | Swett |
| 3,679,089 | A | 7/1972 | Swett |
| D226,063 | S | 1/1973 | Warnberg |
| 3,734,276 | A | 5/1973 | Bank |
| 3,743,133 | A | 7/1973 | Rathbun |
| 3,745,055 | A | 7/1973 | Gorman |
| 3,746,158 | A | 7/1973 | Connick |
| 3,752,042 | A | 8/1973 | Castille |
| 3,768,688 | A | 10/1973 | Linke |
| 3,789,095 | A | 1/1974 | Winstead |
| 3,805,991 | A | 4/1974 | Cheladze |
| 3,817,420 | A | 6/1974 | Heisler |
| 3,828,637 | A | 8/1974 | Slack |
| 3,840,144 | A | 10/1974 | Dry |
| D233,599 | S | 11/1974 | Davis |
| 3,926,084 | A | 12/1975 | Blazer |
| RE28,797 | E | 5/1976 | Brewer |
| 3,954,923 | A | 5/1976 | Valyi |
| 3,964,635 | A | 6/1976 | Ludder |
| 3,974,916 | A | 8/1976 | Bartolucci |
| 3,977,563 | A | 8/1976 | Holt |
| 3,994,411 | A | 11/1976 | Elfelt |
| D242,736 | S | 12/1976 | Craft, III |
| D242,738 | S | 12/1976 | Michaeli |
| 4,006,839 | A | 2/1977 | Thiel |
| 4,007,936 | A | 2/1977 | Hornsby |
| 4,018,355 | A | 4/1977 | Ando |
| 4,026,459 | A | 5/1977 | Blanchard |
| 4,054,229 | A | 10/1977 | Arfert |
| 4,061,706 | A | 12/1977 | Duffield |
| D246,955 | S | 1/1978 | Davis |
| 4,074,827 | A | 2/1978 | Labe |
| 4,078,686 | A | 3/1978 | Karesh |
| D248,376 | S | 7/1978 | Allen |
| D251,828 | S | 5/1979 | Smith |
| 4,190,174 | A | 2/1980 | Haimowitz |
| 4,194,645 | A | 3/1980 | Zabner |
| 4,210,258 | A | 7/1980 | Von Holdt |
| 4,211,743 | A | 7/1980 | Nauta et al. |
| D256,558 | S | 8/1980 | Smith |
| D258,576 | S | 3/1981 | Smith |
| 4,266,689 | A | 5/1981 | Asher |
| D261,486 | S | 10/1981 | Smith |
| 4,293,080 | A | 10/1981 | Letica |
| D262,691 | S | 1/1982 | Horsley |
| D264,440 | S | 5/1982 | Austin, Jr. |
| D264,690 | S | 6/1982 | Bagwell |
| 4,349,119 | A | 9/1982 | Letica |
| 4,351,448 | A | 9/1982 | Ingersoll |
| 4,370,908 | A | 2/1983 | Dealto |
| 4,380,305 | A | 4/1983 | Von Holdt |
| 4,389,802 | A | 6/1983 | McLaren |
| 4,408,698 | A | 10/1983 | Ballester |
| 4,412,467 | A | 11/1983 | Desanto |
| 4,413,964 | A | 11/1983 | Winstead |
| D271,857 | S | 12/1983 | Callahan |
| 4,421,244 | A | 12/1983 | Van Melle |
| 4,421,712 | A | 12/1983 | Winstead |
| D272,324 | S | 1/1984 | Mumford |
| 4,444,332 | A | 4/1984 | Widen |
| 4,446,986 | A | 5/1984 | Bowen |
| 4,474,305 | A | 10/1984 | Marco |
| 4,508,235 | A | 4/1985 | Steele |
| 4,518,097 | A | 5/1985 | Milton |
| 4,524,882 | A | 6/1985 | Buc |
| 4,562,937 | A | 1/1986 | Iyengar |
| D286,026 | S | 10/1986 | Rayner |
| 4,629,088 | A | 12/1986 | Durgin |
| 4,640,434 | A | 2/1987 | Johnsen |
| 4,640,435 | A | 2/1987 | Dutt |
| 4,674,644 | A | 6/1987 | Jacobs |
| 4,679,699 | A | 7/1987 | Malsbury |
| D292,380 | S | 10/1987 | Smith |
| 4,721,210 | A | 1/1988 | Lawrence |
| 4,722,820 | A | 2/1988 | Flecknoe-Brown |
| 4,782,976 | A | 11/1988 | Kenyon |
| D298,919 | S | 12/1988 | Gee |
| 4,799,602 | A | 1/1989 | Collins |
| 4,836,407 | A | 6/1989 | Bruce |
| 4,872,586 | A | 10/1989 | Landis |
| 4,886,184 | A | 12/1989 | Chamourian |
| 4,934,557 | A | 6/1990 | Smith |
| D309,564 | S | 7/1990 | Rayner |
| 4,971,211 | A | 11/1990 | Lake |
| 4,994,229 | A | 2/1991 | Flecknoe-Brown |
| D317,262 | S | 6/1991 | Bluff |
| 5,064,082 | A | 11/1991 | Lombardi |
| 5,088,367 | A | 2/1992 | Cracchiolo |
| 5,099,232 | A | 3/1992 | Howes |
| 5,106,567 | A | 4/1992 | Demerest |
| 5,111,961 | A | 5/1992 | Van Melle |
| 5,151,233 | A | 9/1992 | Wendt |
| 5,180,079 | A | 1/1993 | Jeng |
| 5,188,691 | A | 2/1993 | Caputo |
| 5,197,624 | A | 3/1993 | Dodaro |
| 5,219,627 | A | 6/1993 | Arase |
| D339,027 | S | 9/1993 | Mack |
| 5,375,828 | A | 12/1994 | Shikami |
| 5,377,860 | A | 1/1995 | Littlejohn |
| 5,390,810 | A | 2/1995 | Stroble |
| 5,397,023 | A | 3/1995 | Toczek |
| 5,398,843 | A | 3/1995 | Warden |
| 5,427,266 | A | 6/1995 | Yun |
| D360,133 | S | 7/1995 | Boller |
| 5,460,286 | A | 10/1995 | Rush |
| D365,516 | S | 12/1995 | Williamson |
| 5,489,026 | A | 2/1996 | Daloia |

(56) References Cited

U.S. PATENT DOCUMENTS

D368,430 S 4/1996 Herzog
D368,444 S 4/1996 Shryock
5,503,289 A 4/1996 Fox
5,509,568 A 4/1996 Warden
5,524,788 A 6/1996 Plester
5,531,347 A 7/1996 Goulding
5,542,532 A 8/1996 Mitchell
D374,822 S 10/1996 Philips
5,592,766 A 1/1997 Mygatt
5,613,619 A 3/1997 Van Melle
5,614,228 A 3/1997 Demerest
5,641,063 A 6/1997 Gambardella
D380,385 S 7/1997 Litke
D381,267 S 7/1997 Rush
D384,580 S 10/1997 Fernandes
D384,862 S 10/1997 Hayes
5,713,463 A 2/1998 Lakoski
5,722,558 A 3/1998 Thompson
5,746,312 A 5/1998 Johnson
5,769,263 A 6/1998 Willingham
5,775,194 A 7/1998 Spada
5,783,229 A 7/1998 Manlove
5,791,509 A 8/1998 Rush
5,795,535 A 8/1998 Giovannone
D398,997 S 9/1998 Taylor
5,806,707 A 9/1998 Boehm
5,820,016 A 10/1998 Stropkay
5,829,583 A 11/1998 Verweyst
5,839,601 A * 11/1998 Van Melle ..... B65D 43/24 220/717
5,868,309 A 2/1999 Sandstrom
D408,223 S 4/1999 Henry
5,894,952 A 4/1999 Mendenhall
5,913,964 A 6/1999 Melton
5,947,278 A 9/1999 Sawhney
5,947,323 A 9/1999 Freek
5,979,690 A 11/1999 Hartley
5,983,693 A 11/1999 Bodnar
6,021,917 A 2/2000 Lovell
6,056,144 A 5/2000 Strange
6,070,752 A 6/2000 Nava
D428,355 S 7/2000 Kavalek
6,086,800 A 7/2000 Manlove
6,089,397 A 7/2000 Van Melle
D432,868 S 10/2000 Tan
6,126,035 A 10/2000 Schaper
6,161,354 A 12/2000 Gilbert
D437,223 S 2/2001 Coy
D437,671 S 2/2001 Fajerstein
6,196,404 B1 3/2001 Chen
6,196,411 B1 3/2001 Nava
6,216,857 B1 4/2001 Gordon
6,257,435 B1 7/2001 Chedister
6,257,629 B1 7/2001 Weichelt
D446,150 S 8/2001 Bamminger
6,279,300 B1 8/2001 Simhaee
6,299,014 B1 10/2001 Nava
6,302,288 B1 10/2001 Nava
6,311,860 B1 11/2001 Reidinger
6,319,456 B1 11/2001 Gilbert
D452,155 S 12/2001 Stodd
6,330,943 B1 12/2001 Gordon
6,349,821 B1 2/2002 Gordon
6,357,619 B1 3/2002 Schaefer
6,364,102 B1 4/2002 Gordon
6,371,289 B1 4/2002 Gordon
6,394,783 B1 5/2002 Dalgewicz, III
6,404,730 B2 6/2002 Yeo
6,412,629 B1 7/2002 Gordon
6,419,112 B1 7/2002 Bruce
D461,141 S 8/2002 Steiner
6,427,832 B1 8/2002 Ali
6,454,087 B2 9/2002 Gordon
6,460,716 B1 10/2002 Wong
6,464,072 B2 10/2002 Gordon
6,478,148 B2 11/2002 Gordon
6,481,573 B2 11/2002 Gordon
D468,494 S 1/2003 Holloway
D469,693 S 2/2003 Weiss
D471,810 S 3/2003 Hayes
6,533,114 B1 3/2003 Gordon
6,554,154 B1 4/2003 Chauhan
6,557,698 B2 5/2003 Gordon
6,561,122 B1 5/2003 Kurja
6,561,345 B2 5/2003 Gordon
6,571,943 B2 6/2003 Gordon
6,576,309 B2 6/2003 Dalgewicz, III
6,588,182 B2 7/2003 Gordon
6,598,741 B2 7/2003 Gordon
6,604,629 B2 8/2003 Gordon
6,612,456 B1 9/2003 Hundley
6,625,959 B2 9/2003 Gordon
6,626,288 B2 9/2003 Gordon
D480,968 S 10/2003 Atkins
6,641,384 B2 11/2003 Bosler
6,647,696 B2 11/2003 Gordon
6,648,134 B2 11/2003 Gordon
D482,985 S 12/2003 Bombeke
6,688,487 B2 2/2004 Oakes
D487,411 S 3/2004 Bamminger
6,737,008 B2 5/2004 Gilbert
D492,901 S 7/2004 Woods
6,814,905 B1 11/2004 Dalgewicz
6,840,375 B2 1/2005 Gordon
6,846,533 B2 1/2005 Wu
D502,050 S 2/2005 Munson
6,874,649 B2 4/2005 Clarke
6,886,707 B2 5/2005 Giraud
6,889,860 B2 5/2005 Mazzarolo
6,907,702 B2 6/2005 Gilbert
6,910,599 B2 6/2005 Tucker
6,923,338 B2 8/2005 Dees
6,929,143 B2 8/2005 Mazzarolo
6,932,234 B2 8/2005 Damato
6,948,633 B2 9/2005 Freek
6,959,829 B2 11/2005 Crider
7,000,522 B2 2/2006 Pfaff, Jr.
D516,910 S 3/2006 Bresler
D517,322 S 3/2006 Zettle
7,017,774 B2 3/2006 Haedt
D519,374 S 4/2006 Hornke
D521,382 S 5/2006 Gross
D522,240 S 6/2006 Laval
7,055,715 B2 6/2006 Maravich
7,063,224 B2 6/2006 Clarke
D525,869 S 8/2006 Tedford, Jr.
D527,261 S 8/2006 Manfred
7,100,787 B2 9/2006 Farnsworth
7,108,495 B2 9/2006 Gilbert
D529,391 S 10/2006 Glass
D533,777 S 12/2006 Hundley
7,144,619 B2 12/2006 Ramchandra
7,156,251 B2 1/2007 Smith
7,157,034 B2 1/2007 Bristow
7,159,732 B2 1/2007 Smith
7,169,855 B2 1/2007 Yamaguchi
7,175,042 B2 2/2007 Durdon
7,213,709 B2 5/2007 Moskovich
D543,787 S 6/2007 Wasserman
7,225,945 B2 6/2007 Crider
7,232,302 B2 6/2007 Marzona
7,246,714 B2 7/2007 Garg
7,255,391 B2 8/2007 Bristow
7,284,673 B2 10/2007 Habeger
7,284,676 B2 10/2007 Dantani
D556,037 S 11/2007 D'Amato
D556,574 S 12/2007 Hollis
D559,105 S 1/2008 D'Amato
D560,120 S 1/2008 Maravich
7,318,536 B2 1/2008 Maravich
7,318,563 B2 1/2008 Houts
7,328,791 B1 2/2008 Bosworth
D564,354 S 3/2008 Maravich
7,353,582 B2 4/2008 MacKenzie

(56) References Cited

U.S. PATENT DOCUMENTS

| | | | |
|---|---|---|---|
| D569,245 | S | 5/2008 | Joshi |
| D570,685 | S | 6/2008 | Koennecke |
| D570,686 | S | 6/2008 | Hollis |
| D572,587 | S | 7/2008 | Rush |
| D574,231 | S | 8/2008 | Laval |
| D574,238 | S | 8/2008 | Walker, III |
| D574,290 | S | 8/2008 | Shah |
| 7,413,698 | B2 | 8/2008 | Bearse |
| D578,829 | S | 10/2008 | Freeman |
| 7,455,006 | B2 | 11/2008 | Toth |
| 7,464,831 | B2 | 12/2008 | Aiken |
| 7,484,639 | B2 | 2/2009 | Maravich |
| D588,002 | S | 3/2009 | Gianfranco |
| 7,513,382 | B2 | 4/2009 | Clarke |
| 7,523,534 | B2 | 4/2009 | Mackenzie |
| D591,476 | S | 5/2009 | Colman |
| D592,952 | S | 5/2009 | Hundley |
| D593,892 | S | 6/2009 | Schneider |
| 7,549,559 | B2 | 6/2009 | Conroy |
| D596,524 | S | 7/2009 | Schneider |
| 7,591,389 | B2 | 9/2009 | Wong |
| 7,611,660 | B2 | 11/2009 | Bosler |
| 7,624,536 | B2 | 12/2009 | Schromm |
| 7,628,946 | B2 | 12/2009 | Gandon |
| 7,642,316 | B2 | 1/2010 | Rego |
| 7,658,296 | B2 | 2/2010 | Van Handel |
| 7,658,882 | B2 | 2/2010 | Minganti |
| 7,676,909 | B2 | 3/2010 | MacKenzie |
| 7,685,677 | B2 | 3/2010 | Garg |
| D613,199 | S | 4/2010 | Schneider |
| 7,691,302 | B2 | 4/2010 | Hollis |
| D614,954 | S | 5/2010 | Crowell |
| 7,754,299 | B2 | 7/2010 | Wu |
| 7,762,213 | B2 | 7/2010 | Cook |
| 7,784,641 | B2 | 8/2010 | Chou |
| D624,413 | S | 9/2010 | Selina |
| 7,819,271 | B2 | 10/2010 | Hollis |
| 7,837,923 | B2 | 11/2010 | Bearse |
| 7,845,510 | B2 | 12/2010 | Schmidtner |
| 7,845,514 | B2 | 12/2010 | Rush |
| 7,850,812 | B2 | 12/2010 | Sekar |
| 7,866,502 | B2 | 1/2011 | Maxwell |
| 7,874,449 | B1 | 1/2011 | Studee |
| 7,992,741 | B2 | 8/2011 | Hundley |
| 7,997,230 | B2 | 8/2011 | Cook |
| 8,007,269 | B1 | 8/2011 | Otto |
| 8,038,432 | B2 | 10/2011 | Mazzarolo |
| 8,074,331 | B2 | 12/2011 | Voges |
| 8,074,831 | B2 | 12/2011 | Walker |
| 8,084,109 | B2 | 12/2011 | Gao |
| 8,113,379 | B2 | 2/2012 | Cai |
| 8,142,587 | B2 | 3/2012 | Sekar |
| 8,142,599 | B2 | 3/2012 | Sekar |
| 8,152,018 | B2 | 4/2012 | Smith |
| 8,196,500 | B2 | 6/2012 | Mansfield |
| 8,211,355 | B2 | 7/2012 | Otto |
| 8,276,776 | B2 | 10/2012 | Roth |
| 8,282,382 | B2 | 10/2012 | Mazzarolo |
| 8,286,823 | B2 | 10/2012 | Turvey |
| 8,287,270 | B2 | 10/2012 | Lee |
| 8,308,884 | B2 | 11/2012 | Sekar |
| 8,312,993 | B2 | 11/2012 | Sams |
| 8,317,050 | B2 | 11/2012 | Hollis |
| 8,348,053 | B2 | 1/2013 | Bellamah |
| 8,418,871 | B1 | 4/2013 | Lamasney |
| 8,430,268 | B2 | 4/2013 | Weiss |
| D685,286 | S | 7/2013 | Bhansali |
| 8,474,643 | B2 | 7/2013 | Hundley |
| 8,486,211 | B2 | 7/2013 | Sekar |
| 8,499,947 | B2 | 8/2013 | Trost |
| 8,544,677 | B2 | 10/2013 | Selina |
| D693,181 | S | 11/2013 | Chase |
| D694,109 | S | 11/2013 | Tanner |
| 8,573,400 | B1 | 11/2013 | Lamasney |
| 8,592,014 | B2 | 11/2013 | Alvarez |
| D695,612 | S | 12/2013 | Chou |
| 8,616,405 | B2 | 12/2013 | French |
| D696,940 | S | 1/2014 | Hale |
| 8,623,261 | B2 | 1/2014 | Patkar |
| 8,628,319 | B2 | 1/2014 | Mazzarolo |
| 8,628,718 | B2 | 1/2014 | Li |
| 8,632,831 | B2 | 1/2014 | Perry |
| D699,619 | S | 2/2014 | Kothari |
| 8,642,102 | B2 | 2/2014 | Field |
| D700,513 | S | 3/2014 | Carsrud |
| 8,662,880 | B2 | 3/2014 | Fowler |
| 8,753,106 | B2 | 6/2014 | Lee |
| 8,764,928 | B2 | 7/2014 | Sekar |
| 8,771,451 | B2 | 7/2014 | Sekar |
| 8,777,013 | B1 | 7/2014 | Jalindre |
| 8,777,046 | B2 | 7/2014 | Mann |
| 8,800,801 | B2 | 8/2014 | Freeman |
| 8,895,092 | B1 | 11/2014 | Field |
| 8,939,312 | B1 | 1/2015 | Buck |
| D722,873 | S | 2/2015 | Wu |
| 8,950,623 | B2 | 2/2015 | Fleming |
| D726,025 | S | 4/2015 | Somers |
| 9,034,231 | B2 | 5/2015 | Tabor |
| D732,959 | S | 6/2015 | Branstad |
| 9,051,106 | B2 | 6/2015 | Milano |
| D734,894 | S | 7/2015 | Schlatter |
| 9,078,535 | B1 | 7/2015 | Buck |
| 9,102,446 | B2 | 8/2015 | Kowal |
| 9,114,902 | B2 | 8/2015 | Temple, Jr. |
| D737,689 | S | 9/2015 | Monteparo |
| 9,144,464 | B2 | 9/2015 | Knowlton |
| 9,156,950 | B2 | 10/2015 | Garralda |
| D744,288 | S | 12/2015 | Rosen |
| 9,199,776 | B1 | 12/2015 | Bruce |
| D746,682 | S | 1/2016 | Trombetta |
| D751,382 | S | 3/2016 | Torrison |
| 9,278,787 | B2 | 3/2016 | Garg |
| 9,352,886 | B2 | 5/2016 | Baillies |
| D761,104 | S | 7/2016 | Buck |
| 9,421,710 | B2 | 8/2016 | Drebes |
| 9,474,420 | B2 | 10/2016 | Oakes |
| 9,526,362 | B2 | 12/2016 | Wang |
| 9,546,018 | B1 | 1/2017 | Vovan |
| 9,561,885 | B1 | 2/2017 | Studee |
| 9,656,418 | B2 | 5/2017 | Kezios |
| 9,669,992 | B2 | 6/2017 | Temple, Jr. |
| D793,231 | S | 8/2017 | Langfelder |
| D793,899 | S | 8/2017 | Tilbrook |
| 9,717,651 | B2 | 8/2017 | Hohl |
| 9,814,334 | B2 | 11/2017 | Eickhoff |
| 9,815,239 | B2 | 11/2017 | Borse |
| 10,113,058 | B2 | 10/2018 | Bockman |
| D838,590 | S | 1/2019 | Lee |
| D838,591 | S | 1/2019 | Lee |
| 10,201,241 | B2 | 2/2019 | Eickhoff |
| D845,128 | S | 4/2019 | Eickhoff |
| 10,286,593 | B2 | 5/2019 | Topolkaraev |
| D850,260 | S | 6/2019 | Eickhoff |
| D867,873 | S | 11/2019 | Troudt |
| D876,233 | S | 2/2020 | Pan |
| 10,570,263 | B2 | 2/2020 | Wallis |
| 10,577,159 | B2 | 3/2020 | Peng |
| D885,911 | S | 6/2020 | Silva |
| D885,912 | S | 6/2020 | Silva |
| D907,997 | S | 1/2021 | Eickhoff |
| D911,168 | S | 2/2021 | Eickhoff |
| 11,014,722 | B2 | 5/2021 | Peng |
| 11,040,499 | B2 | 6/2021 | Eickhoff |
| D930,476 | S | 9/2021 | Bontrager |
| D944,083 | S | 2/2022 | Boggs |
| D945,264 | S | 3/2022 | Eickhoff |
| D953,161 | S | 5/2022 | Tang |
| D955,160 | S | 6/2022 | Liu |
| 11,433,591 | B2 | 9/2022 | Eickhoff |
| D976,105 | S | 1/2023 | Eickhoff |
| 11,548,701 | B2 | 1/2023 | Peng |
| D984,894 | S | 5/2023 | Eickhoff |
| D993,770 | S | 8/2023 | Eickhoff |
| D993,771 | S | 8/2023 | Eickhoff |

(56) References Cited

U.S. PATENT DOCUMENTS

| | | | | |
|---|---|---|---|---|
| 11,891,488 | B2 | 2/2024 | Peng | |
| 2001/0001376 | A1 | 5/2001 | Kneppe | |
| 2002/0027139 | A1 | 3/2002 | ONeill | |
| 2002/0037378 | A1 | 3/2002 | Littlejohn | |
| 2002/0184985 | A1 | 12/2002 | Ishibuchi | |
| 2002/0189957 | A1 | 12/2002 | Gordon | |
| 2003/0062272 | A1 | 4/2003 | Gordon | |
| 2003/0089714 | A1* | 5/2003 | Dart | B65D 47/089 220/254.1 |
| 2003/0089726 | A1 | 5/2003 | Mazzarolo | |
| 2003/0114288 | A1 | 6/2003 | Harding | |
| 2003/0155353 | A1 | 8/2003 | Tucker | |
| 2003/0170460 | A1 | 9/2003 | Sienkiewicz | |
| 2003/0192890 | A1 | 10/2003 | Mazzarolo | |
| 2004/0011803 | A1 | 1/2004 | Damato | |
| 2004/0094553 | A1 | 5/2004 | Crider | |
| 2004/0101703 | A1 | 5/2004 | Funaki | |
| 2004/0134911 | A1 | 7/2004 | Padovani | |
| 2004/0144676 | A1 | 7/2004 | Rider | |
| 2004/0159080 | A1 | 8/2004 | Stewart | |
| 2004/0178199 | A1 | 9/2004 | Stroup | |
| 2004/0217033 | A1 | 11/2004 | Gordon | |
| 2004/0222226 | A1 | 11/2004 | Gottainer | |
| 2004/0245261 | A1 | 12/2004 | Stanos | |
| 2005/0037168 | A1 | 2/2005 | Dalgewicz | |
| 2005/0051442 | A1 | 3/2005 | Gordon | |
| 2005/0082177 | A1 | 4/2005 | Weiss | |
| 2005/0092749 | A1 | 5/2005 | Durdon | |
| 2005/0109780 | A1 | 5/2005 | Pendergrass | |
| 2005/0155969 | A1 | 7/2005 | Clarke | |
| 2005/0167294 | A1 | 8/2005 | Swayne | |
| 2005/0178766 | A1 | 8/2005 | Washington | |
| 2005/0210085 | A1 | 9/2005 | Bessiere | |
| 2005/0224505 | A1 | 10/2005 | Brown | |
| 2005/0230406 | A1 | 10/2005 | Maravich | |
| 2005/0263413 | A1 | 12/2005 | Harman | |
| 2005/0269328 | A1 | 12/2005 | Crider | |
| 2006/0060589 | A1 | 3/2006 | Lee | |
| 2006/0071008 | A1 | 4/2006 | Sadlier | |
| 2006/0096983 | A1 | 5/2006 | Patterson | |
| 2006/0097516 | A1 | 5/2006 | Kozlowski | |
| 2006/0180028 | A1 | 8/2006 | Burchard | |
| 2006/0213908 | A1 | 9/2006 | Clarke | |
| 2006/0226148 | A1 | 10/2006 | Hundley | |
| 2006/0255038 | A1 | 11/2006 | Hollis | |
| 2007/0007298 | A1 | 1/2007 | Tucker | |
| 2007/0034629 | A1 | 2/2007 | Mazzarolo | |
| 2007/0062943 | A1 | 3/2007 | Bosworth | |
| 2007/0075080 | A1 | 4/2007 | Farnsworth | |
| 2007/0107578 | A1 | 5/2007 | Koelsch | |
| 2007/0246862 | A1 | 10/2007 | Jones | |
| 2008/0035681 | A1 | 2/2008 | Skillin | |
| 2008/0097516 | A1 | 4/2008 | Chang | |
| 2008/0105696 | A1 | 5/2008 | Dart | |
| 2008/0197134 | A1 | 8/2008 | Maxwell | |
| 2008/0230176 | A1 | 9/2008 | Van de Weijer | |
| 2008/0245792 | A1 | 10/2008 | Chou | |
| 2009/0026219 | A1 | 1/2009 | Bal | |
| 2009/0223961 | A1 | 9/2009 | Wang | |
| 2009/0266829 | A1 | 10/2009 | Bailey | |
| 2009/0272742 | A1 | 11/2009 | Dybala | |
| 2009/0308882 | A1 | 12/2009 | Hundley | |
| 2009/0313956 | A1 | 12/2009 | Martinez Sampedro | |
| 2010/0037780 | A1 | 2/2010 | Pas | |
| 2010/0255137 | A1 | 10/2010 | Mazzarolo | |
| 2010/0282400 | A1 | 11/2010 | Sekar | |
| 2011/0011863 | A1 | 1/2011 | Hollis | |
| 2011/0062173 | A1 | 3/2011 | Trotter | |
| 2011/0089187 | A1 | 4/2011 | Steiger | |
| 2011/0124817 | A1 | 5/2011 | Dias | |
| 2011/0272318 | A1 | 11/2011 | Gallop | |
| 2011/0284564 | A1 | 11/2011 | Hsieh | |
| 2011/0297573 | A1 | 12/2011 | Chen | |
| 2012/0024871 | A1 | 2/2012 | Hundley | |
| 2012/0048856 | A1 | 3/2012 | Walker | |
| 2012/0097690 | A1 | 4/2012 | Chien | |
| 2012/0113488 | A1 | 5/2012 | Machida | |
| 2012/0132699 | A1 | 5/2012 | Mann | |
| 2012/0208961 | A1 | 8/2012 | Carnahan | |
| 2012/0261417 | A1 | 10/2012 | Tabor | |
| 2012/0272622 | A1 | 11/2012 | Weiss | |
| 2012/0298032 | A1 | 11/2012 | Mazzarolo | |
| 2013/0020338 | A1 | 1/2013 | French | |
| 2013/0037558 | A1 | 2/2013 | Selina | |
| 2013/0142975 | A1 | 6/2013 | Wallace | |
| 2013/0277380 | A1 | 10/2013 | Koestring | |
| 2014/0072674 | A1 | 3/2014 | Holinda, Jr. | |
| 2014/0224805 | A1 | 8/2014 | Merbach | |
| 2014/0238583 | A1 | 8/2014 | Sekar | |
| 2014/0238584 | A1 | 8/2014 | Sekar | |
| 2014/0263378 | A1 | 9/2014 | Bolek | |
| 2014/0284344 | A1 | 9/2014 | French | |
| 2014/0325715 | A1 | 10/2014 | Wendeln | |
| 2015/0014090 | A1 | 1/2015 | Masor | |
| 2015/0021345 | A1 | 1/2015 | Wu | |
| 2015/0094406 | A1 | 4/2015 | Miley | |
| 2015/0191282 | A1 | 7/2015 | Crudgington | |
| 2015/0216342 | A1 | 8/2015 | Tabor | |
| 2015/0251818 | A1 | 9/2015 | Strachan | |
| 2015/0337059 | A1 | 11/2015 | Guylaine | |
| 2015/0344647 | A1 | 12/2015 | Maeda | |
| 2015/0367566 | A1 | 12/2015 | Schwab | |
| 2016/0000243 | A1 | 1/2016 | Tedford, Jr. | |
| 2016/0000269 | A1 | 1/2016 | Van Puijenbroek | |
| 2016/0016389 | A1 | 1/2016 | Dias | |
| 2016/0016702 | A1 | 1/2016 | Siskindovich | |
| 2016/0058223 | A1 | 3/2016 | Savenok | |
| 2016/0075487 | A1 | 3/2016 | Lin | |
| 2016/0081280 | A1 | 3/2016 | Moore | |
| 2016/0090218 | A1 | 3/2016 | Sun | |
| 2016/0107786 | A1 | 4/2016 | Lin | |
| 2016/0113424 | A1 | 4/2016 | Eickhoff | |
| 2016/0137364 | A1 | 5/2016 | Pirrella | |
| 2016/0160004 | A1 | 6/2016 | Skaggs | |
| 2016/0167855 | A1 | 6/2016 | Umbarger | |
| 2016/0318686 | A1 | 11/2016 | Russell | |
| 2016/0355327 | A1 | 12/2016 | Minganti | |
| 2017/0008187 | A1 | 1/2017 | Iwai | |
| 2017/0029189 | A1 | 2/2017 | Sanders | |
| 2017/0043913 | A1 | 2/2017 | Strachan | |
| 2017/0121089 | A1 | 5/2017 | Gillblad | |
| 2017/0137159 | A1 | 5/2017 | Sullivan | |
| 2018/0022012 | A1 | 1/2018 | Rapparini | |
| 2018/0050826 | A1 | 2/2018 | Hartman | |
| 2018/0127161 | A1 | 5/2018 | Smith | |
| 2018/0133919 | A1 | 5/2018 | Waterman | |
| 2018/0290798 | A1 | 10/2018 | Peng | |
| 2019/0039328 | A1 | 2/2019 | Eickhoff | |
| 2020/0024039 | A1 | 1/2020 | Chou | |
| 2020/0029712 | A1 | 1/2020 | O'Nan | |
| 2020/0055640 | A1 | 2/2020 | Lee | |
| 2020/0247034 | A1 | 8/2020 | Eickhoff | |
| 2020/0247967 | A1 | 8/2020 | Peng | |
| 2021/0047083 | A1* | 2/2021 | Eickhoff | B65D 47/0833 |
| 2021/0253318 | A1 | 8/2021 | Waterman | |
| 2022/0041341 | A1 | 2/2022 | Eickhoff | |
| 2022/0097925 | A1 | 3/2022 | Baird | |
| 2023/0105117 | A1 | 4/2023 | Waterman | |

FOREIGN PATENT DOCUMENTS

| | | | |
|---|---|---|---|
| CN | 99813627 | | 1/1999 |
| CN | 99813014 | | 9/1999 |
| DE | 20116771 | U1 | 12/2001 |
| DE | 20301404 | U1 | 4/2003 |
| DE | 202016006730 | U1 | 2/2018 |
| EP | 0934893 | A1 | 8/1999 |
| EP | 1319493 | A1 | 6/2003 |
| EP | 1464458 | B1 | 10/2004 |
| EP | 1208958 | B1 | 1/2006 |
| EP | 1837138 | B1 | 9/2007 |
| FR | 2484903 | A1 | 12/1981 |
| GB | 1496299 | A | 12/1977 |
| JP | H09171322 | A | 6/1997 |

(56) References Cited

FOREIGN PATENT DOCUMENTS

| | | | |
|---|---|---|---|
| JP | 11040499 | A | 2/1999 |
| JP | 2002104686 | A | 4/2002 |
| JP | 2002210616 | A | 7/2002 |
| JP | 2002210818 | A | 7/2002 |
| JP | 2002241514 | A | 8/2002 |
| JP | 2002241515 | A | 8/2002 |
| JP | 2004025802 | A | 1/2004 |
| JP | 2004106519 | A | 4/2004 |
| JP | 2009281529 | A | 12/2009 |
| WO | 1999017923 | A1 | 4/1999 |
| WO | 0018662 | | 4/2000 |
| WO | 0018663 | | 4/2000 |
| WO | 0185575 | | 11/2001 |
| WO | 03011716 | | 2/2003 |
| WO | 2004014776 | | 2/2004 |
| WO | 2005013247 | A1 | 2/2005 |
| WO | 2010018749 | A1 | 2/2010 |
| WO | 2011149583 | A2 | 12/2011 |

OTHER PUBLICATIONS

Dixie Long-Skirt Selector Lid: Site Visited (Nov. 30, 2022). Available from URL: https://caljaninc.com/catalog/p/DXE- 914LSRD/Dixie-Long-Skirt-Selector-Lid-For-12-16-21-oz/.
Office Action dated Dec. 8, 2022 for U.S. Appl. No. 29/843,255, (pp. 1-8).
Office Action dated Dec. 8, 2022 for U.S. Appl. No. 29/843,256, (pp. 1-8).
Supplementary European Search Report for European App. No. 20753051.0 dated Jan. 3, 2023, 13 pages.
European Examination Report for EP 18780978.5 dated Nov. 25, 2022, 5 pages.
Extended European Search Report for EP 20852216.9 dated Sep. 11, 2023, 7 pages.
European Extended Search Report for EP23180774.4 dated Sep. 25, 2023, 9 pages.
Office Action dated Sep. 22, 2023 for U.S. Appl. No. 29/896,014 (pp. 1-9).
12SL Foam Cup Straw Lid: Announced (May 24, 2019 online). Site visited (Sep. 18, 2023). Available from URL: https:// www.mrplasticsinc.com/12oz-foam-cup-straw-slotted-lid-match-12j12-1000ps.
PET Thermoform Flat Lid with FLavor Buttons: Site Visited (Sep. 14, 2023; online). Available from URL: https:// www.berryglobal.com/en/product/lids/47inches-pet-thermoform-flat-lid-with-flavor-buttons-13183158.
Fabri-Kal Greetware: Site Visited (Sep. 18, 2023). Available from URL: https://www.officedepot.com/a/products/1639774/ Fabri-Kal-Greenware-Cold-Drink-Cup/.
Office Action dated Sep. 22, 2023 for U.S. Appl. No. 29/896,017 (pp. 1-9).
Office Action dated Oct. 10, 2023 for U.S. Appl. No. 29/798,668, (pp. 1-10).
International (PCT) Preliminary Report on Patentability dated Feb. 7, 2023, 10pages.
Office Action (Final Rejection) dated May 20, 2024 for U.S. Appl. No. 18/127,353, (pp. 1-19).
Office Action (Non-Final Rejection) dated Dec. 21, 2023 for U.S. Appl. No. 17/395,182, (pp. 1-13).
Office Action (Non-Final Rejection) dated Dec. 21, 2023 for U.S. Appl. No. 18/127,353, (pp. 1-19).
Office Action (Non-Final Rejection) dated Jan. 31, 2024 for U.S. Appl. No. 18/217,763 (pp. 1-10).
Third Chinese Office Action for Chinese App. No. 201880065303.8 dated Jan. 5, 2023, 12 pages.
Black Plastic Straw: Announced (May 19, 2022; online). Site Vistied (Dec. 17, 2022). Available from URL: https://www.restaurantware.com/disposables/coffee-cups-accessories/coffee-cup-lids/black-plastic-2-in-1-straw-or-sip-coffee-cup-lid-fits-8- 12-16-and-20-oz-100-count-box/.
Black Flip Top Hot Cup Lid: Announced (Sep. 9, 2020 (online)). Site Visited (Dec. 17, 2022). Available from URL: https://hotcupfactory.com/collections/hot-cup-lids/products/black-flip-top-hot-cup-lids-8-10-12-16-20-22-oz.
English translation of JP-2004025802-A by EPO (OA Appendix) (Year: 2004).
English translation of JP-2002210818-A by EPO (OA Appendix) (Year: 2002).
Office Action dated Jul. 5, 2023 for U.S. Appl. No. 16/782,165, (pp. 1-7).
Office Action (Final Rejection) dated Jul. 5, 2023 for U.S. Appl. No. 16/782,165 (pp. 1-14).
Extended European Search Report for European Patent App. No. EP21853805.6 dated Jul. 23, 2024, 8 pages.
Kocsis et al. The Polypropylene Handbook (Year: 2018).
Entec Stress Whitening in Polypropylene (Year: 2020).
Office Action (Non-Final Rejection) dated Jul. 17, 2024 for U.S. Appl. No. 18/399,886 (pp. 1-21).
Office Action (Non-Final Rejection) dated Jun. 20, 2024 for U.S. Appl. No. 18/101,385, (pp. 1-17).
Extended European Search Report for European Patent App. No. EP24204859.3 dated Nov. 12, 2024, BP-558 EP-DIV1 ||, 8 pages.
Canadian Office Action for Canadian App. No. 3072302 sent Sep. 23, 2024, BP-516 CA ||, 3 pages.
Office Action (Non-Final Rejection) dated Dec. 12, 2024 for U.S. Appl. No. 18/125,308 (pp. 1-26).
Canadian Examination Report for Canadian Patent App. No. 3,129,224 dated Jan. 17, 2025, BP-535 CA ||, 3 pages.
Office Action (Non-Final Rejection) dated Feb. 14, 2025 for U.S. Appl. No. 18/101,385 (pp. 1-15).
Canadian Examiner's Report for Canadian App. No. CA3129416 dated Feb. 7, 2025, BP-534 CA ||, 4 pages.
European Examination Report for European App. No. 20753137.7 dated Apr. 15, 2025, BP-534 EP ||, 5 pages.
English translation of JP-2009281529-A by EPO. (Year: 2009).
Office Action (Final Rejection) dated May 22, 2025 for U.S. Appl. No. 18/125,308 (pp. 1-33).
Polymer Properties of Omnexus—Haze (https://web.archive.Org/web/20170519201652/https://omnexus.specialchem.com/polymer-properties/properties/haze, available in public at least on or after May 19, 2017) (Year: 2017).
Impact Plastics Blog (http://blog.impactplastics-ct.com/blog/basic-guide-to-the-three-main-grades-of-polypropylene-resin, available in public from the date May 16, 2017) (Year: 2017).
Canadian Filing of Prior Art Under Section 34.1(1) of the Canadian Patent Act by Third Party, Aug. 7, 2020, 20 pages.
Chartier Octagonal Wall Modern and Contemporary Accent Mirror: Site Visited [Sep. 14, 2020. Available from Internet URL: https://www.wayfair.com/decor-pillows/pdp/eichholtz-chartier-octagonal-wall-modern-and-contemporary-accent-mirror-eitz2666.html.
Nathan Wall Mounted Mirror: Announced Jul. 2, 2020 [online]. Site Visited [Sep. 14, 2020], Available from Internet URL: https://www.wayfair.com/decor-pillows/pdp/house-of-hampton-nathan-wall-mounted-mirror-hmpt5079.html.
Office Action dated Dec. 30, 2020 for U.S. Appl. No. 15/172,650, (pp. 1-24).
International (PCT) Search Report and Written Opinion for PCT/US20/46469 dated Nov. 30, 2020, 9 pages.
European Search Report for European App. No. 18780978.5 dated Jan. 28, 2021, 8 pages.
European Search Report for European App. No. 18844658.7 dated Apr. 4, 2021, 11 pages.
Office Action dated Jul. 1, 2021 for U.S. Appl. No. 15/172,650, (pp. 1-6).
First Chinese Office Action for Chinese Patent App. No. 20180065303.8 dated Jun. 15, 2021, 12 pages.
European First Substantive Examination Report for European App. No. 18780978.5 dated Aug. 24, 2021, 4 pages.
Office Action dated Nov. 23, 2021 for U.S. Appl. No. 16/782,203, (pp. 1-36).
"Polymers and Environment," by Ojeda, available at https://www.intechopen.com/chapters/42104, published on Jan. 23, 2013. ( Year: 2013).

(56) References Cited

OTHER PUBLICATIONS

Office Action dated Jan. 14, 2022 for U.S. Appl. No. 29/761,992, (pp. 1-8).
Octagonal Wall Mirror: Announced Aug. 26, 2019 [online]. Site Visite [Jan. 10, 2022. Available from Internet URL: https://www.wayfair.com/decor-pillows/pdp/house-of-hampton-nathan-wall-mounted-mirror-hmpt5079.html, 16 pages.
International (PCT) Search Report and Written Opinion for PCT/US21/44766 dated Jan. 11, 2022, 14 pages.
Second Chinese Office Action for Chinese Patent App. No. 20180065303.8 dated Jun. 24, 2022, 9 pages.
Thermoform Spill Resistant Flat Lid: Site Visited [Feb. 15, 2022]. Available from Internet URL: https://catalog.berryglobal.com/ products/lid/liddrink/dlt408srcp.
Office Action dated Feb. 22, 2022 for U.S. Appl. No. 29/765,808, (pp. 1-8).
Chinese Rejection Decision for Chinese Patent App. No. 20180065303.8 dated May 27, 2022, 12 pages.
European Search Report for European App. No. 20753137.7 dated Sep. 1, 2022, 6 pages.
Office Action dated Aug. 26, 2022 for U.S. Appl. No. 29/765,808, (pp. 1-5).
European Search Report for European App. No. 20753051.0 dated Sep. 23, 2022, 15 pages.
Solo PET Plastic Flat Cold Cup Lids: Announced (Oct. 28, 2020 (online)) Site Visited (Sep. 20, 2022). Available from Internet URL: https://www.dartcontainer.com/products/foodservice-catalog/accessories/lids/solo-pet-plastic-flat-cold-cup-lids/668ns/.
Office Action (Non-Final Rejection) dated Oct. 5, 2022 for U.S. Appl. No. 17/550,292 (pp. 1-13).
International (PCT) Search Report and Written Opinion for PCT/US2022/035911 dated Oct. 5, 2022, 8 pages.
Office Action (Non-Final Rejection) dated Mar. 16, 2023 for U.S. Appl. No. 16/782,165, (pp. 1-14).
Office Action dated Apr. 13, 2023 for U.S. Appl. No. 29/798,668, (pp. 1-9).
International Search Report for PCT/US06/32565, dated May 24, 2007.
Supplementary European Search Report dated Apr. 6, 2009, for European Patent Application No. 05735742.8.
International Search Report and Written Opinion dated Jul. 9, 2008, for PCT/US2008/054888.
Supplementary European Search Report dated Jul. 28, 2008, for European Patent Application No. 06813520.1.
International Search Report and Written Opinion for International Application No. PCT/US2014/006277, Jul. 15, 2014, 8 pages.
Notice of Non-Final Rejection for U.S. Appl. No. 13/448,050, filed Oct. 8, 2014, 13 pages.
Notice of Non-Final Rejection for U.S. Appl. No. 13/554,771, filed Jun. 7, 2013, 14 pages.
Notice of Non-Final Rejection for U.S. Appl. No. 14/214,236, filed Oct. 3, 2014, 10 pages.
PCT International Search Report and Written Opinion completed by the ISA/US on Jun. 19, 2014 and issued in connection with PCT/US2014/027067.
Chinse Office Action for Chinese Patent Application 201480010419.3 dated Jul. 19, 2016, 8 pages.
Extended European Search Report for European Patent Application No. 14768275.1, mailed Sep. 14, 2016, 7 pages.
Office Action dated Sep. 30, 2016 for U.S. Appl. No. 14/214,236.
Chinese Office Action for Chinese App. No. 201480010419.3 dated Dec. 22, 2016, 4 pages.
Office Action dated Apr. 3, 2017 for U.S. Appl. No. 14/921,540.
Australian Search Report for Australian App. No. 2014240016 sent Mar. 17, 2017, 3 pages.
Office Action dated May 15, 2017 for U.S. Appl. No. 14/214,236.
Singapore Written Opinion for Singapore Patent App. No. 11201507343Y dated Sep. 6, 2017, 6 pages.
Office action dated Jun. 14, 2017 for U.S. Appl. No. 14/921,540; (pp. 1-8).
Australian Search Report for Australian App. No. 2014240016 sent Aug. 25, 2017, 3 pages.
Office Action mailed Oct. 6, 2017 for U.S. Appl. No. 15/485,299; (pp. 1-5).
Japanese Office Action for Japanese App. No. 2016-502328 sent Oct. 3, 2017, 11 pages.
Office Action dated Jan. 16, 2018 for U.S. Appl. No. 14/214,236; (pp. 1-13).
Russian Office Action and Search Report for Russian App. No. 2015134775 sent on Mar. 13, 2018, 10 pages.
Japanese Office Action for Japanese App. No. 2016-502328 sent Mar. 6, 2018, 4 pages.
Emvato Tuts+. Create a Set of Flat Precious Gems Icons in Adobe Illustrator by Yulia Sokolova. Apr. 9, 2014 [earliest online date], [ site visited Feb. 22, 2018]. Available from Internet, <URL:https://design.tutsplus.com/tutorials/ create-a-set-of-flat-precious-gems-icons-in-adobe-illustrator--vector-26188>. (Year: 2014), 77 pages.
Office Action dated Apr. 4, 2018 for U.S. Appl. No. 29/599,942 (pp. 1-5).
Infinity Blade Wiki. Hexagon gem. Nov. 17, 2013 [earliest online date], [site visited Feb. 22, 2018]. Available from Internet, <URL:http://infinityblade.wikia.conn/wiki/Hexagon gem>. (Year: 2013), 1 page.
Office Action dated Apr. 4, 2018 for U.S. Appl. No. 29/599,948 (pp. 1-5).
Office Action dated Apr. 16, 2018 for U.S. Appl. No. 15/485,299, (pp. 1-4).
Office Action dated Jul. 10, 2018 for U.S. Appl. No. 15/172,650, (pp. 1-9).
Office Action dated Jul. 5, 2018 for U.S. Appl. No. 29/599,942, (pp. 1-4).
Blogspot. The Herman Letters. Jul. 12, 2011 [earliest online date], [site visited Jul. 23, 18]. Available from Internet, <URL: http://theherrnanletters.blogspot.corn/2011/07/ipost-190-is-rncdonalds-selling-p.htrnl>. (Year: 2011).
Office Action dated Jul. 27, 2018 for U.S. Appl. No. 29/599,948, (pp. 1-5).
Office Action dated Nov. 30, 2018 for U.S. Appl. No. 29/599,948, (pp. 1-5).
Office Action dated Jan. 7, 2019 for U.S. Appl. No. 15/172,650, (pp. 1-9).
International (PCT) Search Report and Written Opinion for PCT App. No. PCT/US18/264467 mailed Jul. 3, 2018, 11 pages.
International (PCT) Search Report and Written Opinion for PCT/US18/45575 established Oct. 19, 2018, 13 pages.
Office Action dated Sep. 12, 2019 for U.S. Appl. No. 15/946,023, (pp. 1-15).
First Examination Report for Indian App. No. 8804/DELNP/2015 sent Oct. 30, 2019, 6 pages.
Office Action mailed Mar. 19, 2020, for U.S. Appl. No. 15/172,650, (pp. 1-11).
Office Action dated Mar. 19, 2020, for U.S. Appl. No. 15/172,650 (pp. 1-11).
Third Party Submission Under 37 CFR 1.290 in U.S. Appl. No. 16/057,122, dated Apr. 16, 2020, 49 pages.
Solo 668NS: Site Visited [Apr. 30, 2020]. Available from Internet URL: https://www.dartcontainer.com/products/foodservice-catalog/accessories/lids/solo-pet-plastic-flat-cold-cup-lids/668ns/ 1/2.
Single Use Spill REsistant Flat Lid_Berry Global: Site Visited [Apr. 30, 2020]. Available from Internet URL: https://catalog.berryglobal .com/products/lid/liddrink/dlt308srcp.
Thermoform Strawless Lid with Straw Slot_Berry Global: Site Visited [Apr. 30, 2020]. Available from Internet URL: https://catalog. berryglobal .com/products/lid/liddrink/dlt402ssl p.
International Search Report and Writen Opinion dated Apr. 29, 2020, 11 pages.
International (PCT) Search Report and Written Opinion for PCT/2020/016769 dated May 27, 2020, 12 pages.
Office Action dated Aug. 6, 2020 for U.S. Appl. No. 16/736,849, (pp. 1-18).
Office Action dated Aug. 20, 2020 for U.S. Appl. No. 16/057,122, (pp. 1-20).

(56) References Cited

OTHER PUBLICATIONS

Polymer Properties of Omnexus—Transparency (https://web.archive.Org/web/20170406012756/https://omnexus.specialchem.com/ polymer-properties/properties/transparency, available in public at least on or after Apr. 6, 2017) (Year: 2017).
European Search Report for European Patent App. No. EP24204859.3 dated Jul. 31, 2025, 3 pages.

* cited by examiner

DRINK CUP LID

PRIORITY CLAIM

This application claims priority under 35 U.S.C. § 119(e) to U.S. Provisional Application Ser. No. 63/218,672, filed Jul. 6, 2021, which is expressly incorporated by reference herein.

BACKGROUND

The present disclosure relates to drink cups, and particularly to lids for drink cups. More particularly, the present disclosure relates to a lid formed to include a liquid-discharge outlet through which a consumer can sip a beverage contained in a drink cup carrying the lid.

SUMMARY

In accordance with the present disclosure, a drink cup lid includes a ring-shaped brim mount adapted to mate with a brim of a drink cup and a central closure surrounded by the ring-shaped brim mount. The central closure is coupled to an inner edge of the ring-shaped brim mount and includes an annular top wall and an outer wall arranged to extend around an entirety of a circumferential extent of the annular top wall and downwardly from the annular top wall toward an interior region surrounded by the ring-shaped brim mount. The annular top wall is formed to include a top aperture and an adjacent liquid-discharge outlet.

In illustrative embodiments, the drink cup lid further includes an outlet closure coupled to the annular top wall of the central closure and a closure retainer aligned with the top aperture. The outlet closure is configured to move about a horizontally extending pivot axis between a closed position arranged to close the liquid-discharge outlet formed in the annular top wall of the central closure and an opened position arranged to extend away from the liquid-discharge outlet. The closure retainer is coupled to the annular top wall of the central closure and is configured to retain the outlet closure in a stationary position relative to the outer wall upon movement of the outlet closure from the closed position to the opened position. In some embodiments, at least half of the circumferential extent of the annular top wall has a constant radial width.

In illustrative embodiments, the outlet closure includes a closure plate, an upstanding closure-anchor lug coupled to the closure plate, and a hinge coupled to the closure plate and to the annular top wall and configured to establish the horizontal pivot axis. The hinge is coupled to a portion of the annular top wall between the liquid-discharge outlet and the top aperture. The width of the closure plate measured in a direction of the horizontal pivot axis is greater than a width of the hinge in the direction of the horizontal pivot axis.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
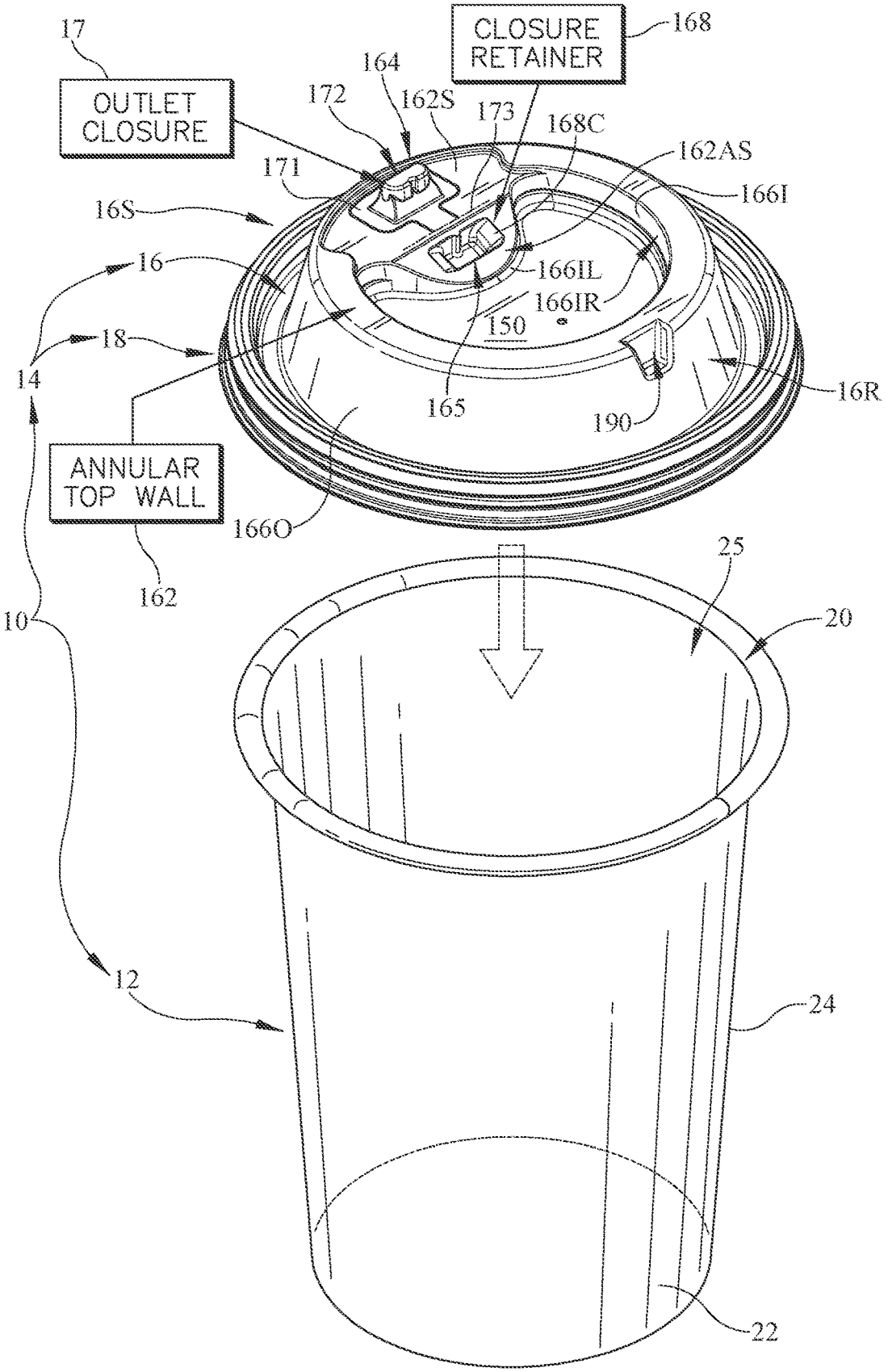
FIG. 1 is a perspective view of a lid in accordance with the present disclosure and a cup before the lid is mounted on the cup and showing that the lid includes a ring-shaped brim mount adapted to mate with the brim of the cup, a central closure surrounded by the brim mount and formed to include an annular top wall formed to include a top aperture and an adjacent liquid-discharge outlet and an outer wall arranged to extend around an entirety of a circumferential extent of the annular top wall and downwardly from the annular top wall toward an interior region surrounded by the ring-shaped brim mount, and an outlet closure mounted for pivotable movement between an outlet-closing position shown in FIGS. 1-3 and 5A and an outlet-opening position shown in FIGS. 4, 5B, and 5C.

A first embodiment of a liquid container 10 is shown in FIGS. 1-5C. In one example, the liquid container 10 includes a cup 12 and a lid 14, the lid 14 including a central closure 16 having an annular top wall 162, an outer wall 166, and an inner wall 167 configured to maintain their shape in response to the cup 12 being filled with hot liquid and in response to a consumer moving a pivotable outlet closure 17 from the outlet-closing position to an outlet-opening position. A second embodiment of a liquid container 200 is shown in FIGS. 6-10C. Another embodiment of a liquid container 400 is shown in FIGS. 11-15C.

A liquid container 10 in accordance with a first embodiment of the present disclosure includes a cup 12 and a lid 14 as shown in FIGS. 1-5C. The lid 14 includes a central closure 16 formed to include a liquid-discharge outlet 164, a pivotable outlet closure 17, and a brim mount 18 coupled to the central closure 16 and configured to be mounted on a brim 20 of the cup 12 to arrange the central closure 16 to close a cup mouth 21 opening into an interior region 25 formed in the cup 12 as suggested in FIG. 1. In the illustrative embodiment, the lid 14 is made of polypropylene using a thermoforming process or other suitable process in illustrative embodiments.

Figure 2:
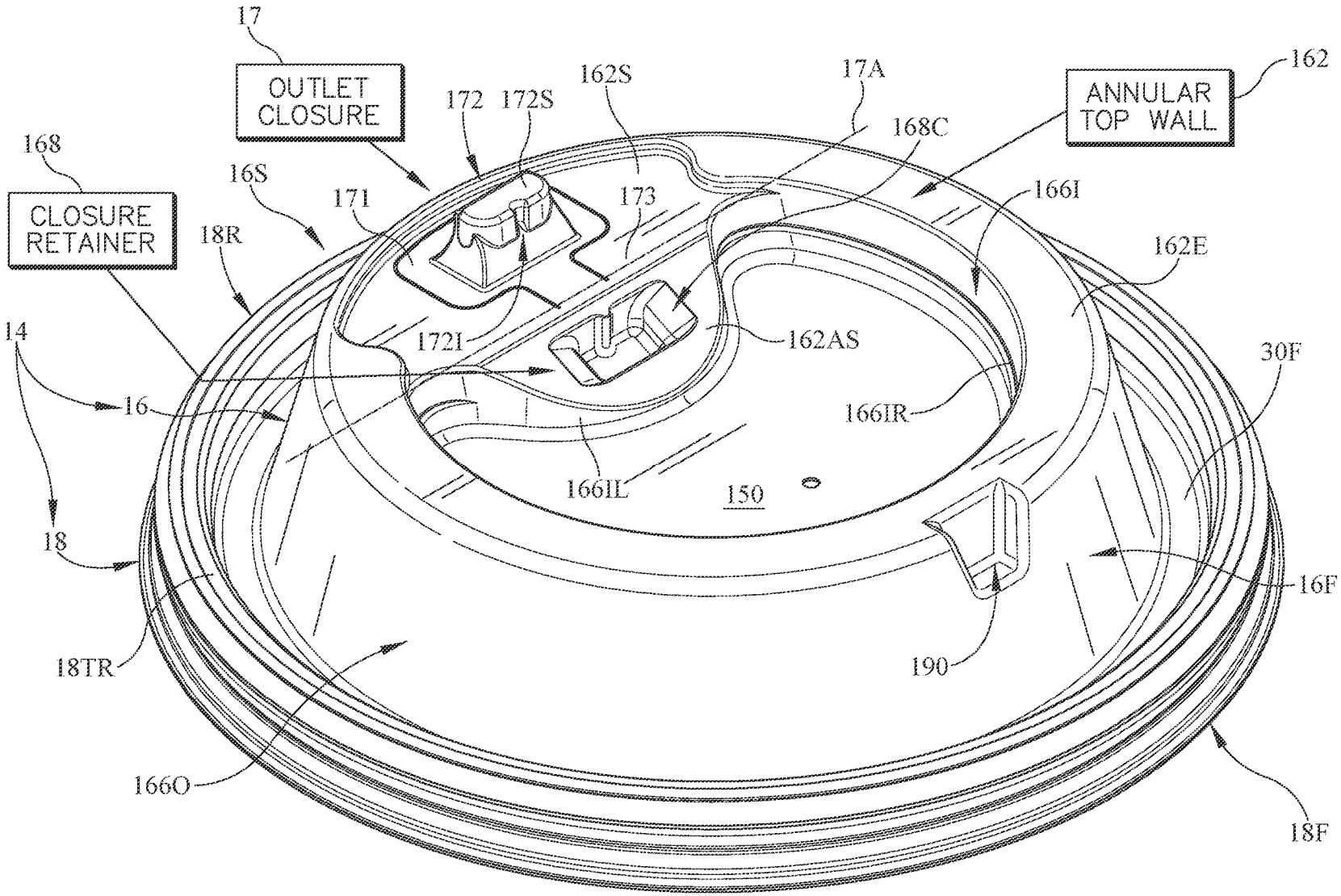
FIG. 2 is an enlarged perspective view of the lid of FIG. 1 showing the outlet closure in the closed position, showing that the lid further includes an inner wall that extends downwardly from an inner edge of the annular top wall of the central closure, and showing that the top aperture is located between the liquid-discharge outlet and a serpentine-shaped portion of inner wall on an inwardly sloped top aperture portion of a sunken portion of the annular top wall.
Figure 5A:
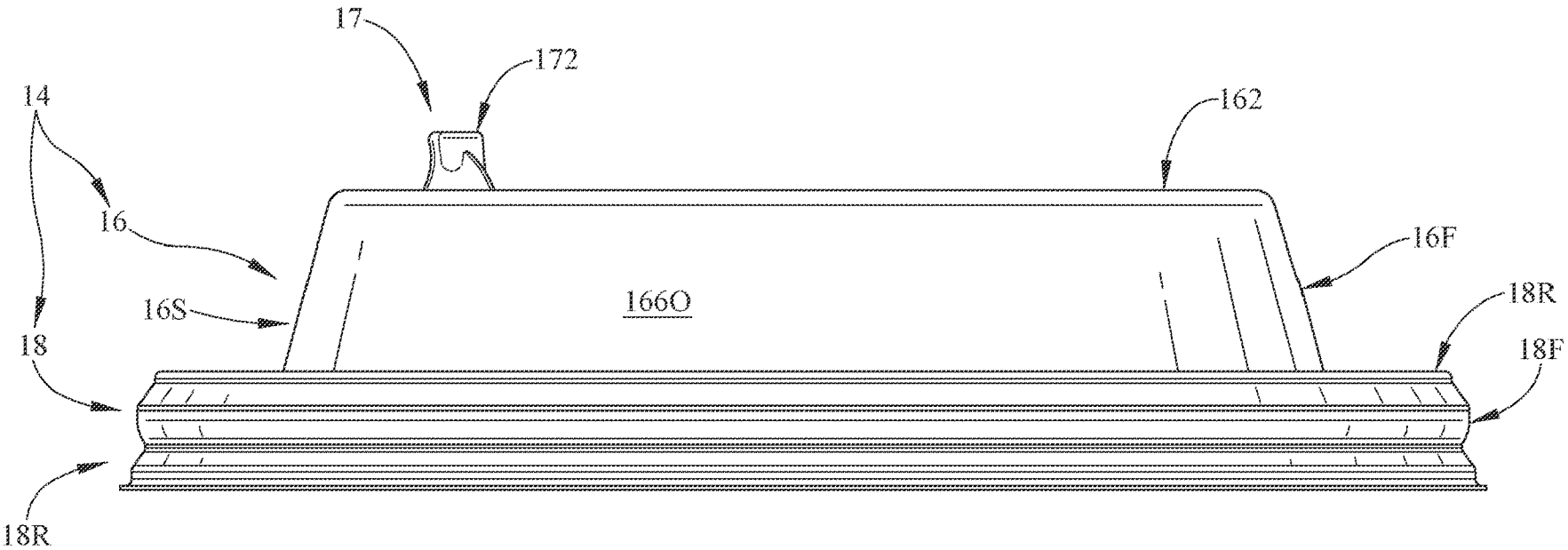
FIG. 5A is a side elevation view of the lid shown in FIG. 2 showing the outlet closure in the outlet-closing position to cause the closure anchor of the outlet closure to extend upwardly away from the generally horizontal annular top wall of the central closure.
Figure 5B:
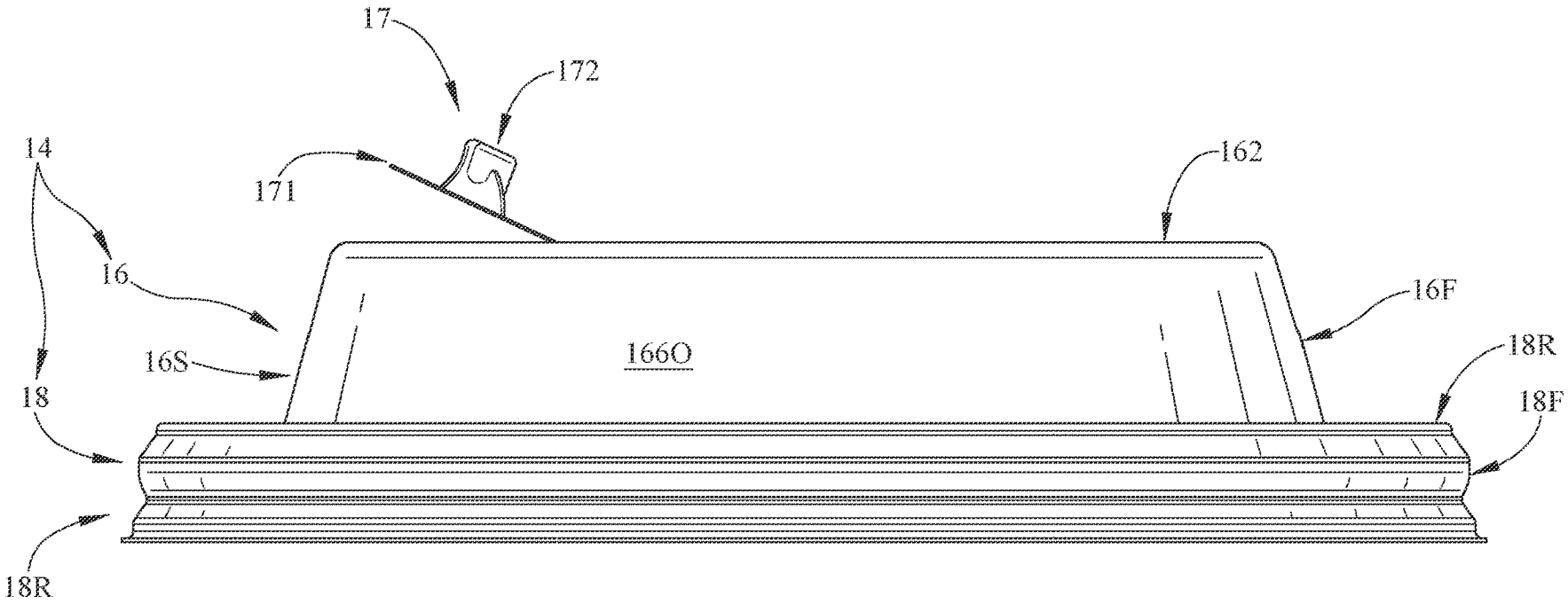
FIG. 5B is a view similar to FIG. 4A showing the orientation of the outlet closure during pivoting movement of the outlet closure from the outlet-closing position shown in FIGS. 1-3 and 5A and an outlet-opening position shown in FIGS. 4, 5B, and 5C.
Figure 5C:
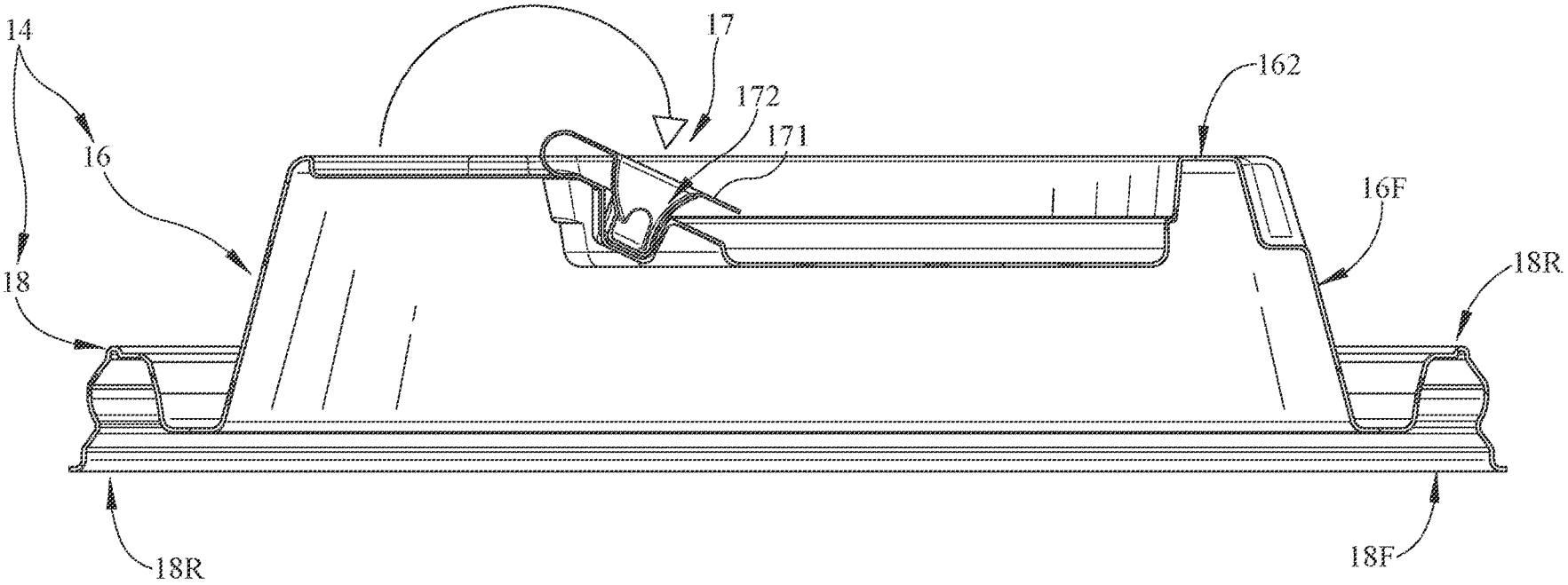
FIG. 5C is a cross sectional view through line 5C in FIG. 3 showing the orientation of the outlet closure upon arrival at the outlet-opening position shown in FIGS. 4, 5B, and 5C.

The central closure 16 includes a generally horizontal annular top wall 162 and a closure retainer 168 coupled to an underside of top wall 162 as suggested in FIGS. 1, 2, and 5C. The annular top wall 162 is formed to include a liquid-discharge outlet 164 and a top aperture 165 opening into a lug-receiving cavity 168C formed in the closure retainer 168. The central closure 16 also includes an outer wall 1660 extending around and downwardly away from an outer perimeter edge of the annular top wall 162 and an inner wall 1661 arranged to extend around and downwardly away from an inner perimeter edge of the annular top wall 162.

Figure 3:
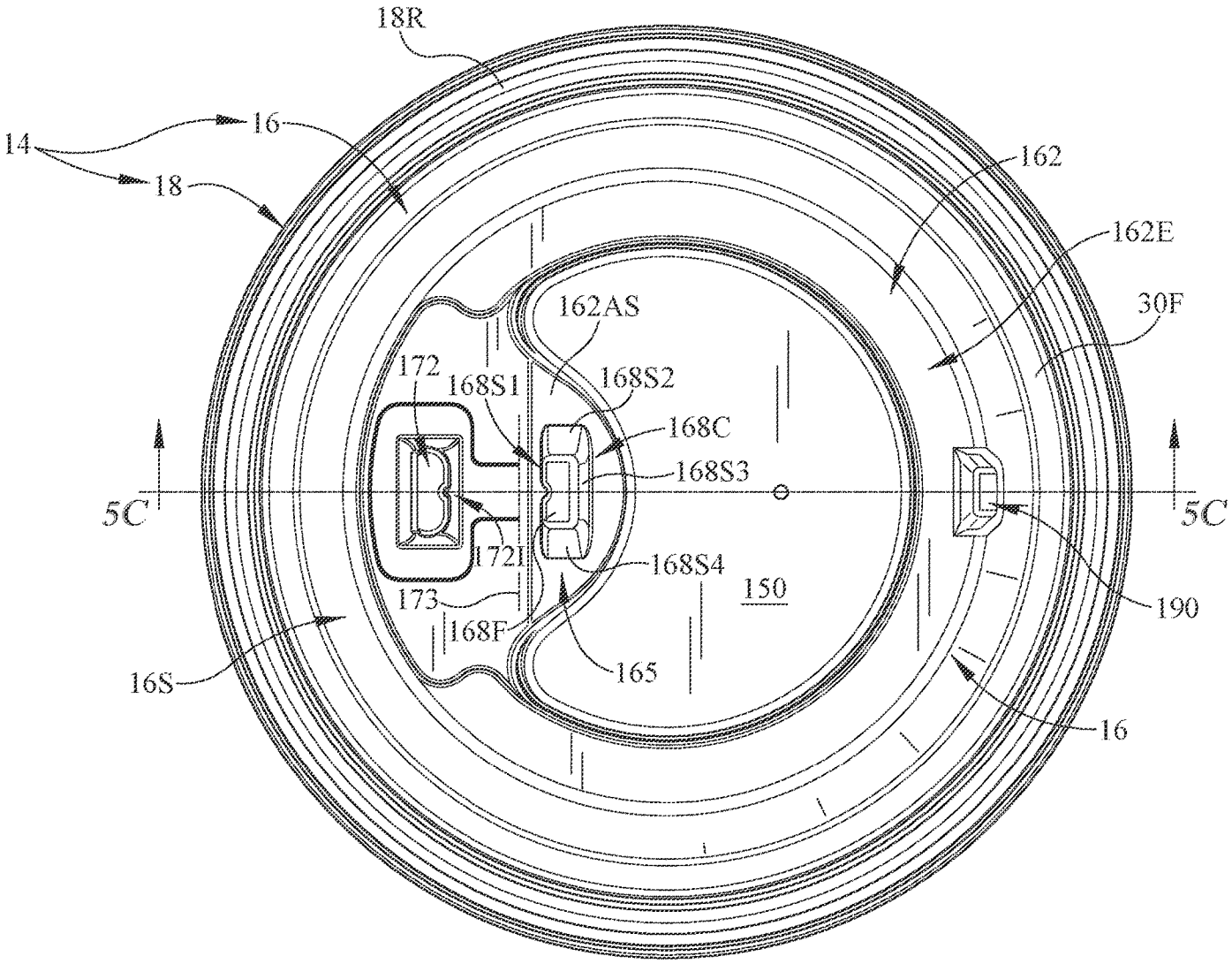
FIG. 3 is an enlarged top view of the lid of FIG. 1 showing the outlet closure in the closed position and that the top aperture is located between the liquid-discharge outlet and the serpentine-shaped portion of inner wall on the inwardly sloped top aperture portion of the sunken portion of the annular top wall.

A lowered portion 166IL of the inner wall 1661 that extends from an inwardly angled top aperture surface 162AS of the annular top wall 162 has a smaller height than a constant height portion 166IC of the inner wall 1661 that extends around the remainder of the inner edge of the annular top wall 162, as shown in FIGS. 1-3. The top aperture 165 is formed in the annular top wall 162 to lie in a position that is located between liquid-discharge outlet 164 and the lowered portion 166IL of the inner wall 1661 as suggested in FIGS. 1-3.

Figure 4:
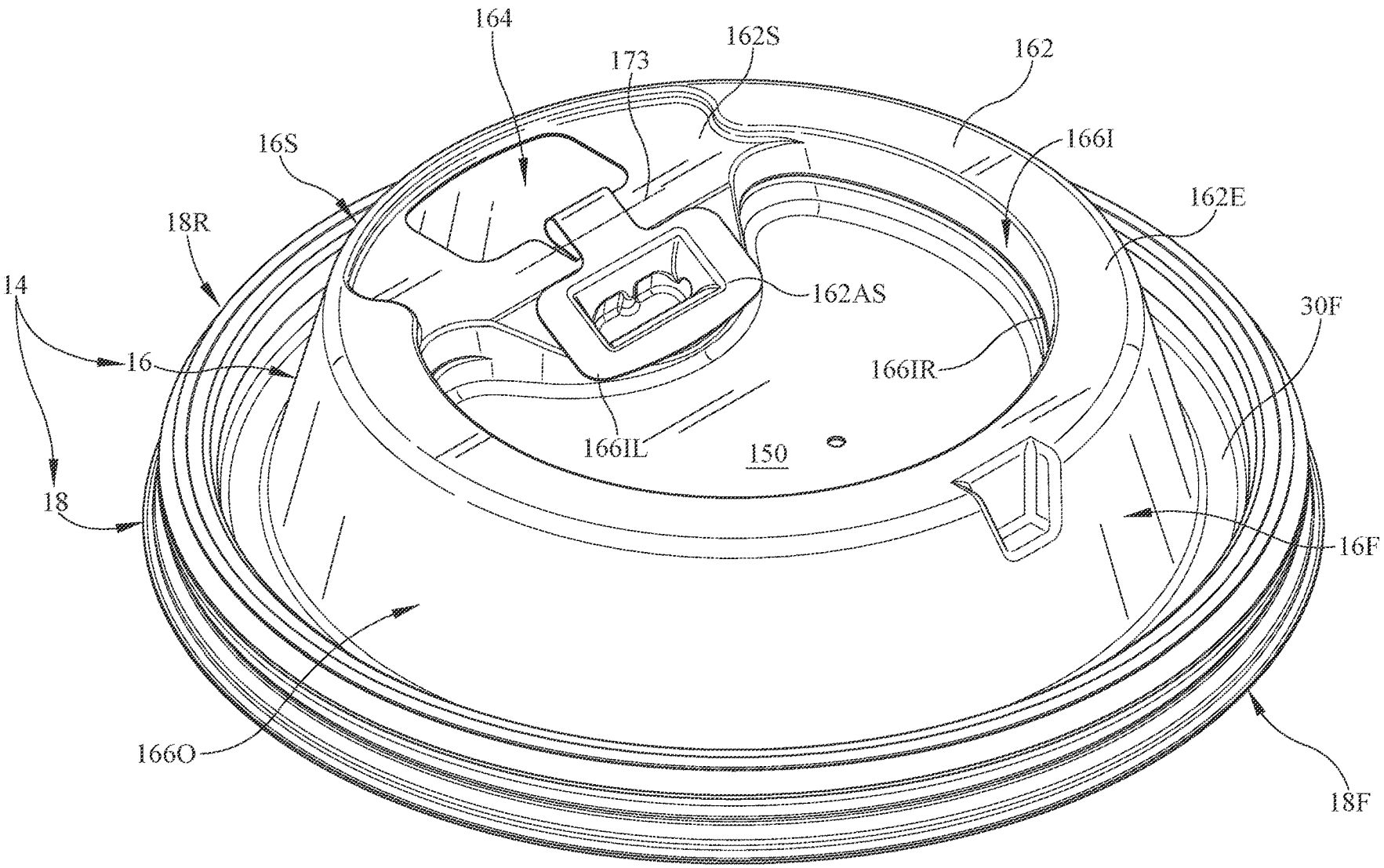
FIG. 4 is an enlarged perspective view of similar to FIG. 2 showing the outlet closure retained in the outlet-opening position, and showing that the liquid-discharge outlet has been opened in response to pivoting movement of the outlet closure to the outlet-opening position in which the closure-anchor lug of the outlet closure is extended through the top aperture formed in the annular top wall and into the underlying lug-receiving cavity formed in the closure retainer that is coupled to the underside of the annular top wall.

The outlet closure 17 is mounted on the central closure 16 for pivotable movement about a pivot axis 17A between a closed position closing the liquid-discharge outlet 164, as shown in FIGS. 1-3, and an opened position opening the liquid-discharge outlet 164 and mating with the closure retainer 168 provided under annular top wall 162 to retain outlet closure 17 in an opened position, as shown in FIGS. 4, 5B, and 5C. It is within the scope of this disclosure to add one or more rigidifying features to the annular top wall 162 in a region near the closure retainer 168 to minimize unwanted deflection of the annular top wall 162 during mating engagement of the outlet closure 17 and the closure retainer 168.

As shown in FIG. 1, the cup 12 includes a brim 20, a floor 22, and a side wall 24 extending upwardly from the floor 22 to the brim 20. The side wall 24 and the floor 22 cooperate to form an interior region 25 of the cup 12. It is within the scope of this disclosure to make the cup 12 out of any suitable plastics, paper, or other material(s).

In an illustrative embodiment, a consumer can drink liquid stored in the cup 12 while the lid 14 remains mounted on the brim 20 of the cup 12 through the opened liquid-discharge outlet 164 formed in the lid 14 after the consumer has pivoted the outlet closure 17 to an opened position. In an illustrative embodiment, the central closure 16 of the lid 14 includes an annular top wall 162 having a sunken surface 162S which is formed to include the liquid-discharge outlet 164. The central closure 16 and a rearward portion of the sunken surface 162S are adapted to be received in the mouth of a consumer desiring to drink a liquid stored in the cup 12 once the outlet closure 17 has been moved to an opened position.

The drink cup lid 14 includes a ring-shaped brim mount 18 adapted to mate with a brim 20 of a drink cup 12 and a central closure 16 surrounded by brim mount 20 and formed to include a spout side 16S that is formed to include a high-elevation liquid-discharge outlet 164 for liquid consumption by a consumer as shown, for example, in FIGS. 1-5C.

The central closure 16 rises upwardly above and is surrounded circumferentially by the brim mount 18 and includes a front side 16F that is located inside a front semicircular portion 18F of the brim mount 18 and a spout side 16S that is formed to include a high-elevation liquid-discharge outlet 164 and is located inside a rear semicircular portion 18R of the brim mount 18 in spaced-apart confronting relation to the front side 16F, as suggested in FIGS. 1-5C. The central closure 16 includes the annular top wall 162 that extends entirely circumferentially within the brim mount 18 when viewed from a top-down perspective. The annular top wall 162 includes a radially outer circumferential edge and a radially inner circumferential edge. The central closure also includes the outer wall 1660 that is appended to the radially outer circumferential edge of the annular top wall 162, as shown in FIGS. 1-4. The outer wall 1660 extends around and downwardly away from the outer perimeter edge.

The annular top wall 162 is formed to include an elevated portion 162E, a sunken portion 162S, and an inwardly angled top aperture surface 162AS, as shown in FIGS. 1-4. The elevated portion 162E is the highest vertical portion of the central closure 16 and essentially forms the top surface of the central closure 16. In the illustrative embodiment, the sunken portion 162S is formed as a planar platform at the spout side 16S of the central closure 16 and is sized to include the liquid-discharge outlet 164. The sunken portion 162S is arranged below the elevated portion 162E, and in at least some embodiments, is formed to be parallel with the plane defined by the elevated portion 162E. The distance between the surface of the sunken portion 162S and the surface of the elevated portion 162 is relatively small as compared to the overall height of the lid 14. In some embodiments, the distance between the sunken portion 162S and the elevated portion 162E is about 1.25 mm. In some embodiments, the distance between the sunken portion 162S and the elevated portion 162E is five percent of the total height of the central closure 16.

The sunken portion 162S includes a spout side edge 162SE that extends along and follows the contour of the outer wall 1660 on the spout side 16S of the central closure 16, as shown in FIGS. 1-4. The sunken portion also includes circumferentially spaced apart terminal ends 162STE located opposite each other relative to the sunken surface 162S. In some embodiments, the terminal ends 162STE are symmetrical and are S-shaped. The sunken portion 162S further includes an inner edge 162SI that is generally linear and located radially inward from the spout side edge 162SE. The inner edge 162SI is located at a transition from the sunken portion 162S to the top aperture surface 162AS, as suggested in FIGS. 1-4. The distance between the spout side edge 162SE and the inner edge 162SI of the sunken portion 162S is greater than the radial width of the elevated portion 162E so as to provide a large enough surface to include the liquid-discharge outlet 164 and the entire outlet closure 17.

The spout side edge 162SE and the terminal ends 162STE each include a steeply sloped transition surface 162TS that transitions from the sunken surface 162S to the elevated portion 162E, in the case of the terminal ends 162STE, or to a sipping rim 162SR of the annular top wall 162, in the case of the spout side edge 162SE. The sipping rim 162SR is coplanar with the elevated portion 162E in at least some embodiments.

The elevated portion 162E extends circumferentially away from the top of the transition surfaces 162SS at the terminal ends 162STE of the sunken surface 162S, as shown in FIGS. 1-4. In some embodiments, the ends of the elevated portion 162E include an S-shape that matches the S-shape of the terminal ends 162STE of the sunken surface 162S. In the illustrative embodiment, the elevated portion 162E is formed to have a generally constant radial width along the circumferential extent of the elevated portion 162E. In some embodiments, the elevated portion 162E includes a constant radial width along at least half of the circumferential extent of the annular top wall 162. In some embodiments, the elevated portion 162E includes a constant radial width along about three-quarters of the circumferential extent of the annular top wall 162 and the sunken portion 162S extends about one quarter of the circumferential extent, as suggested in FIGS. 1-4. In such embodiments, the three-quarters of the elevated portion 162E having the constant width includes an indent at the frontmost end of the annular top wall 162 on the front side 16F of the central closure 16 where a guide recess 190 is located. In some embodiments, the radial width in the constant width area is about 6.2 mm.

The inwardly angled top aperture surface 162AS of the annular top wall 162 extends away from the inward edge 162SI of the sunken surface 162S towards the front side 16F of the central closure 16, as shown in FIGS. 1-4. In the illustrative embodiment as shown in FIGS. 1-5C, the angle of the top aperture surface 162AS is about −25 degrees, although other angles may be utilized in some embodiments based on the requirements of the lid 14. The top aperture surface 162AS is formed to include the top aperture 165 as well as the upwardly facing lug-receiving cavity 168C, as will be discussed in greater detail below. In the illustrative embodiment, the top aperture surface 162AS includes a rounded radially inner edge having a generally semicircular shape located opposite the inner edge 162SI of the sunken surface 162S.

In the illustrative embodiment, the outer wall 1660 extends around and downwardly away from the outer perimeter edge of the annular top wall 162, as shown in FIGS. 1-4. The transition from the annular top wall 162 to the outer wall 1660 may be rounded, as shown in FIGS. 1, 2, and 4. The outer wall 1660 extends vertically upwardly away from a floor 30F of a ring-shaped low-elevation liquid-retention channel 30 that surrounds the outer wall 1660 and is located between the outer wall 1660 and the brim 18. The slope of the outer wall 1660 is generally linear such that the outer wall 1660 is flat. In the illustrative embodiment as shown in FIGS. 1, 2, and 4, the angle of the slope of the outer wall 1660 is about 74 degrees, although the slope may be different in some embodiments based on the requirements of the lid 14. In some embodiments, the angle of the slope of the outer wall 1660 is within a range of about 70 degrees to about 90 degrees. In some embodiments, the angle of the slope of the outer wall 1660 is within a range of about 74 degrees to about 86 degrees. In some embodiments, the angle of the slope of the outer wall 1660 is within a range of about 78 degrees to about 82 degrees. In some embodiments, the angle of the slope of the outer wall 1660 is about 80 degrees. As used herein, the term about means within 1 degree. The height of the outer wall 1660 measured in the vertical direction from the floor 30F to the top of the outer wall 1660 may be about 1.95 cm. The slope of the outer wall 1660 is relatively steep to provide a better drinking experience for a user as compared to other closures having less steep outer walls.

In the illustrative embodiment, the central closure 16 further includes the inner wall 1661 arranged to extend around and downwardly away from the inner perimeter edge of the annular top wall 162, as shown in FIGS. 1, 2, and 4. The lowered portion 166IL of the inner wall 1661 extends from the inwardly angled top aperture surface 162AS of the annular top wall 162. Because of the angle of the slope of the top aperture surface 162AS as described above, the height of the lowered portion 166IL is relatively small. In the illustrative embodiment, the vertical height of the lowered portion 166IL at its shortest point which is at the crest of the semicircular rounded radially inner edge of the top aperture surface 162AS is about 1.2 mm. Because of the rounded shape of the inner edge of the top aperture surface 162AS, the height of the lowered portion 166IL increases as the lowered portion 166IL extends away from the shortest point, as shown in FIGS. 1, 2, and 4. The height of the lowered portion 166IL increases until it meets the height of the constant height portion 166IC of the inner wall 1661.

The constant height portion 166IC of the inner wall 1661 extends around the remainder of the radially inner circumferential edge of the annular top wall 162, as shown in FIGS. 1-4. In the illustrative embodiment, the constant height portion 166IC extends circumferentially around the basin floor 150 and around the radially inner circumferential edge of the annular top wall 162 between the two transition surfaces 162TS. The constant height portion 166IC has a constant vertical height along the circumferential extent of the constant height portion 166IC, as shown in FIGS. 1, 2, and 4. In the illustrative embodiment, the height of the constant height portion 166IC is about 7.6 mm, although other heights may be used in some embodiments based on the requirements of the lid 14.

The generally constant width of the annular top wall 162 along at least half of its circumferential extent, and in some embodiments along three-quarters of its circumferential extent, as well as the constant height of the constant height portion 166IC cooperate to define a high-strength lid 14 capable of withstanding relatively high temperatures of a hot liquid located in the cup 12, as well as withstand the forces applied to the lid 14 in response to a consumer moving the pivotable outlet closure 17 from the outlet-closing position to an outlet-opening position. Moreover, the lid 14 may be formed of polypropylene which keeps the lid 14 from deforming when interacting with hot temperatures for an extended period of time.

In illustrative embodiments, the central closure 16 includes the generally crescent-shaped basin floor 150 located between and circumscribed by the lower circumferential edge of the inner wall 1661, as suggested in FIGS. 1-4. The crescent-shaped basin floor 150 is substantially flat in an illustrative embodiment and includes rounded edges that extend towards the spout side 16S of the central closure 16 on opposite sides of the top aperture surface 162AS and adjoin with a generally annular outer edge of the basin floor 150. In the illustrative embodiment, the floor 30F of the ring-shaped low-elevation liquid-retention channel 30 surrounds the basin floor 150 and the central closure 16 as suggested in FIGS. 1 and 2.

The central closure 16 further includes the guide recess 190 located diametrically opposite of the outlet closure 17, as shown in FIGS. 1-4. The guide recess 190 is formed partially in the outer wall 1660 and is arranged to extend radially inwardly and into the annular top wall 162. The guide recess 190 may help visually tell a server of the liquid container 10 where to place the cup 12 seam and may also help with locating and placing the lid 14 on the cup 12.

The outlet closure 17 includes a closure plate 171, an upstanding nose-shaped closure-anchor lug 172 coupled to the closure plate 171, and a hinge 173 coupled to a front-facing hinge side 171PH of the perimeter of the closure plate 171 and extending along horizontally extending pivot axis 17A as shown, for example, in FIGS. 1-4. The closure plate 171 is a flange coupled to a lower edge of the upstanding nose-shaped closure-anchor lug 172 and arranged to extend outwardly therefrom and extends in a plane substantially parallel to the plane of the annular top wall 162 when the outlet closure 17 is in the closed position as suggested in FIGS. 1-3. The lid 14 is thermoformed to normally position the outlet closure 17 in the closed position in an illustrative embodiment. It is within the scope of this disclosure to provide the closure-anchor lug 172 with any suitable shape so long as it is retained by closure retainer 168 in an opened position as disclosed herein.

The hinge 173 extends coaxially with the pivot axis 17A, as shown in FIG. 2. The perimeter of the closure plate 171 includes a rear side 171PR, two opposing sides 171PS, and the hinge side 171PH. In the illustrative embodiment, the two opposing sides 171PS are symmetrical and have an S-shape such that the portions of the sides 171PS that extend into and connect to the hinge side 171PH are closer than the portions that extend on opposing sides of the lug 172. In some embodiments, the portions of the sides 171PS that extend into and connect to the hinge side 171PH are spaced apart the same distance as the hinge 173 extends.

In the illustrative embodiment, the length of the hinge 173 may be less than about 0.3 inches. In another example, the length of the hinge 173 is about 0.3 inches. In another example, the length of the hinge 173 is about 0.2 inches. In another example the length of the hinge 173 is about 0.25 inches.

In one example, the length of the hinge 173 is in a range of 0.1 inches to about 0.3 inches. In one example, the length of the hinge 173 is in a range of about 0.11 inches to about 0.3 inches. In one example, the length of the hinge 173 is in a range of about 0.12 inches to about 0.3 inches. In one example, the length of the hinge 173 is in a range of about 0.13 inches to about 0.3 inches. In one example, the length of the hinge 173 is in a range of about 0.14 inches to about 0.3 inches. In one example, the length of the hinge 173 is in a range of about 0.15 inches to about 0.3 inches. In one example, the length of the hinge 173 is in a range of about 0.16 inches to about 0.3 inches. In one example, the length of the hinge 173 is in a range of about 0.17 inches to about 0.3 inches. In one example, the length of the hinge 173 is in a range of about 0.18 inches to about 0.3 inches. In one example, the length of the hinge 173 is in a range of about 0.19 inches to about 0.3 inches.

In one example, the length of the hinge 173 is in a range of 0.2 inches to about 0.3 inches. In one example, the length of the hinge 173 is in a range of about 0.21 inches to about 0.3 inches. In one example, the length of the hinge 173 is in a range of about 0.22 inches to about 0.3 inches. In one example, the length of the hinge 173 is in a range of about 0.23 inches to about 0.3 inches. In one example, the length of the hinge 173 is in a range of about 0.24 inches to about 0.3 inches. In one example, the length of the hinge 173 is in a range of about 0.25 inches to about 0.3 inches.

In one example, the length of the hinge 173 is in a range of 0.1 inches to about 0.29 inches. In one example, the length of the hinge 173 is in a range of about 0.1 inches to about 0.28 inches. In one example, the length of the hinge 173 is in a range of about 0.1 inches to about 0.27 inches. In one example, the length of the hinge 173 is in a range of about 0.1 inches to about 0.26 inches. In one example, the length of the hinge 173 is in a range of about 0.1 inches to about 0.25 inches.

In one example, the length of the hinge 173 is in a range of about 0.15 inches to about 0.3 inches. In another example, the length of the hinge 173 is in a range of about 0.16 inches to about 0.29 inches. In another example, the length of the hinge 173 is in a range of about 0.17 inches to about 0.28 inches. In another example, the length of the hinge 173 is in a range of about 0.18 inches to about 0.27 inches. In another example, the length of the hinge 173 is in a range of about 0.19 inches to about 0.26 inches. In another example, the length of the hinge 173 is in a range of about 0.2 inches to about 0.25 inches.

In one example, the length of the hinge 173 is in a range of about 0.2 inches to about 0.3 inches. In another example, the length of the hinge 173 is in a range of about 0.21 inches to about 0.29 inches. In another example, the length of the hinge 173 is in a range of about 0.22 inches to about 0.28 inches. In another example, the length of the hinge 173 is in a range of about 0.23 inches to about 0.27 inches. In another example, the length of the hinge 173 is in a range of about 0.24 inches to about 0.26 inches.

In the illustrative embodiment, the total length of the perimeter of the closure plate 171, that being the total length of the rear side 171PR, the two opposing sides 171PS, and the hinge side 171PH, may be less than about 2.4 inches. In another example, the perimeter of the closure plate 171 is about 2.3 inches.

In one example, the perimeter of the closure plate 171 is in a range of about 1.5 inches to about 2.5 inches. In one example, the perimeter of the closure plate 171 is in a range of about 1.6 inches to about 2.5 inches. In one example, the perimeter of the closure plate 171 is in a range of about 1.7 inches to about 2.5 inches. In one example, the perimeter of the closure plate 171 is in a range of about 1.8 inches to about 2.5 inches. In one example, the perimeter of the closure plate 171 is in a range of about 1.9 inches to about 2.5 inches. In one example, the perimeter of the closure plate 171 is in a range of about 2.0 inches to about 2.5 inches. In one example, the perimeter of the closure plate 171 is in a range of about 2.1 inches to about 2.5 inches. In one example, the perimeter of the closure plate 171 is in a range of about 2.2 inches to about 2.5 inches. In one example, the perimeter of the closure plate 171 is in a range of about 2.3 inches to about 2.5 inches.

In one example, the perimeter of the closure plate 171 is in a range of about 1.5 inches to about 2.5 inches. In one example, the perimeter of the closure plate 171 is in a range of about 1.5 inches to about 2.4 inches. In one example, the perimeter of the closure plate 171 is in a range of about 1.5 inches to about 2.3 inches.

In one example, the perimeter of the closure plate 171 is in a range of about 1.5 inches to about 2.5 inches. In one example, the perimeter of the closure plate 171 is in a range of about 1.6 inches to about 2.4 inches. In one example, the perimeter of the closure plate 171 is in a range of about 1.7 inches to about 2.3 inches.

In one example, the perimeter of the closure plate 171 is in a range of about 1.5 inches to about 2.5 inches. In one example, the perimeter of the closure plate 171 is in a range of about 1.5 inches to about 2.4 inches. In one example, the perimeter of the closure plate 171 is in a range of about 1.5 inches to about 2.3 inches.

In one example, the perimeter of the closure plate 171 is in a range of about 1.5 inches to about 2.5 inches. In one example, the perimeter of the closure plate 171 is in a range of about 1.6 inches to about 2.4 inches. In one example, the perimeter of the closure plate 171 is in a range of about 1.7 inches to about 2.3 inches.

In the illustrative embodiment, the percentage of the length of the hinge 173 to the total length of the perimeter of the closure plate 171, may be less than about 11 percent. In another example, the percentage is about 10.9 percent.

In one example, the percentage is in a range of about 9 percent to about 13 percent. In one example, the percentage is in a range of about 9.1 percent to about 13 percent. In one example, the percentage is in a range of about 9.2 percent to about 13 percent. In one example, the percentage is in a range of about 9.3 percent to about 13 percent. In one example, the percentage is in a range of about 9.4 percent to about 13 percent. In one example, the percentage is in a range of about 9.5 percent to about 13 percent. In one example, the percentage is in a range of about 9.6 percent to about 13 percent. In one example, the percentage is in a range of about 9.7 percent to about 13 percent. In one example, the percentage is in a range of about 9.8 percent to about 13 percent. In one example, the percentage is in a range of about 9.9 percent to about 13 percent. In one example, the percentage is in a range of about 10 percent to about 13 percent. In one example, the percentage is in a range of about 10.1 percent to about 13 percent. In one example, the percentage is in a range of about 10.2 percent to about 13 percent. In one example, the percentage is in a range of about 10.3 percent to about 13 percent. In one example, the percentage is in a range of about 10.4 percent to about 13 percent. In one example, the percentage is in a range of about 10.5 percent to about 13 percent. In one example, the percentage is in a range of about 10.6 percent to about 13 percent. In one example, the percentage is in a range of about 10.7 percent to about 13 percent. In one example, the percentage is in a range of about 10.8 percent to about 13 percent. In one example, the percentage is in a range of about 10.9 percent to about 13 percent.

In one example, the percentage is in a range of about 9 percent to about 13 percent. In one example, the percentage is in a range of about 9 percent to about 12.9 percent. In one example, the percentage is in a range of about 9 percent to about 12.8 percent. In one example, the percentage is in a range of about 9 percent to about 12.7 percent. In one example, the percentage is in a range of about 9 percent to about 12.6 percent. In one example, the percentage is in a range of about 9 percent to about 12.5 percent. In one example, the percentage is in a range of about 9 percent to about 12.4 percent. In one example, the percentage is in a range of about 9 percent to about 12.3 percent. In one example, the percentage is in a range of about 9 percent to about 12.2 percent. In one example, the percentage is in a range of about 9 percent to about 12.1 percent. In one example, the percentage is in a range of about 9 percent to about 12 percent. In one example, the percentage is in a range of about 9 percent to about 11.9 percent. In one example, the percentage is in a range of about 9 percent to about 11.8 percent. In one example, the percentage is in a range of about 9 percent to about 11.7 percent. In one example, the percentage is in a range of about 9 percent to about 11.6 percent. In one example, the percentage is in a range of about 9 percent to about 11.5 percent. In one example, the percentage is in a range of about 9 percent to about 11.4 percent. In one example, the percentage is in a range of about 9 percent to about 11.3 percent. In one example, the percentage is in a range of about 9 percent to about 11.2 percent. In one example, the percentage is in a range of about 9 percent to about 11.1 percent. In one example, the percentage is in a range of about 9 percent to about 11 percent. In one example, the percentage is in a range of about 9 percent to about 10.9 percent.

In one example, the percentage is in a range of about 9 percent to about 13 percent. In one example, the percentage is in a range of about 9.1 percent to about 12.9 percent. In one example, the percentage is in a range of about 9.2 percent to about 12.8 percent. In one example, the percentage is in a range of about 9.3 percent to about 12.7 percent. In one example, the percentage is in a range of about 9.4 percent to about 12.6 percent. In one example, the percentage is in a range of about 9.5 percent to about 12.5 percent. In one example, the percentage is in a range of about 9.6 percent to about 12.4 percent. In one example, the percentage is in a range of about 9.7 percent to about 12.3 percent. In one example, the percentage is in a range of about 9.8 percent to about 12.2 percent. In one example, the percentage is in a range of about 9.9 percent to about 12.1 percent. In one example, the percentage is in a range of about 10 percent to about 12 percent. In one example, the percentage is in a range of about 10.1 percent to about 11.9 percent. In one example, the percentage is in a range of about 10.2 percent to about 11.8 percent. In one example, the percentage is in a range of about 10.3 percent to about 11.7 percent. In one example, the percentage is in a range of about 10.4 percent to about 11.6 percent. In one example, the percentage is in a range of about 10.5 percent to about 11.5 percent. In one example, the percentage is in a range of about 10.6 percent to about 11.4 percent. In one example, the percentage is in a range of about 10.7 percent to about 11.3 percent. In one example, the percentage is in a range of about 10.8 percent to about 11.2 percent. In one example, the percentage is in a range of about 10.9 percent to about 11.1 percent.

The length of the hinge 173, the perimeter of the closure plate 171, and the percentage of the length of the hinge 173 to the perimeter being in the ranges disclosed above creates an easier to open outlet closure 17 than comparative cup lids due to the hinge length being shorter than comparative lids. Moreover, the S-shape of the side portions 171PS provides an improvement over comparative lids in that it allows for the material of the closure plate 171 to bend when a user moves the outlet closure 17 from the closed position to the opened position without causing tearing at the juncture of the hinge 173 and the sunken surface 162S.

The outlet closure 17 may include a lug top surface 172S and at least one retention indent 1721 formed in at least one side of the closure-anchor lug 172, as shown in FIGS. 1-3. In the illustrative embodiment, the outlet closure 17 includes a vertically extending retention indent 1721 located on a front-facing side of the closure-anchor lug 172 and a generally rectangular lug top surface 172S with rounded corners facing the front side 16F. The retention indent 1721 is configured to engage a corresponding ridge 168CR formed in the lug-receiving cavity 168C so as to retain the outlet closure 17 in the opened position within the closure retainer 168. The closure-anchor lug 172 and the lug-receiving cavity 168C may include other combinations of recesses and ridges in other embodiments, as will described in further detail below.

The closure retainer 168 is formed to include the upwardly facing lug-receiving cavity 168C that is sized to receive the tip of the closure-anchor lug 172 of outlet closure 17 therein when outlet closure 17 is pivoted by the user to the opened position shown in FIGS. 4, 5B, and 5C. The lug-receiving cavity 168C is bounded by at least four cavity side walls 168S1, 168S2, 168S3, and 168S4 and a generally horizontal floor 168F coupled to lower edges of each of the cavity side walls 168S1-4 as suggested in FIG. 3. These cavity side walls cooperate to define interference-fit means for temporarily retaining the closure-anchor lug 172 of the outlet closure 17 in the lug-receiving the cavity 168 upon movement of the outlet closure 17 to the opened position shown, for example, in FIGS. 4 and 5C. It is within the scope of the present disclosure to vary the shape of the lug-receiving cavity 168 and bordering portions of the annular top wall 162 to rigidify or reinforce the lug-receiving cavity 168 to minimize deformation of the lug-receiving cavity 168 and a surrounding border region during insertion of the closure-anchor lug 172 into the lug-receiving cavity 168C.

The closure retainer 168 is coupled to the annular top wall 162 and is formed to include a forwardly facing lug-receiving cavity 168C and side walls 168S1-4 as suggested in FIG. 3 that cooperate to provide detent means for retaining the retention indent 1721 of the closure-anchor lug 172 in the lug-receiving cavity 168C upon movement of the outlet closure 17 to the opened position as suggested in FIGS. 3-5C. The outlet closure 17 is mounted for pivotable movement through an angle of about 150°-170° about pivot axis 17A between a closed position closing the liquid-discharge outlet 164 and an opened position opening the liquid-discharge outlet 164 and mating with a closure retainer 168 formed in central closure 16 as shown, for example, in FIG. 3.

Another embodiment of a liquid container 210 in accordance with the present disclosure is shown in FIGS. 6-10C. The liquid container 210 is similar to the liquid container 10 shown in FIGS. 1-5C and described herein. Accordingly, similar reference numbers in the 200 series indicate features that are common between the liquid container 210 and the liquid container 10. The description of the liquid container 10 is incorporated by reference to apply to the liquid container 210, except in instances when it conflicts with the specific description and the drawings of the liquid container 210.

A drink cup lid 214 of the liquid container 210 includes a ring-shaped brim mount 218 adapted to mate with a brim 220 of a drink cup 212 and a central closure 216 surrounded by brim mount 220 and formed to include a spout side 216S that is formed to include a high-elevation liquid-discharge outlet 364 for liquid consumption by a consumer as shown, for example, in FIGS. 6-10C.

The central closure 216 rises upwardly above and is surrounded circumferentially by the brim mount 218 and includes a front side 216F that is located inside a front semicircular portion 218F of the brim mount 218 and a spout side 216S that is formed to include a high-elevation liquid-discharge outlet 364 and is located inside a rear semicircular portion 218R of the brim mount 218 in spaced-apart confronting relation to the front side 216F, as suggested in FIGS. 6-10C. The central closure 216 includes an annular top wall 362 that extends entirely circumferentially within the brim mount 218 when viewed from a top-down perspective. The annular top wall 362 includes a radially outer circumferential edge and a radially inner circumferential edge. The central closure also includes the outer wall 3660 that is appended to the radially outer circumferential edge of the annular top wall 362, as shown in FIGS. 6-9. The outer wall 3660 extends around and downwardly away from the outer perimeter edge.

The annular top wall 362 is formed substantially similarly to the annular top wall 162, specifically to include an elevated portion 362E, a sunken portion 362S, and an inwardly angled top aperture surface 362AS, as shown in FIGS. 6-9. In the illustrative embodiment, the sunken portion 362S is formed as a planar platform at the spout side 216S of the central closure 216 and is sized to include the liquid-discharge outlet 364. The sunken portion 362S is arranged below the elevated portion 362E, and in at least some embodiments, is formed to be parallel with the plane defined by the elevated portion 362E. In some embodiments, the distance between the sunken portion 362S and the elevated portion 362E is about 1.25 mm. In some embodiments, the distance between the sunken portion 362S and the elevated portion 362E is five percent of the total height of the central closure 216.

The sunken portion 362S is formed substantially similarly to the sunken portion 362S, specifically to include a spout side edge 362SE that extends along and follows the contour of the outer wall 3660 on the spout side 216S of the central closure 216, as shown in FIGS. 6-9. The sunken portion also includes circumferentially spaced apart terminal ends 362STE located opposite each other relative to the sunken surface 362S. In some embodiments, the terminal ends 362STE are symmetrical and are S-shaped. The sunken portion 362S further includes an inner edge 362SI that is generally linear and located radially inward from the spout side edge 362SE. The inner edge 362SI is located at a transition from the sunken portion 362S to the top aperture surface 362AS, as suggested in FIGS. 6-9.

The spout side edge 362SE and the terminal ends 362STE each include a steeply sloped transition surface 362TS that transitions from the sunken surface 362S to the elevated portion 362E, in the case of the terminal ends 362STE, or to a sipping rim 362SR of the annular top wall 362, in the case of the spout side edge 362SE. The sipping rim 362SR is coplanar with the elevated portion 362E in at least some embodiments.

The elevated portion 362E extends circumferentially away from the top of the transition surfaces 362SS at the terminal ends 362STE of the sunken surface 362S, as shown in FIGS. 6-9. In the illustrative embodiment, the elevated portion 362E is formed to have a generally constant radial width along the circumferential extent of the elevated portion 362E. In some embodiments, the elevated portion 362E includes a constant radial width along at least half of the circumferential extent of the annular top wall 362. In some embodiments, the elevated portion 362E includes a constant radial width along about three-quarters of the circumferential extent of the annular top wall 362 and the sunken portion 362S extends about one quarter of the circumferential extent, as suggested in FIGS. 6-9. In such embodiments, the three-quarters of the elevated portion 362E having the constant width includes an indent at the frontmost end of the annular top wall 362 on the front side 16F of the central closure 16 where a guide recess 390 is located. In some embodiments, the radial width in the constant width area is about 6.1 mm.

Figure 6:
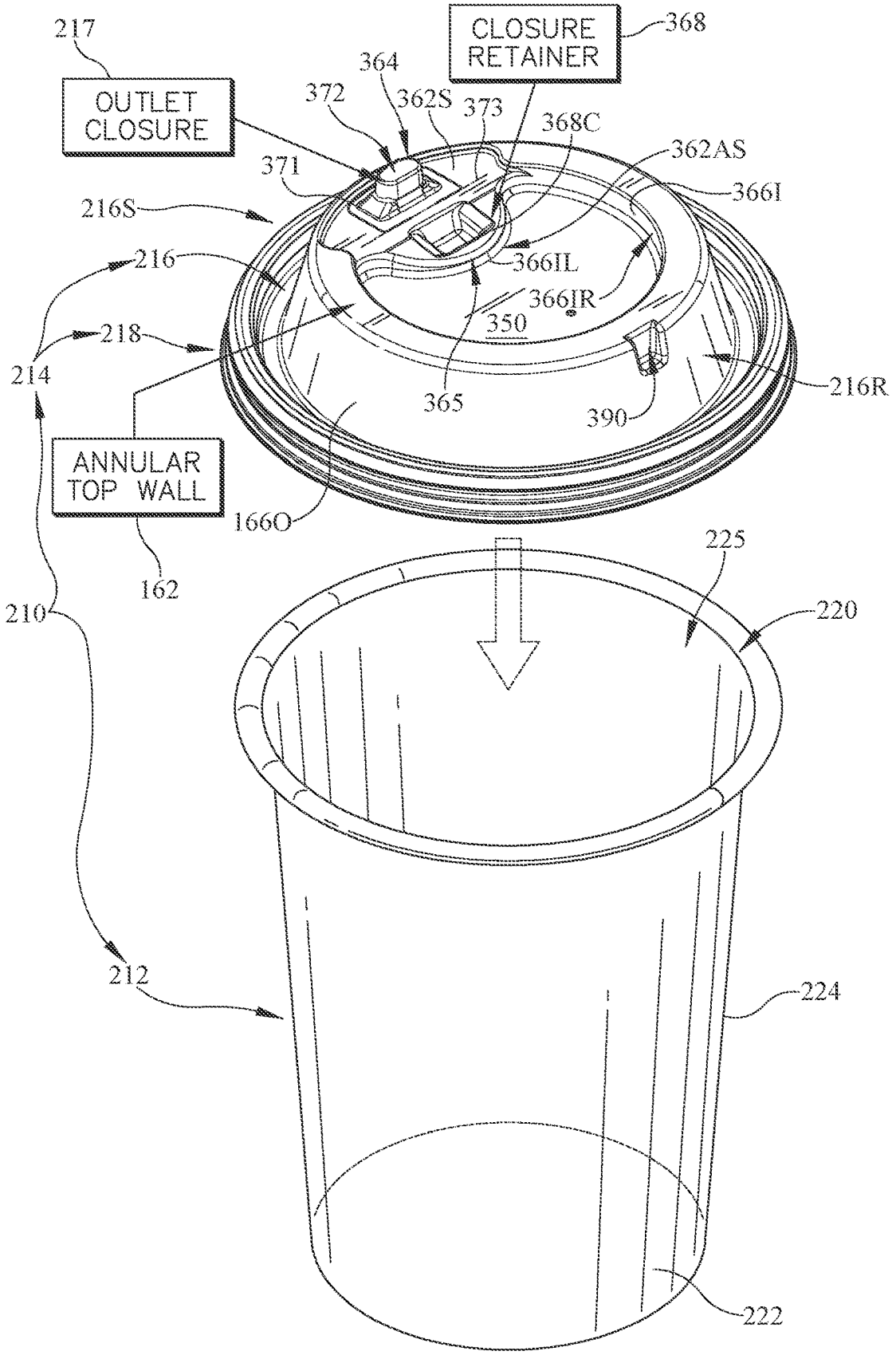
FIG. 6 is a perspective view of a lid in accordance with another embodiment of the present disclosure and a cup before the lid is mounted on the cup and showing that the lid includes a ring-shaped brim mount adapted to mate with the brim of the cup, a central closure surrounded by the brim mount and formed to include an annular top wall formed to include a top aperture and an adjacent liquid-discharge outlet and an outer wall arranged to extend around an entirety of a circumferential extent of the annular top wall and downwardly from the annular top wall toward an interior region surrounded by the ring-shaped brim mount, and an outlet closure mounted for pivotable movement between an outlet-closing position shown in FIGS. 6-8 and 10A and an outlet-opening position shown in FIGS. 9, 10B, and 10C.
Figure 7:
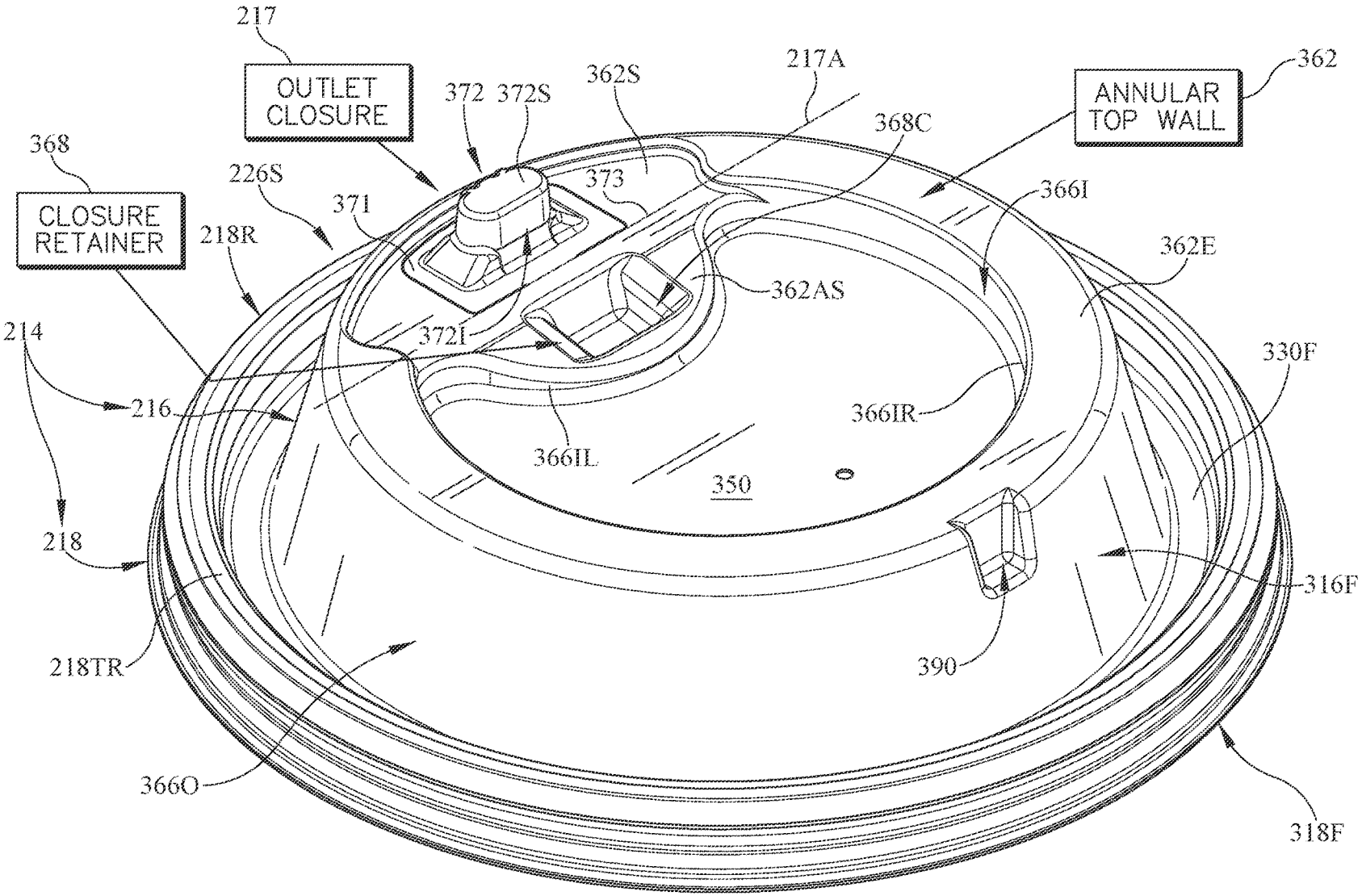
FIG. 7 is an enlarged perspective view of the lid of FIG. 6 showing the outlet closure in the closed position, showing that the lid further includes an inner wall that extends downwardly from an inner edge of the annular top wall of the central closure, and showing that the top aperture is located between the liquid-discharge outlet and a serpentine-shaped portion of inner wall on an inwardly sloped top aperture portion of a sunken portion of the annular top wall.
Figure 8:
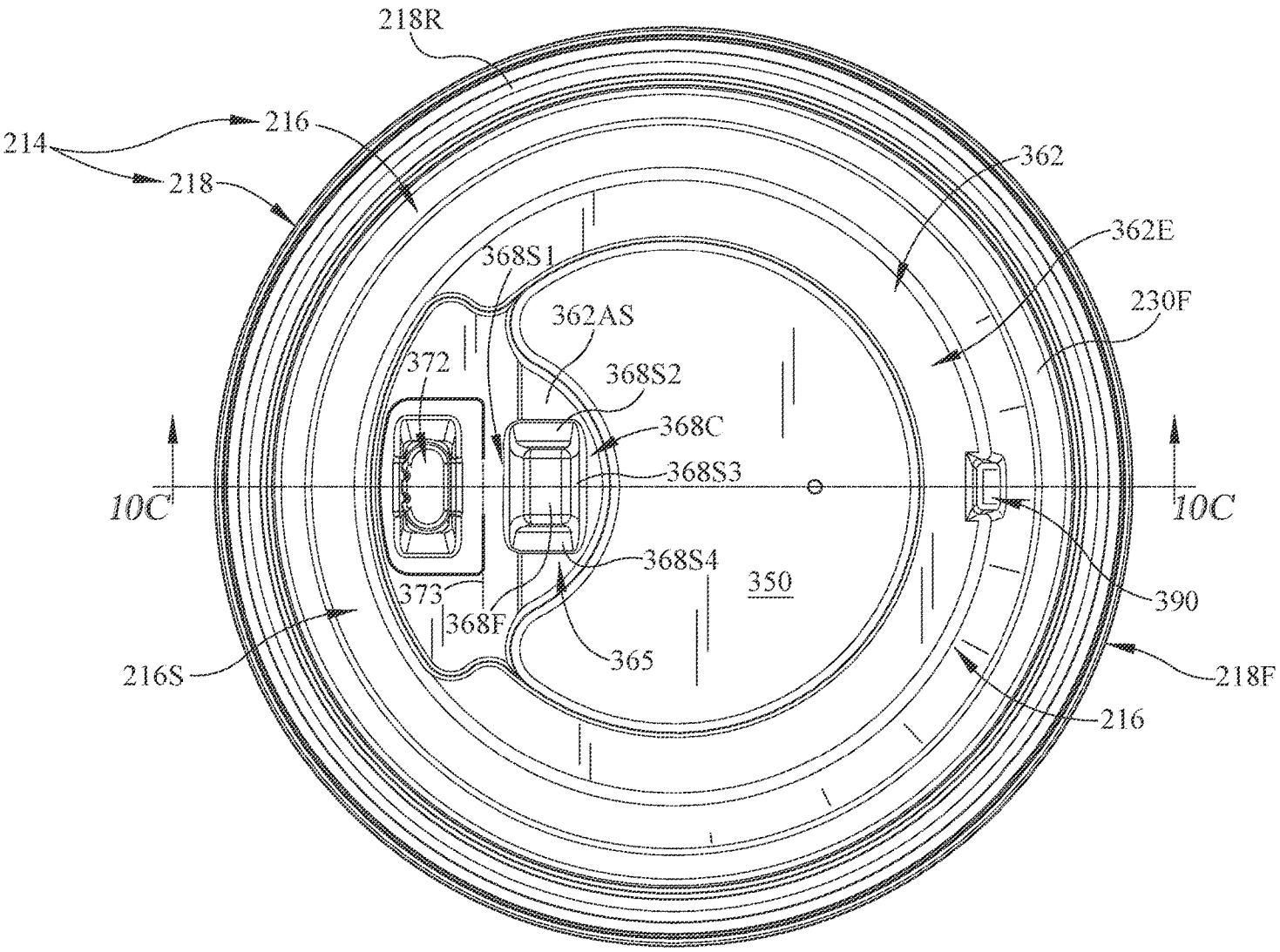
FIG. 8 is an enlarged top view of the lid of FIG. 6 showing the outlet closure in the closed position and that the top aperture is located between the liquid-discharge outlet and the serpentine-shaped portion of inner wall on the inwardly sloped top aperture portion of the sunken portion of the annular top wall.
Figure 9:
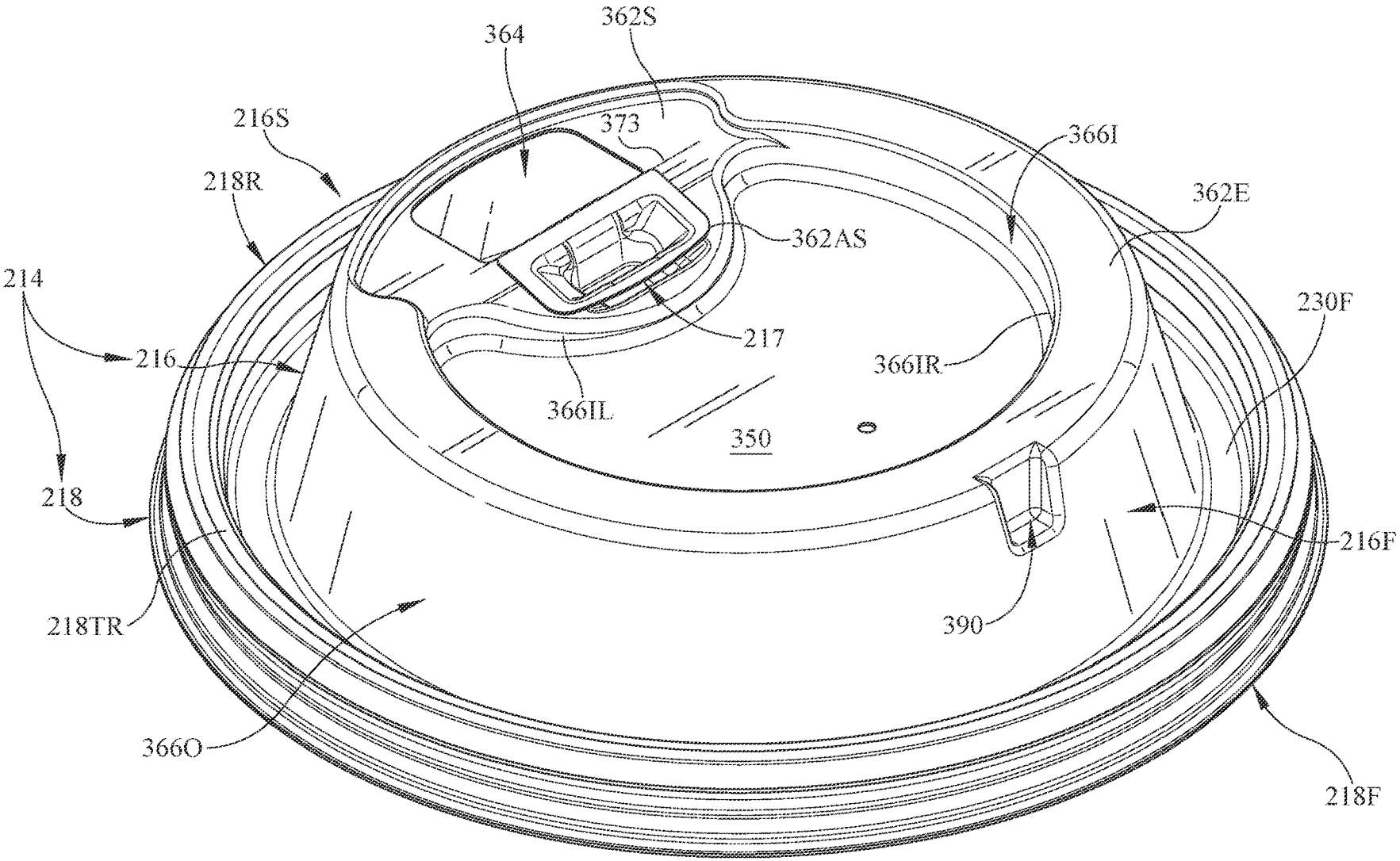
FIG. 9 is an enlarged perspective view of similar to FIG. 7 showing the outlet closure retained in the outlet-opening position, and showing that the liquid-discharge outlet has been opened in response to pivoting movement of the outlet closure to the outlet-opening position in which the closure-anchor lug of the outlet closure is extended through the top aperture formed in the annular top wall and into the underlying lug-receiving cavity formed in the closure retainer that is coupled to the underside of the annular top wall.

The inwardly angled top aperture surface 362AS of the annular top wall 362 extends away from the inward edge 362SI of the sunken surface 362S towards the front side 216F of the central closure 216, as shown in FIGS. 6-9. In the illustrative embodiment as shown in FIGS. 6-10C, the angle of the top aperture surface 362AS is about −10 degrees, although other angles may be utilized in some embodiments based on the requirements of the lid 214. The top aperture surface 362AS is formed to include the top aperture 365 as well as the upwardly facing lug-receiving cavity 368C, as will be discussed in greater detail below. As can be seen in FIGS. 6, 7, and 9, the top aperture 365 and the lug-receiving cavity 368C partially extend into the sunken surface 362S beyond the inner edge 362SI. In the illustrative embodiment, the top aperture surface 362AS includes a rounded radially inner edge having a generally semicircular shape located opposite the inner edge 362SI of the sunken surface 362S.

In the illustrative embodiment, the outer wall 3660 extends around and downwardly away from the outer perimeter edge of the annular top wall 362, as shown in FIGS. 6-9. The outer wall 3660 extends vertically upwardly away from a floor 230F of a ring-shaped low-elevation liquid-retention channel 230 that surrounds the outer wall 3660 and is located between the outer wall 3660 and the brim 218. The slope of the outer wall 3660 is generally linear such that the outer wall 3660 is flat. In the illustrative embodiment as shown in FIGS. 6, 7, and 9, the angle of the slope of the outer wall 3660 is about 74 degrees, although the slope may be different in some embodiments based on the requirements of the lid 214. The height of the outer wall 3660 measured in the vertical direction from the floor 230F to the top of the outer wall 3660 may be about 1.95 cm.

In the illustrative embodiment, the central closure 216 further includes the inner wall 3661 arranged to extend around and downwardly away from the inner perimeter edge of the annular top wall 362, as shown in FIGS. 6, 7, and 9. The lowered portion 366IL of the inner wall 3661 extends from the inwardly angled top aperture surface 362AS of the annular top wall 362. In the illustrative embodiment, the vertical height of the lowered portion 366IL at its shortest point which is at the crest of the semicircular rounded radially inner edge of the top aperture surface 362AS is about 2.2 mm. Because of the rounded shape of the inner edge of the top aperture surface 362AS, the height of the lowered portion 366IL increases as the lowered portion 366IL extends away from the shortest point, as shown in FIGS. 6, 7, and 9. The height of the lowered portion 366IL increases until it meets the height of the constant height portion 366IC of the inner wall 3661.

The constant height portion 366IC of the inner wall 3661 extends around the remainder of the radially inner circumferential edge of the annular top wall 362, as shown in FIGS. 6-9. In the illustrative embodiment, the constant height portion 366IC extends circumferentially around the basin floor 350 and around the radially inner circumferential edge of the annular top wall 362 between the two transition surfaces 362TS. The constant height portion 366IC has a constant vertical height along the circumferential extent of the constant height portion 366IC, as shown in FIGS. 6, 7, and 9. In the illustrative embodiment, the height of the constant height portion 366IC is about 5.1 mm, although other heights may be used in some embodiments based on the requirements of the lid 214.

In illustrative embodiments, the central closure 216 includes the generally crescent-shaped basin floor 350 located between and circumscribed by the lower circumferential edge of the inner wall 3661, as suggested in FIGS. 6-9. The crescent-shaped basin floor 350 is substantially flat in an illustrative embodiment and includes rounded edges that extend towards the spout side 216S of the central closure 216 on opposite sides of the top aperture surface 362AS and adjoin with a generally annular outer edge of the basin floor 350. In the illustrative embodiment, the floor 230F of the ring-shaped low-elevation liquid-retention channel 230 surrounds the basin floor 350 and the central closure 216 as suggested in FIGS. 6 and 7.

The central closure 216 further includes the guide recess 390 located diametrically opposite of the outlet closure 217, as shown in FIGS. 6-9. The guide recess 390 is formed partially in the outer wall 3660 and is arranged to extend radially inwardly and into the annular top wall 362. The guide recess 390 may help visually tell a server of the liquid container 210 where to place the cup 212 seam and may also help with locating and placing the lid 214 on the cup 212.

The outlet closure 217 includes a closure plate 371, an upstanding nose-shaped closure-anchor lug 372 coupled to the closure plate 371, and a hinge 373 coupled to a front-facing hinge side 371PH of the perimeter of the closure plate 371 and extending along horizontally extending pivot axis 217A as shown, for example, in FIGS. 6-9. The closure plate 371 is a flange coupled to a lower edge of the upstanding nose-shaped closure-anchor lug 372 and arranged to extend outwardly therefrom and extends in a plane substantially parallel to the plane of the annular top wall 362 when the outlet closure 217 is in the closed position as suggested in FIGS. 6-8. The lid 214 is thermoformed to normally position the outlet closure 217 in the closed position in an illustrative embodiment. It is within the scope of this disclosure to provide the closure-anchor lug 372 with any suitable shape so long as it is retained by closure retainer 368 in an opened position as disclosed herein.

The hinge 373 extends coaxially with the pivot axis 217A, as shown in FIG. 7. The perimeter of the closure plate 371 includes a rear side 371PR, two opposing sides 371PS, and the hinge side 371PH. In the illustrative embodiment, the two opposing sides 371PS are symmetrical and extend between the ends of the rear side 371PR and the hinge side 371PH.

In the illustrative embodiment, the length of the hinge 373 may be less than about 0.3 inches. In another example, the length of the hinge 373 is about 0.3 inches. In another example, the length of the hinge 373 is about 0.2 inches. In another example the length of the hinge 373 is about 0.25 inches.

In one example, the length of the hinge 373 is in a range of 0.1 inches to about 0.3 inches. In one example, the length of the hinge 373 is in a range of about 0.11 inches to about 0.3 inches. In one example, the length of the hinge 373 is in a range of about 0.12 inches to about 0.3 inches. In one example, the length of the hinge 373 is in a range of about 0.13 inches to about 0.3 inches. In one example, the length of the hinge 373 is in a range of about 0.14 inches to about 0.3 inches. In one example, the length of the hinge 373 is in a range of about 0.15 inches to about 0.3 inches. In one example, the length of the hinge 373 is in a range of about 0.16 inches to about 0.3 inches. In one example, the length of the hinge 373 is in a range of about 0.17 inches to about 0.3 inches. In one example, the length of the hinge 373 is in a range of about 0.18 inches to about 0.3 inches. In one example, the length of the hinge 373 is in a range of about 0.19 inches to about 0.3 inches.

In one example, the length of the hinge 373 is in a range of 0.2 inches to about 0.3 inches. In one example, the length of the hinge 373 is in a range of about 0.21 inches to about 0.3 inches. In one example, the length of the hinge 373 is in a range of about 0.22 inches to about 0.3 inches. In one example, the length of the hinge 373 is in a range of about 0.23 inches to about 0.3 inches. In one example, the length of the hinge 373 is in a range of about 0.24 inches to about 0.3 inches. In one example, the length of the hinge 373 is in a range of about 0.25 inches to about 0.3 inches.

In one example, the length of the hinge 373 is in a range of 0.1 inches to about 0.29 inches. In one example, the length of the hinge 373 is in a range of about 0.1 inches to about 0.28 inches. In one example, the length of the hinge 373 is in a range of about 0.1 inches to about 0.27 inches. In one example, the length of the hinge 373 is in a range of about 0.1 inches to about 0.26 inches. In one example, the length of the hinge 373 is in a range of about 0.1 inches to about 0.25 inches.

In one example, the length of the hinge 373 is in a range of about 0.15 inches to about 0.3 inches. In another example, the length of the hinge 373 is in a range of about 0.16 inches to about 0.29 inches. In another example, the length of the hinge 373 is in a range of about 0.17 inches to about 0.28 inches. In another example, the length of the hinge 373 is in a range of about 0.18 inches to about 0.27 inches. In another example, the length of the hinge 373 is in a range of about 0.19 inches to about 0.26 inches. In another example, the length of the hinge 373 is in a range of about 0.2 inches to about 0.25 inches.

In one example, the length of the hinge 373 is in a range of about 0.2 inches to about 0.3 inches. In another example, the length of the hinge 373 is in a range of about 0.21 inches to about 0.29 inches. In another example, the length of the hinge 373 is in a range of about 0.22 inches to about 0.28 inches. In another example, the length of the hinge 373 is in a range of about 0.23 inches to about 0.27 inches. In another example, the length of the hinge 373 is in a range of about 0.24 inches to about 0.26 inches.

In the illustrative embodiment, the total length of the perimeter of the closure plate 371, that being the total length of the rear side 371PR, the two opposing sides 371PS, and the hinge side 371PH, may be less than about 2.4 inches. In another example, the perimeter of the closure plate 371 is about 2.3 inches.

In one example, the perimeter of the closure plate 371 is in a range of about 1.5 inches to about 2.5 inches. In one example, the perimeter of the closure plate 371 is in a range of about 1.6 inches to about 2.5 inches. In one example, the perimeter of the closure plate 371 is in a range of about 1.7 inches to about 2.5 inches. In one example, the perimeter of the closure plate 371 is in a range of about 1.8 inches to about 2.5 inches. In one example, the perimeter of the closure plate 371 is in a range of about 1.9 inches to about 2.5 inches. In one example, the perimeter of the closure plate 371 is in a range of about 2.0 inches to about 2.5 inches. In one example, the perimeter of the closure plate 371 is in a range of about 2.1 inches to about 2.5 inches. In one example, the perimeter of the closure plate 371 is in a range of about 2.2 inches to about 2.5 inches. In one example, the perimeter of the closure plate 371 is in a range of about 2.3 inches to about 2.5 inches.

In one example, the perimeter of the closure plate 371 is in a range of about 1.5 inches to about 2.5 inches. In one example, the perimeter of the closure plate 371 is in a range of about 1.5 inches to about 2.4 inches. In one example, the perimeter of the closure plate 371 is in a range of about 1.5 inches to about 2.3 inches.

In one example, the perimeter of the closure plate 371 is in a range of about 1.5 inches to about 2.5 inches. In one example, the perimeter of the closure plate 371 is in a range of about 1.6 inches to about 2.4 inches. In one example, the perimeter of the closure plate 371 is in a range of about 1.7 inches to about 2.3 inches.

In one example, the perimeter of the closure plate 371 is in a range of about 1.5 inches to about 2.5 inches. In one example, the perimeter of the closure plate 371 is in a range of about 1.5 inches to about 2.4 inches. In one example, the perimeter of the closure plate 371 is in a range of about 1.5 inches to about 2.3 inches.

In one example, the perimeter of the closure plate 371 is in a range of about 1.5 inches to about 2.5 inches. In one example, the perimeter of the closure plate 371 is in a range of about 1.6 inches to about 2.4 inches. In one example, the perimeter of the closure plate 371 is in a range of about 1.7 inches to about 2.3 inches.

In the illustrative embodiment, the percentage of the length of the hinge 373 to the total length of the perimeter of the closure plate 371, may be less than about 11 percent. In another example, the percentage is about 10.9 percent.

In one example, the percentage is in a range of about 9 percent to about 13 percent. In one example, the percentage is in a range of about 9.1 percent to about 13 percent. In one example, the percentage is in a range of about 9.2 percent to about 13 percent. In one example, the percentage is in a range of about 9.3 percent to about 13 percent. In one example, the percentage is in a range of about 9.4 percent to about 13 percent. In one example, the percentage is in a range of about 9.5 percent to about 13 percent. In one example, the percentage is in a range of about 9.6 percent to about 13 percent. In one example, the percentage is in a range of about 9.7 percent to about 13 percent. In one example, the percentage is in a range of about 9.8 percent to about 13 percent. In one example, the percentage is in a range of about 9.9 percent to about 13 percent. In one example, the percentage is in a range of about 10 percent to about 13 percent. In one example, the percentage is in a range of about 10.1 percent to about 13 percent. In one example, the percentage is in a range of about 10.2 percent to about 13 percent. In one example, the percentage is in a range of about 10.3 percent to about 13 percent. In one example, the percentage is in a range of about 10.4 percent to about 13 percent. In one example, the percentage is in a range of about 10.5 percent to about 13 percent. In one example, the percentage is in a range of about 10.6 percent to about 13 percent. In one example, the percentage is in a range of about 10.7 percent to about 13 percent. In one example, the percentage is in a range of about 10.8 percent to about 13 percent. In one example, the percentage is in a range of about 10.9 percent to about 13 percent.

In one example, the percentage is in a range of about 9 percent to about 13 percent. In one example, the percentage is in a range of about 9 percent to about 12.9 percent. In one example, the percentage is in a range of about 9 percent to about 12.8 percent. In one example, the percentage is in a range of about 9 percent to about 12.7 percent. In one example, the percentage is in a range of about 9 percent to about 12.6 percent. In one example, the percentage is in a range of about 9 percent to about 12.5 percent. In one example, the percentage is in a range of about 9 percent to about 12.4 percent. In one example, the percentage is in a range of about 9 percent to about 12.3 percent. In one example, the percentage is in a range of about 9 percent to about 12.2 percent. In one example, the percentage is in a range of about 9 percent to about 12.1 percent. In one example, the percentage is in a range of about 9 percent to about 12 percent. In one example, the percentage is in a range of about 9 percent to about 11.9 percent. In one example, the percentage is in a range of about 9 percent to about 11.8 percent. In one example, the percentage is in a range of about 9 percent to about 11.7 percent. In one example, the percentage is in a range of about 9 percent to about 11.6 percent. In one example, the percentage is in a range of about 9 percent to about 11.5 percent. In one example, the percentage is in a range of about 9 percent to about 11.4 percent. In one example, the percentage is in a range of about 9 percent to about 11.3 percent. In one example, the percentage is in a range of about 9 percent to about 11.2 percent. In one example, the percentage is in a range of about 9 percent to about 11.1 percent. In one example, the percentage is in a range of about 9 percent to about 11 percent. In one example, the percentage is in a range of about 9 percent to about 10.9 percent.

In one example, the percentage is in a range of about 9 percent to about 13 percent. In one example, the percentage is in a range of about 9.1 percent to about 12.9 percent. In one example, the percentage is in a range of about 9.2 percent to about 12.8 percent. In one example, the percentage is in a range of about 9.3 percent to about 12.7 percent. In one example, the percentage is in a range of about 9.4 percent to about 12.6 percent. In one example, the percentage is in a range of about 9.5 percent to about 12.5 percent. In one example, the percentage is in a range of about 9.6 percent to about 12.4 percent. In one example, the percentage is in a range of about 9.7 percent to about 12.3 percent. In one example, the percentage is in a range of about 9.8 percent to about 12.2 percent. In one example, the percentage is in a range of about 9.9 percent to about 12.1 percent. In one example, the percentage is in a range of about 10 percent to about 12 percent. In one example, the percentage is in a range of about 10.1 percent to about 11.9 percent. In one example, the percentage is in a range of about 10.2 percent to about 11.8 percent. In one example, the percentage is in a range of about 10.3 percent to about 11.7 percent. In one example, the percentage is in a range of about 10.4 percent to about 11.6 percent. In one example, the percentage is in a range of about 10.5 percent to about 11.5 percent. In one example, the percentage is in a range of about 10.6 percent to about 11.4 percent. In one example, the percentage is in a range of about 10.7 percent to about 11.3 percent. In one example, the percentage is in a range of about 10.8 percent to about 11.2 percent. In one example, the percentage is in a range of about 10.9 percent to about 11.1 percent.

The length of the hinge 373, the perimeter of the closure plate 371, and the percentage of the length of the hinge 373 to the perimeter being in the ranges disclosed above creates an easier to open outlet closure 217 than comparative cup lids due to the hinge length being shorter than comparative lids. Moreover, as shown in FIGS. 6-9, the hinge 373 extends along the hinge side 371PH of the closure plate 371. Specifically, a slit is formed between the hinge side 371PH and the material of the sunken surface 362S between the hinge 373 and the sides 371PS of the closure plate 371 such that the hinge 373 may fold to allow the closure plate 371 to move to the opened position. Comparative lids suffer in that they tend to tear when the hinge occupies the entirety of the hinge side of the closure plate of the lid. The hinge 373 being formed directly on the hinge side 371PH and only occupying a portion of the hinge side 371PH, in particular a portion of the hinge side 371PH in the ranges of lengths described above, provides an improvement over comparative lids in that the chances of tearing at the hinge 373 are reduced.

The outlet closure 217 may include a lug top surface 372S and at least one retention ridge 3721 formed in at least one side of the closure-anchor lug 372, as shown in FIGS. 6-8. In the illustrative embodiment, the outlet closure 217 includes two vertically extending retention indents 3721 located on a rear-facing side of the closure-anchor lug 372 and a generally rectangular lug top surface 372S with rounded corners. The retention ridges 3721 are configured to engage corresponding recesses 368R formed in the lug-receiving cavity 368C so as to retain the outlet closure 217 in the opened position within the closure retainer 368. The closure-anchor lug 372 and the lug-receiving cavity 368C may include other combinations of recesses and ridges in other embodiments.

Figure 10A:
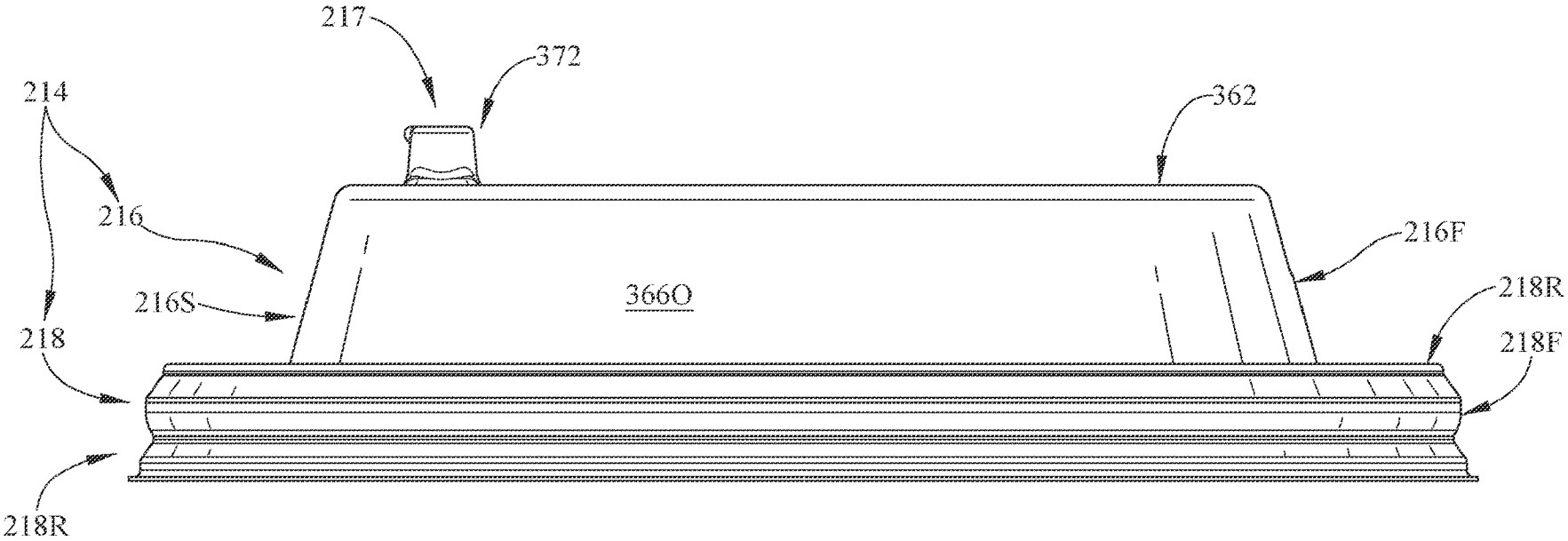
FIG. 10A is a side elevation view of the lid shown in FIG. 7 showing the outlet closure in the outlet-closing position to cause the closure anchor of the outlet closure to extend upwardly away from the generally horizontal annular top wall of the central closure.
Figure 10B:
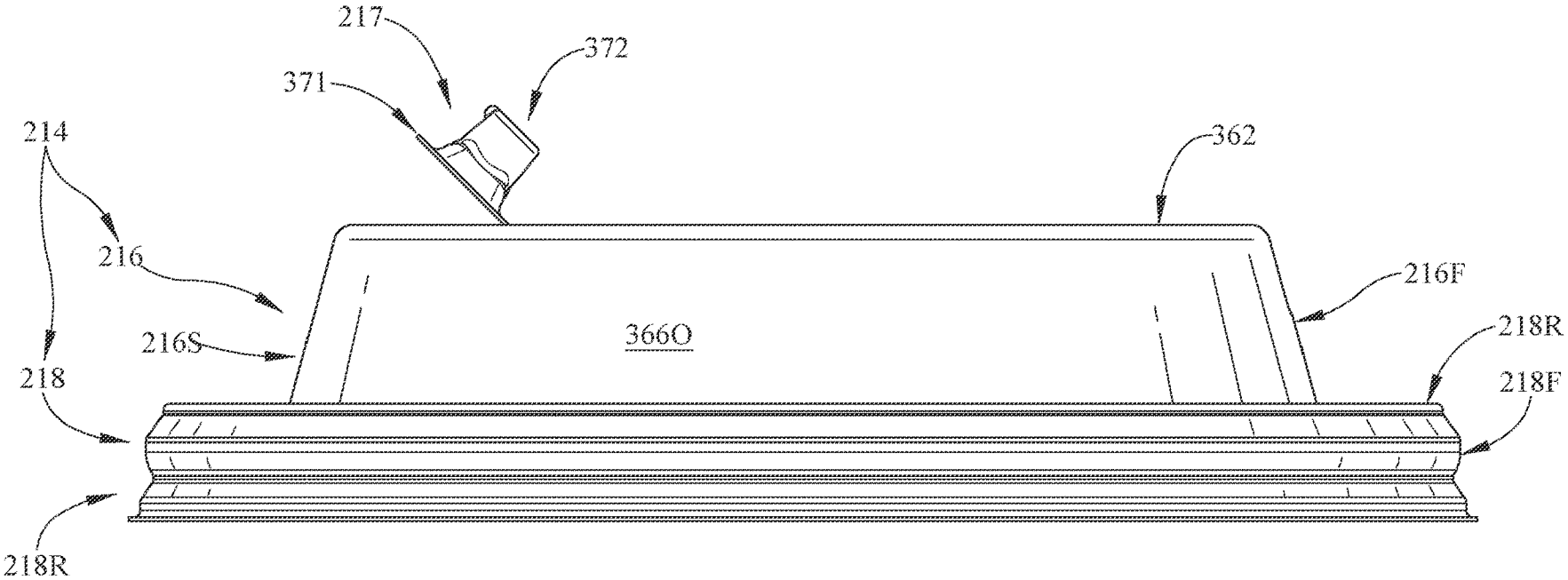
FIG. 10B is a view similar to FIG. 9A showing the orientation of the outlet closure during pivoting movement of the outlet closure from the outlet-closing position shown in FIGS. 6-8 and 10A and an outlet-opening position shown in FIGS. 9, 10B, and 10C.
Figure 10C:
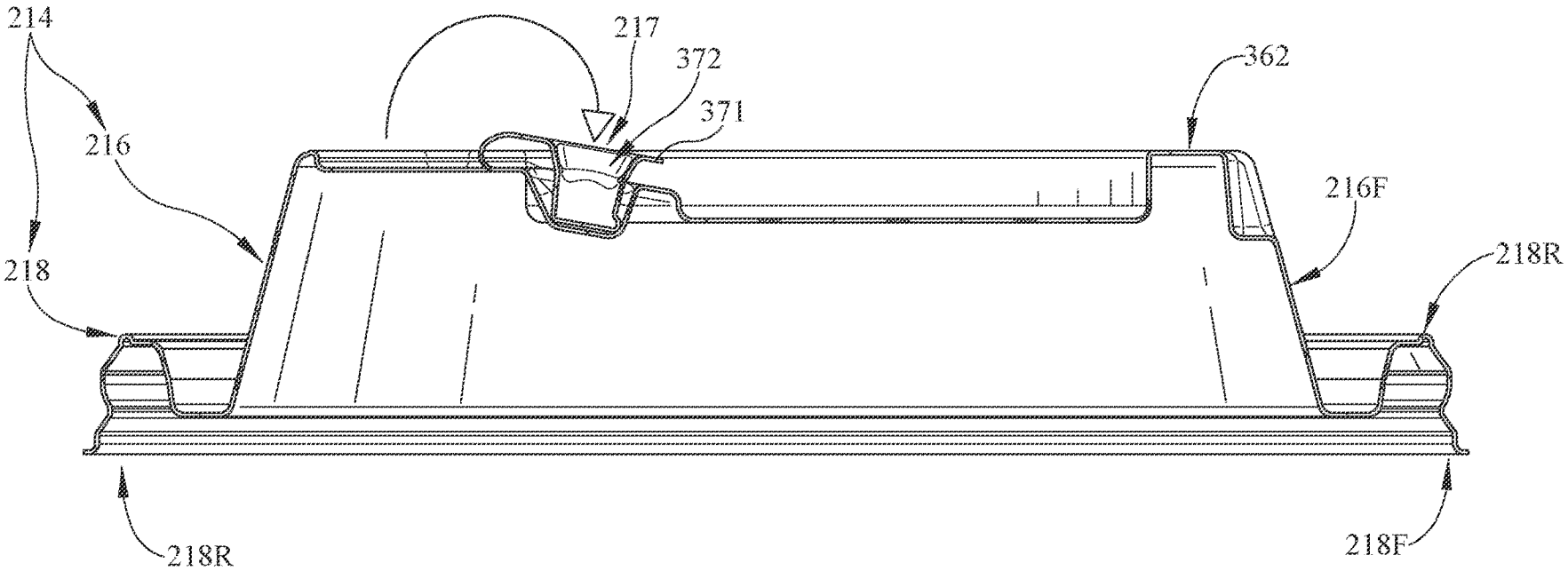
FIG. 10C is a cross sectional view through line 10C in FIG. 8 showing the orientation of the outlet closure upon arrival at the outlet-opening position shown in FIGS. 9, 10B, and 10C.

The closure retainer 368 is formed to include the upwardly facing lug-receiving cavity 368C that is sized to receive the tip of the closure-anchor lug 372 of outlet closure 217 therein when outlet closure 217 is pivoted by the user to the opened position shown in FIGS. 9, 10B, and 10C. The lug-receiving cavity 368C is bounded by at least four cavity side walls 368S1, 368S2, 368S3, and 368S4 and a generally horizontal floor 368F coupled to lower edges of each of the cavity side walls 368S1-4 as suggested in FIG. 8. These cavity side walls cooperate to define interference-fit means for temporarily retaining the closure-anchor lug 372 of the outlet closure 217 in the lug-receiving the cavity 368 upon movement of the outlet closure 217 to the opened position shown, for example, in FIGS. 9 and 10C. It is within the scope of the present disclosure to vary the shape of the lug-receiving cavity 368 and bordering portions of the annular top wall 362 to rigidify or reinforce the lug-receiving cavity 368 to minimize deformation of the lug-receiving cavity 368 and a surrounding border region during insertion of the closure-anchor lug 372 into the lug-receiving cavity 368C.

The closure retainer 368 is coupled to the annular top wall 362 and is formed to include a forwardly facing lug-receiving cavity 368C and side walls 368S1-4 as suggested in FIG. 8 that cooperate to provide detent means for retaining the retention ridges 3721 of the closure-anchor lug 372 in the lug-receiving cavity 368C upon movement of the outlet closure 217 to the opened position as suggested in FIGS. 8-10C. The outlet closure 217 is mounted for pivotable movement through an angle of about 150°-170° about pivot axis 217A between a closed position closing the liquid-discharge outlet 364 and an opened position opening the liquid-discharge outlet 364 and mating with a closure retainer 368 formed in central closure 216 as shown, for example, in FIG. 8.

Another embodiment of a liquid container 410 in accordance with the present disclosure is shown in FIGS. 11-15C. The liquid container 410 is similar to the liquid containers 10, 210 shown in FIGS. 11-15C and described herein. Accordingly, similar reference numbers in the 400 series indicate features that are common between the liquid container 410 and the liquid containers 10, 210. The description of the liquid containers 10, 210 is incorporated by reference to apply to the liquid container 410, except in instances when it conflicts with the specific description and the drawings of the liquid container 410.

A drink cup lid 414 of the liquid container 410 includes a ring-shaped brim mount 418 adapted to mate with a brim 420 of a drink cup 412 and a central closure 416 surrounded by brim mount 420 and formed to include a spout side 416S that is formed to include a high-elevation liquid-discharge outlet 564 for liquid consumption by a consumer as shown, for example, in FIGS. 11-15C.

The central closure 416 rises upwardly above and is surrounded circumferentially by the brim mount 418 and includes a front side 416F that is located inside a front semicircular portion 418F of the brim mount 418 and a spout side 416S that is formed to include a high-elevation liquid-discharge outlet 564 and is located inside a rear semicircular portion 418R of the brim mount 418 in spaced-apart confronting relation to the front side 416F, as suggested in FIGS. 11-15C. The central closure 416 includes an annular top wall 562 that extends entirely circumferentially within the brim mount 418 when viewed from a top-down perspective. The annular top wall 562 includes a radially outer circumferential edge and a radially inner circumferential edge. The central closure also includes the outer wall 566O that is appended to the radially outer circumferential edge of the annular top wall 562, as shown in FIGS. 11-14. The outer wall 566O extends around and downwardly away from the outer perimeter edge.

The annular top wall 562 is formed substantially similarly to the annular top wall 162, specifically to include an elevated portion 562E, a sunken portion 562S, and an inwardly angled top aperture surface 562AS, as shown in FIGS. 11-14. In the illustrative embodiment, the sunken portion 562S is formed as a planar platform at the spout side 416S of the central closure 416 and is sized to include the liquid-discharge outlet 564. The sunken portion 562S is arranged below the elevated portion 562E, and in at least some embodiments, is formed to be parallel with the plane defined by the elevated portion 562E. In some embodiments, the distance between the sunken portion 562S and the elevated portion 562E is about 1.25 mm. In some embodiments, the distance between the sunken portion 562S and the elevated portion 562E is five percent of the total height of the central closure 416.

The sunken portion 562S is formed substantially similarly to the sunken portion 562S, specifically to include a spout side edge 562SE that extends along and follows the contour of the outer wall 566O on the spout side 416S of the central closure 416, as shown in FIGS. 11-14. The sunken portion also includes circumferentially spaced apart terminal ends 562STE located opposite each other relative to the sunken surface 562S. In some embodiments, the terminal ends 562STE are symmetrical and are S-shaped. The sunken portion 562S further includes an inner edge 562SI that is generally linear and located radially inward from the spout side edge 562SE. The inner edge 562SI is located at a transition from the sunken portion 562S to the top aperture surface 562AS, as suggested in FIGS. 11-14.

The spout side edge 562SE and the terminal ends 562STE each include a steeply sloped transition surface 562TS that transitions from the sunken surface 562S to the elevated portion 562E, in the case of the terminal ends 562STE, or to a sipping rim 562SR of the annular top wall 562, in the case of the spout side edge 562SE. The sipping rim 562SR is coplanar with the elevated portion 562E in at least some embodiments.

The elevated portion 562E extends circumferentially away from the top of the transition surfaces 562SS at the terminal ends 562STE of the sunken surface 562S, as shown in FIGS. 11-14. In the illustrative embodiment, the elevated portion 562E is formed to have a generally constant radial width along the circumferential extent of the elevated portion 562E. In some embodiments, the elevated portion 562E includes a constant radial width along at least half of the circumferential extent of the annular top wall 562. In some embodiments, the elevated portion 562E includes a constant radial width along about three-quarters of the circumferential extent of the annular top wall 562 and the sunken portion 562S extends about one quarter of the circumferential extent, as suggested in FIGS. 11-14. In such embodiments, the three-quarters of the elevated portion 562E having the constant width includes an indent at the frontmost end of the annular top wall 562 on the front side 16F of the central closure 16 where a guide recess 390 is located. In some embodiments, the radial width in the constant width area is about 6.1 mm.

Figure 11:
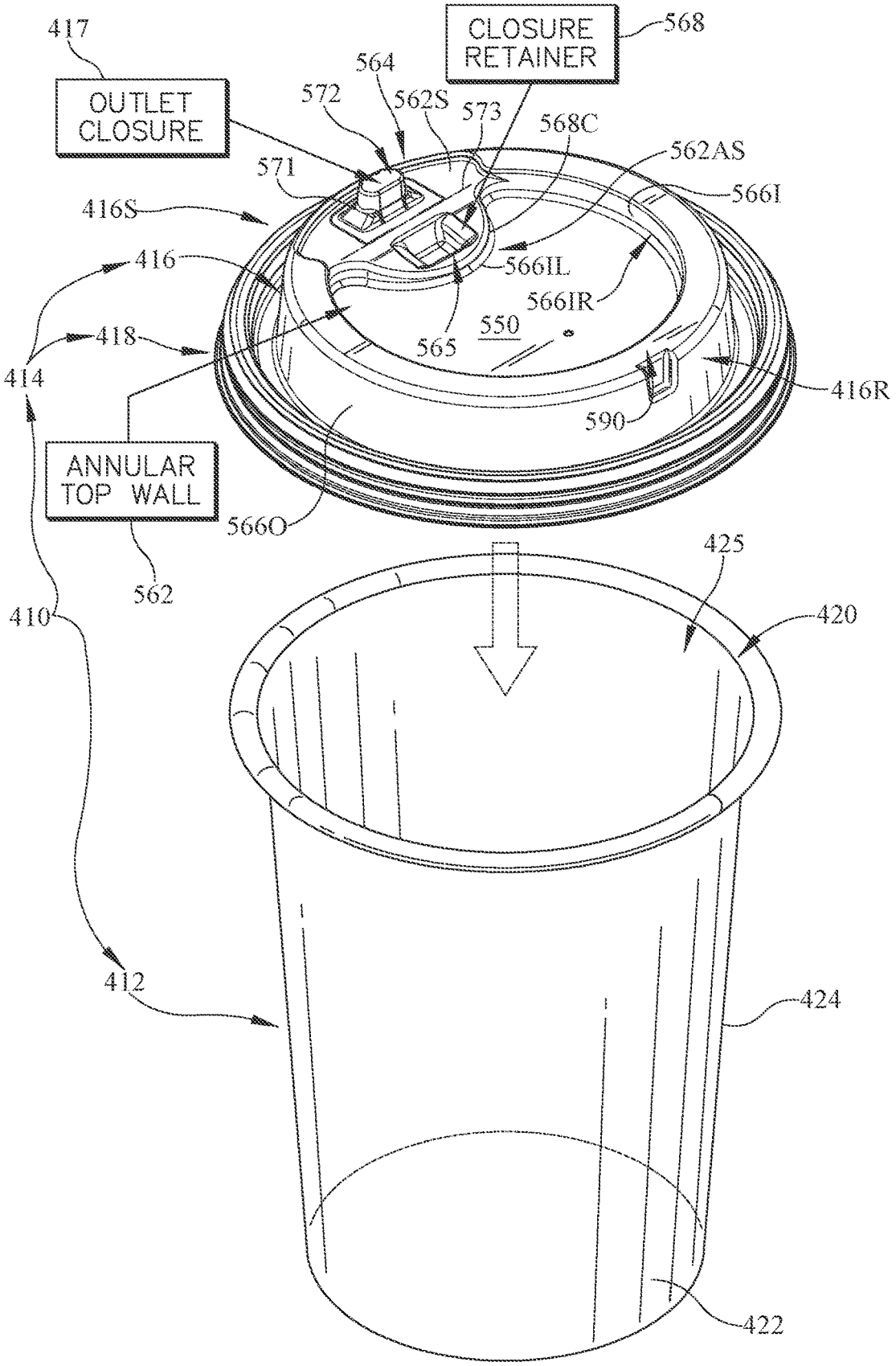
FIG. 11 is a perspective view of a lid in accordance with another embodiment of the present disclosure and a cup before the lid is mounted on the cup and showing that the lid includes a ring-shaped brim mount adapted to mate with the brim of the cup, a central closure surrounded by the brim mount and formed to include an annular top wall formed to include a top aperture and an adjacent liquid-discharge outlet and an outer wall arranged to extend around an entirety of a circumferential extent of the annular top wall and downwardly from the annular top wall toward an interior region surrounded by the ring-shaped brim mount, and an outlet closure mounted for pivotable movement between an outlet-closing position shown in FIGS. 11-13 and 15A and an outlet-opening position shown in FIGS. 14, 15B, and 15C.
Figure 12:
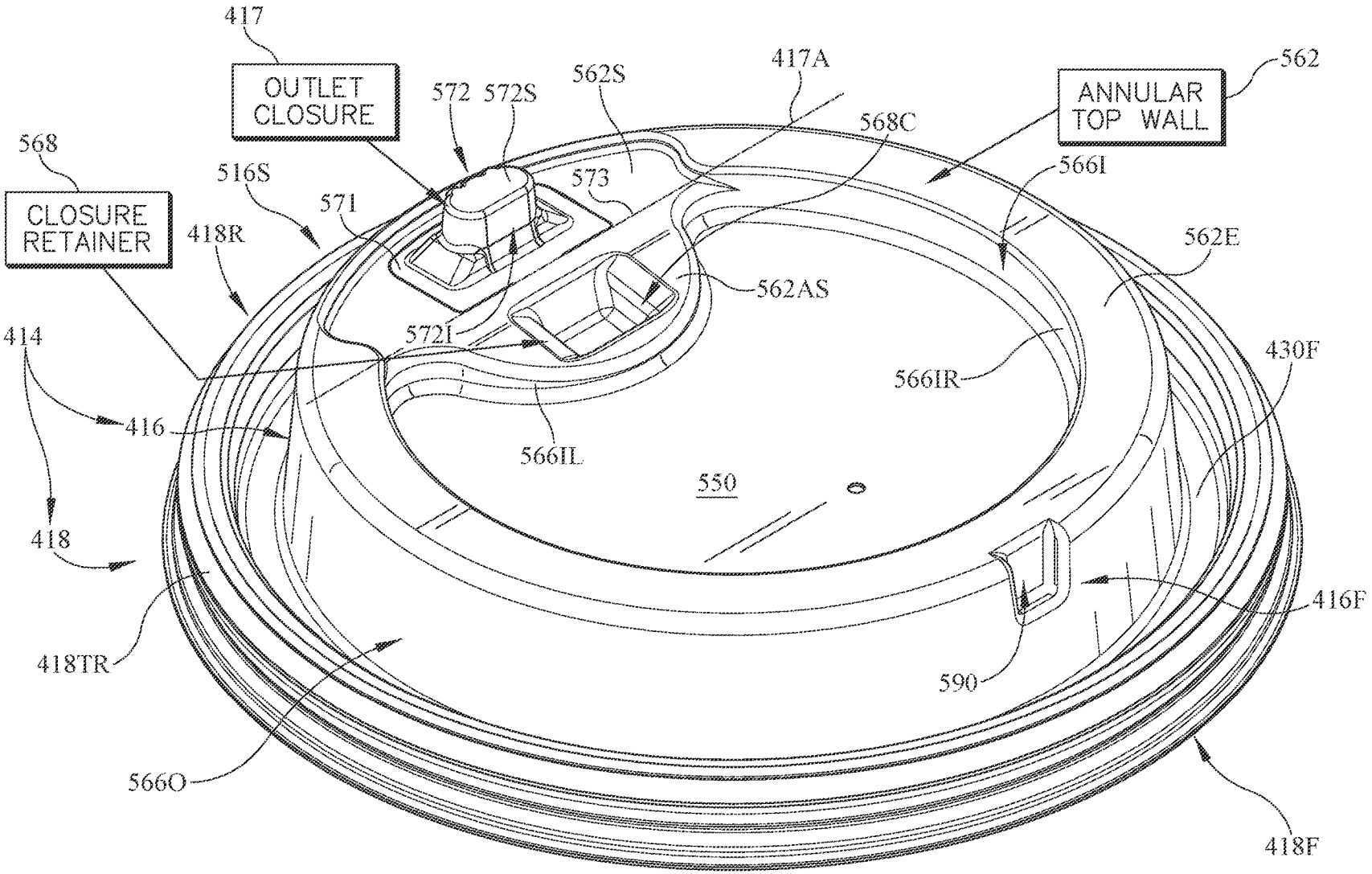
FIG. 12 is an enlarged perspective view of the lid of FIG. 11 showing the outlet closure in the closed position, showing that the lid further includes an inner wall that extends downwardly from an inner edge of the annular top wall of the central closure, and showing that the top aperture is located between the liquid-discharge outlet and a serpentine-shaped portion of inner wall on an inwardly sloped top aperture portion of a sunken portion of the annular top wall.
Figure 13:
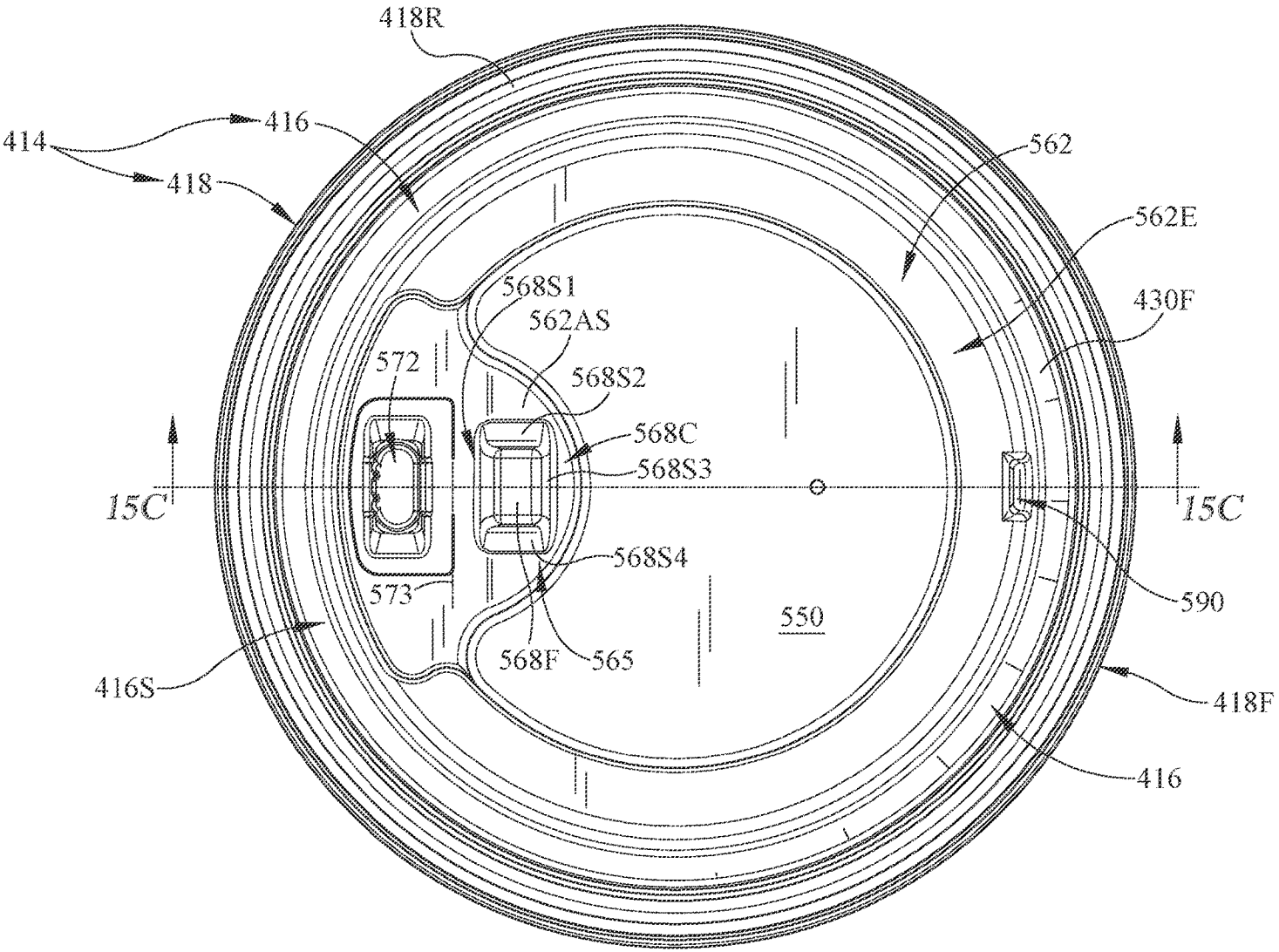
FIG. 13 is an enlarged top view of the lid of FIG. 11 showing the outlet closure in the closed position and that the top aperture is located between the liquid-discharge outlet and the serpentine-shaped portion of inner wall on the inwardly sloped top aperture portion of the sunken portion of the annular top wall.
Figure 14:
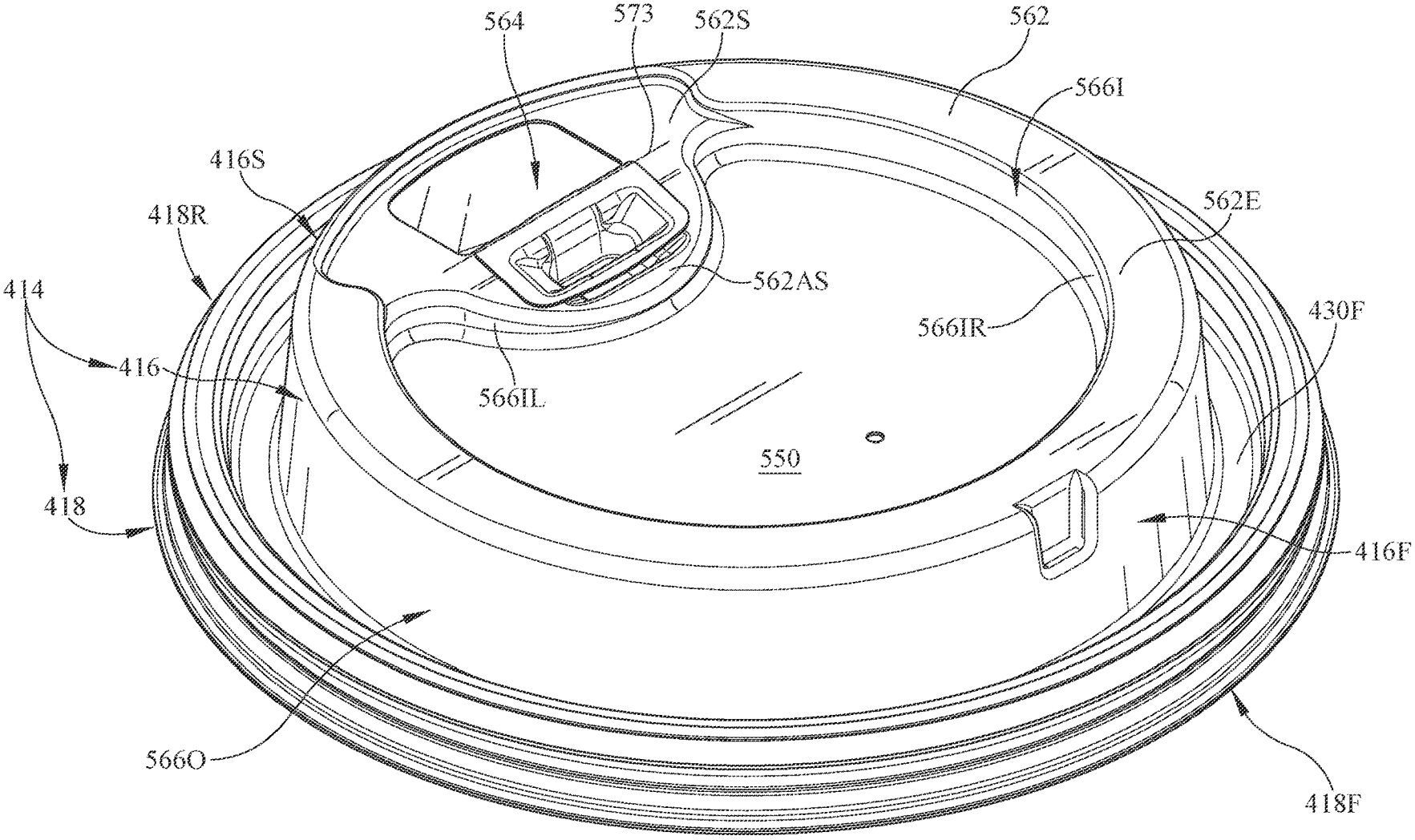
FIG. 14 is an enlarged perspective view of similar to FIG. 12 showing the outlet closure retained in the outlet-opening position, and showing that the liquid-discharge outlet has been opened in response to pivoting movement of the outlet closure to the outlet-opening position in which the closure-anchor lug of the outlet closure is extended through the top aperture formed in the annular top wall and into the underlying lug-receiving cavity formed in the closure retainer that is coupled to the underside of the annular top wall.

The inwardly angled top aperture surface 562AS of the annular top wall 562 extends away from the inward edge 562SI of the sunken surface 562S towards the front side 416F of the central closure 416, as shown in FIGS. 11-14. In the illustrative embodiment as shown in FIGS. 11-15C, the angle of the top aperture surface 562AS is about −10 degrees, although other angles may be used in some embodiments based on the requirements of the lid 414. The top aperture surface 562AS is formed to include the top aperture 565 as well as the upwardly facing lug-receiving cavity 568C, as will be discussed in greater detail below. As can be seen in FIGS. 11, 12, and 14, the top aperture 565 and the lug-receiving cavity 568C partially extend into the sunken surface 562S beyond the inner edge 562SI. In the illustrative embodiment, the top aperture surface 562AS includes a rounded radially inner edge having a generally semicircular shape located opposite the inner edge 562SI of the sunken surface 562S.

In the illustrative embodiment, the outer wall 566O extends around and downwardly away from the outer perimeter edge of the annular top wall 562, as shown in FIGS. 11-14. The outer wall 566O extends vertically upwardly away from a floor 430F of a ring-shaped low-elevation liquid-retention channel 430 that surrounds the outer wall 566O and is located between the outer wall 566O and the brim 418. The slope of the outer wall 566O is generally linear such that the outer wall 566O is flat. In the illustrative embodiment as shown in FIGS. 11, 12, and 14, the angle of the slope of the outer wall 566O is about 85 degrees, although the slope may be different in some embodiments based on the requirements of the lid 414. The height of the outer wall 566O measured in the vertical direction from the floor 430F to the top of the outer wall 566O may be about 1.57 cm.

In the illustrative embodiment, the central closure 416 further includes the inner wall 5661 arranged to extend around and downwardly away from the inner perimeter edge of the annular top wall 562, as shown in FIGS. 11, 12, and 14. The lowered portion 566IL of the inner wall 5661 extends from the inwardly angled top aperture surface 562AS of the annular top wall 562. In the illustrative embodiment, the vertical height of the lowered portion 566IL at its shortest point which is at the crest of the semicircular rounded radially inner edge of the top aperture surface 562AS is about 2.2 mm. Because of the rounded shape of the inner edge of the top aperture surface 562AS, the height of the lowered portion 566IL increases as the lowered portion 566IL extends away from the shortest point, as shown in FIGS. 11, 12, and 14. The height of the lowered portion 566IL increases until it meets the height of the constant height portion 566IC of the inner wall 5661.

The constant height portion 566IC of the inner wall 5661 extends around the remainder of the radially inner circumferential edge of the annular top wall 562, as shown in FIGS. 11-14. In the illustrative embodiment, the constant height portion 566IC extends circumferentially around the basin floor 550 and around the radially inner circumferential edge of the annular top wall 562 between the two transition surfaces 562TS. The constant height portion 566IC has a constant vertical height along the circumferential extent of the constant height portion 566IC, as shown in FIGS. 11, 12, and 14. In the illustrative embodiment, the height of the constant height portion 566IC is about 5.1 mm, although other heights may be used in some embodiments based on the requirements of the lid 414.

In illustrative embodiments, the central closure 416 includes the generally crescent-shaped basin floor 550 located between and circumscribed by the lower circumferential edge of the inner wall 5661, as suggested in FIGS. 11-14. The crescent-shaped basin floor 550 is substantially flat in an illustrative embodiment and includes rounded edges that extend towards the spout side 416S of the central closure 416 on opposite sides of the top aperture surface 562AS and adjoin with a generally annular outer edge of the basin floor 550. In the illustrative embodiment, the floor 430F of the ring-shaped low-elevation liquid-retention channel 430 surrounds the basin floor 550 and the central closure 416 as suggested in FIGS. 11 and 12.

The central closure 416 further includes the guide recess 590 located diametrically opposite of the outlet closure 417, as shown in FIGS. 11-14. The guide recess 490 is formed partially in the outer wall 566O and is arranged to extend radially inwardly and into the annular top wall 562. The guide recess 490 may help visually tell a server of the liquid container 410 where to place the cup 412 seam and may also help with locating and placing the lid 414 on the cup 412.

The outlet closure 417 includes a closure plate 571, an upstanding nose-shaped closure-anchor lug 572 coupled to the closure plate 571, and a hinge 573 coupled to a front-facing hinge side 571PH of the perimeter of the closure plate 571 and extending along horizontally extending pivot axis 417A as shown, for example, in FIGS. 11-14. The closure plate 571 is a flange coupled to a lower edge of the upstanding nose-shaped closure-anchor lug 572 and arranged to extend outwardly therefrom and extends in a plane substantially parallel to the plane of the annular top wall 562 when the outlet closure 417 is in the closed position as suggested in FIGS. 11-13. The lid 414 is thermoformed to normally position the outlet closure 417 in the closed position in an illustrative embodiment. It is within the scope of this disclosure to provide the closure-anchor lug 572 with any suitable shape so long as it is retained by closure retainer 568 in an opened position as disclosed herein.

The hinge 573 extends coaxially with the pivot axis 417A, as shown in FIG. 12. The perimeter of the closure plate 571 includes a rear side 571PR, two opposing sides 571PS, and the hinge side 571PH. In the illustrative embodiment, the two opposing sides 571PS are symmetrical and extend between the ends of the rear side 571PR and the hinge side 571PH.

In the illustrative embodiment, the length of the hinge 573 may be less than about 0.3 inches. In another example, the length of the hinge 573 is about 0.3 inches. In another example, the length of the hinge 573 is about 0.2 inches. In another example the length of the hinge 573 is about 0.25 inches.

In one example, the length of the hinge 573 is in a range of 0.1 inches to about 0.3 inches. In one example, the length of the hinge 573 is in a range of about 0.11 inches to about 0.3 inches. In one example, the length of the hinge 573 is in a range of about 0.12 inches to about 0.3 inches. In one example, the length of the hinge 573 is in a range of about 0.13 inches to about 0.3 inches. In one example, the length of the hinge 573 is in a range of about 0.14 inches to about 0.3 inches. In one example, the length of the hinge 573 is in a range of about 0.15 inches to about 0.3 inches. In one example, the length of the hinge 573 is in a range of about 0.16 inches to about 0.3 inches. In one example, the length of the hinge 573 is in a range of about 0.17 inches to about 0.3 inches. In one example, the length of the hinge 573 is in a range of about 0.18 inches to about 0.3 inches. In one example, the length of the hinge 573 is in a range of about 0.19 inches to about 0.3 inches.

In one example, the length of the hinge 573 is in a range of 0.2 inches to about 0.3 inches. In one example, the length of the hinge 573 is in a range of about 0.21 inches to about 0.3 inches. In one example, the length of the hinge 573 is in a range of about 0.22 inches to about 0.3 inches. In one example, the length of the hinge 573 is in a range of about 0.23 inches to about 0.3 inches. In one example, the length of the hinge 573 is in a range of about 0.24 inches to about 0.3 inches. In one example, the length of the hinge 573 is in a range of about 0.25 inches to about 0.3 inches.

In one example, the length of the hinge 573 is in a range of 0.1 inches to about 0.29 inches. In one example, the length of the hinge 573 is in a range of about 0.1 inches to about 0.28 inches. In one example, the length of the hinge 573 is in a range of about 0.1 inches to about 0.27 inches. In one example, the length of the hinge 573 is in a range of about 0.1 inches to about 0.26 inches. In one example, the length of the hinge 573 is in a range of about 0.1 inches to about 0.25 inches.

In one example, the length of the hinge 573 is in a range of about 0.15 inches to about 0.3 inches. In another example, the length of the hinge 573 is in a range of about 0.16 inches to about 0.29 inches. In another example, the length of the hinge 573 is in a range of about 0.17 inches to about 0.28 inches. In another example, the length of the hinge 573 is in a range of about 0.18 inches to about 0.27 inches. In another example, the length of the hinge 573 is in a range of about 0.19 inches to about 0.26 inches. In another example, the length of the hinge 573 is in a range of about 0.2 inches to about 0.25 inches.

In one example, the length of the hinge 573 is in a range of about 0.2 inches to about 0.3 inches. In another example, the length of the hinge 573 is in a range of about 0.21 inches to about 0.29 inches. In another example, the length of the hinge 573 is in a range of about 0.22 inches to about 0.28 inches. In another example, the length of the hinge 573 is in a range of about 0.23 inches to about 0.27 inches. In another example, the length of the hinge 573 is in a range of about 0.24 inches to about 0.26 inches.

In the illustrative embodiment, the total length of the perimeter of the closure plate 571, that being the total length of the rear side 571PR, the two opposing sides 571PS, and the hinge side 571PH, may be less than about 2.4 inches. In another example, the perimeter of the closure plate 571 is about 2.3 inches.

In one example, the perimeter of the closure plate 571 is in a range of about 1.5 inches to about 2.5 inches. In one example, the perimeter of the closure plate 571 is in a range of about 1.6 inches to about 2.5 inches. In one example, the perimeter of the closure plate 571 is in a range of about 1.7 inches to about 2.5 inches. In one example, the perimeter of the closure plate 571 is in a range of about 1.8 inches to about 2.5 inches. In one example, the perimeter of the closure plate 571 is in a range of about 1.9 inches to about 2.5 inches. In one example, the perimeter of the closure plate 571 is in a range of about 2.0 inches to about 2.5 inches. In one example, the perimeter of the closure plate 571 is in a range of about 2.1 inches to about 2.5 inches. In one example, the perimeter of the closure plate 571 is in a range of about 2.2 inches to about 2.5 inches. In one example, the perimeter of the closure plate 571 is in a range of about 2.3 inches to about 2.5 inches.

In one example, the perimeter of the closure plate 571 is in a range of about 1.5 inches to about 2.5 inches. In one example, the perimeter of the closure plate 571 is in a range of about 1.5 inches to about 2.4 inches. In one example, the perimeter of the closure plate 571 is in a range of about 1.5 inches to about 2.3 inches.

In one example, the perimeter of the closure plate 571 is in a range of about 1.5 inches to about 2.5 inches. In one example, the perimeter of the closure plate 571 is in a range of about 1.6 inches to about 2.4 inches. In one example, the perimeter of the closure plate 571 is in a range of about 1.7 inches to about 2.3 inches.

In one example, the perimeter of the closure plate 571 is in a range of about 1.5 inches to about 2.5 inches. In one example, the perimeter of the closure plate 571 is in a range of about 1.5 inches to about 2.4 inches. In one example, the perimeter of the closure plate 571 is in a range of about 1.5 inches to about 2.3 inches.

In one example, the perimeter of the closure plate 571 is in a range of about 1.5 inches to about 2.5 inches. In one example, the perimeter of the closure plate 571 is in a range of about 1.6 inches to about 2.4 inches. In one example, the perimeter of the closure plate 571 is in a range of about 1.7 inches to about 2.3 inches.

In the illustrative embodiment, the percentage of the length of the hinge 573 to the total length of the perimeter of the closure plate 571, may be less than about 11 percent. In another example, the percentage is about 10.9 percent.

In one example, the percentage is in a range of about 9 percent to about 13 percent. In one example, the percentage is in a range of about 9.1 percent to about 13 percent. In one example, the percentage is in a range of about 9.2 percent to about 13 percent. In one example, the percentage is in a range of about 9.3 percent to about 13 percent. In one example, the percentage is in a range of about 9.4 percent to about 13 percent. In one example, the percentage is in a range of about 9.5 percent to about 13 percent. In one example, the percentage is in a range of about 9.6 percent to about 13 percent. In one example, the percentage is in a range of about 9.7 percent to about 13 percent. In one example, the percentage is in a range of about 9.8 percent to about 13 percent. In one example, the percentage is in a range of about 9.9 percent to about 13 percent. In one example, the percentage is in a range of about 10 percent to about 13 percent. In one example, the percentage is in a range of about 10.1 percent to about 13 percent. In one example, the percentage is in a range of about 10.2 percent to about 13 percent. In one example, the percentage is in a range of about 10.3 percent to about 13 percent. In one example, the percentage is in a range of about 10.4 percent to about 13 percent. In one example, the percentage is in a range of about 10.5 percent to about 13 percent. In one example, the percentage is in a range of about 10.6 percent to about 13 percent. In one example, the percentage is in a range of about 10.7 percent to about 13 percent. In one example, the percentage is in a range of about 10.8 percent to about 13 percent. In one example, the percentage is in a range of about 10.9 percent to about 13 percent.

In one example, the percentage is in a range of about 9 percent to about 13 percent. In one example, the percentage is in a range of about 9 percent to about 12.9 percent. In one example, the percentage is in a range of about 9 percent to about 12.8 percent. In one example, the percentage is in a range of about 9 percent to about 12.7 percent. In one example, the percentage is in a range of about 9 percent to about 12.6 percent. In one example, the percentage is in a range of about 9 percent to about 12.5 percent. In one example, the percentage is in a range of about 9 percent to about 12.4 percent. In one example, the percentage is in a range of about 9 percent to about 12.3 percent. In one example, the percentage is in a range of about 9 percent to about 12.2 percent. In one example, the percentage is in a range of about 9 percent to about 12.1 percent. In one example, the percentage is in a range of about 9 percent to about 12 percent. In one example, the percentage is in a range of about 9 percent to about 11.9 percent. In one example, the percentage is in a range of about 9 percent to about 11.8 percent. In one example, the percentage is in a range of about 9 percent to about 11.7 percent. In one example, the percentage is in a range of about 9 percent to about 11.6 percent. In one example, the percentage is in a range of about 9 percent to about 11.5 percent. In one example, the percentage is in a range of about 9 percent to about 11.4 percent. In one example, the percentage is in a range of about 9 percent to about 11.3 percent. In one example, the percentage is in a range of about 9 percent to about 11.2 percent. In one example, the percentage is in a range of about 9 percent to about 11.1 percent. In one example, the percentage is in a range of about 9 percent to about 11 percent. In one example, the percentage is in a range of about 9 percent to about 10.9 percent.

In one example, the percentage is in a range of about 9 percent to about 13 percent. In one example, the percentage is in a range of about 9.1 percent to about 12.9 percent. In one example, the percentage is in a range of about 9.2 percent to about 12.8 percent. In one example, the percentage is in a range of about 9.3 percent to about 12.7 percent. In one example, the percentage is in a range of about 9.4 percent to about 12.6 percent. In one example, the percentage is in a range of about 9.5 percent to about 12.5 percent. In one example, the percentage is in a range of about 9.6 percent to about 12.4 percent. In one example, the percentage is in a range of about 9.7 percent to about 12.3 percent. In one example, the percentage is in a range of about 9.8 percent to about 12.2 percent. In one example, the percentage is in a range of about 9.9 percent to about 12.1 percent. In one example, the percentage is in a range of about 10 percent to about 12 percent. In one example, the percentage is in a range of about 10.1 percent to about 11.9 percent. In one example, the percentage is in a range of about 10.2 percent to about 11.8 percent. In one example, the percentage is in a range of about 10.3 percent to about 11.7 percent. In one example, the percentage is in a range of about 10.4 percent to about 11.6 percent. In one example, the percentage is in a range of about 10.5 percent to about 11.5 percent. In one example, the percentage is in a range of about 10.6 percent to about 11.4 percent. In one example, the percentage is in a range of about 10.7 percent to about 11.3 percent. In one example, the percentage is in a range of about 10.8 percent to about 11.2 percent. In one example, the percentage is in a range of about 10.9 percent to about 11.1 percent.

The length of the hinge 573, the perimeter of the closure plate 571, and the percentage of the length of the hinge 573 to the perimeter being in the ranges disclosed above creates an easier to open outlet closure 417 than comparative cup lids due to the hinge length being shorter than comparative lids. Moreover, as shown in FIGS. 11-14, the hinge 573 extends along the hinge side 571PH of the closure plate 571. Specifically, a slit is formed between the hinge side 571PH and the material of the sunken surface 562S between the hinge 573 and the sides 571PS of the closure plate 571 such that the hinge 573 may fold to allow the closure plate 571 to move to the opened position. Comparative lids suffer in that they tend to tear when the hinge occupies the entirety of the hinge side of the closure plate of the lid. The hinge 573 being formed directly on the hinge side 571PH and only occupying a portion of the hinge side 571PH, in particular a portion of the hinge side 571PH in the ranges of lengths described above, provides an improvement over comparative lids in that the chances of tearing at the hinge 573 are reduced.

The outlet closure 417 may include a lug top surface 572S and at least one retention ridge 5721 formed in at least one side of the closure-anchor lug 572, as shown in FIGS. 11-13. In the illustrative embodiment, the outlet closure 417 includes two vertically extending retention indents 5721 located on a rear-facing side of the closure-anchor lug 572 and a generally rectangular lug top surface 572S with rounded corners. The retention ridges 5721 are configured to engage corresponding recesses 568R formed in the lug-receiving cavity 568C so as to retain the outlet closure 417 in the opened position within the closure retainer 568. The closure-anchor lug 572 and the lug-receiving cavity 568C may include other combinations of recesses and ridges in other embodiments.

Figure 15A:
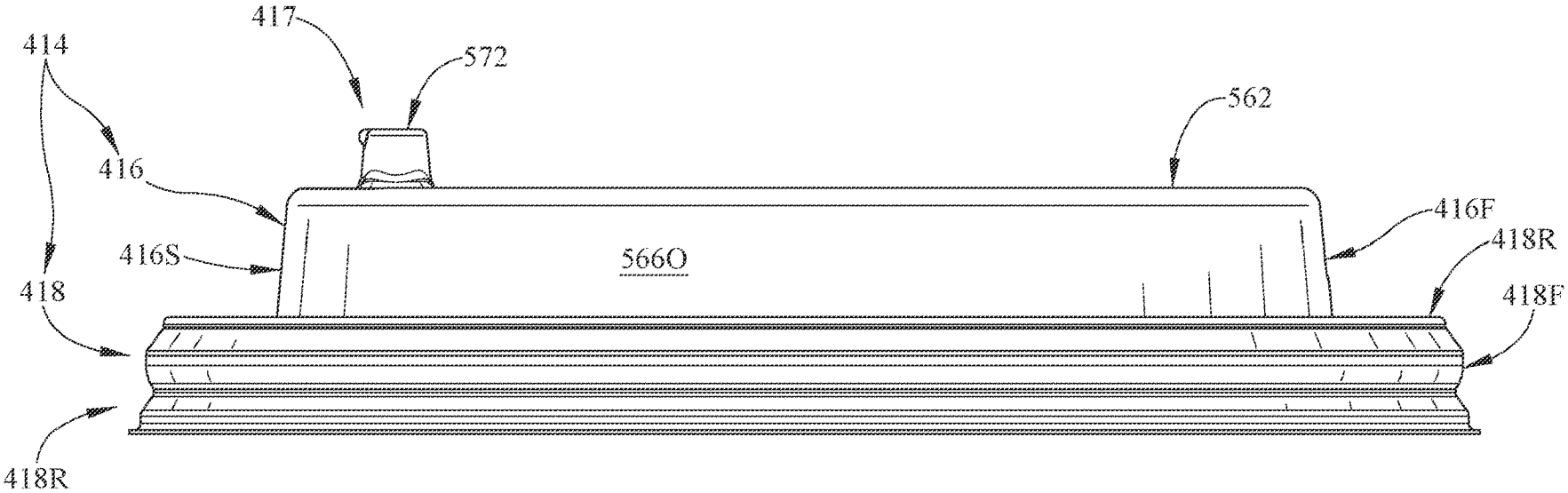
FIG. 15A is a side elevation view of the lid shown in FIG. 12 showing the outlet closure in the outlet-closing position to cause the closure anchor of the outlet closure to extend upwardly away from the generally horizontal annular top wall of the central closure.
Figure 15B:
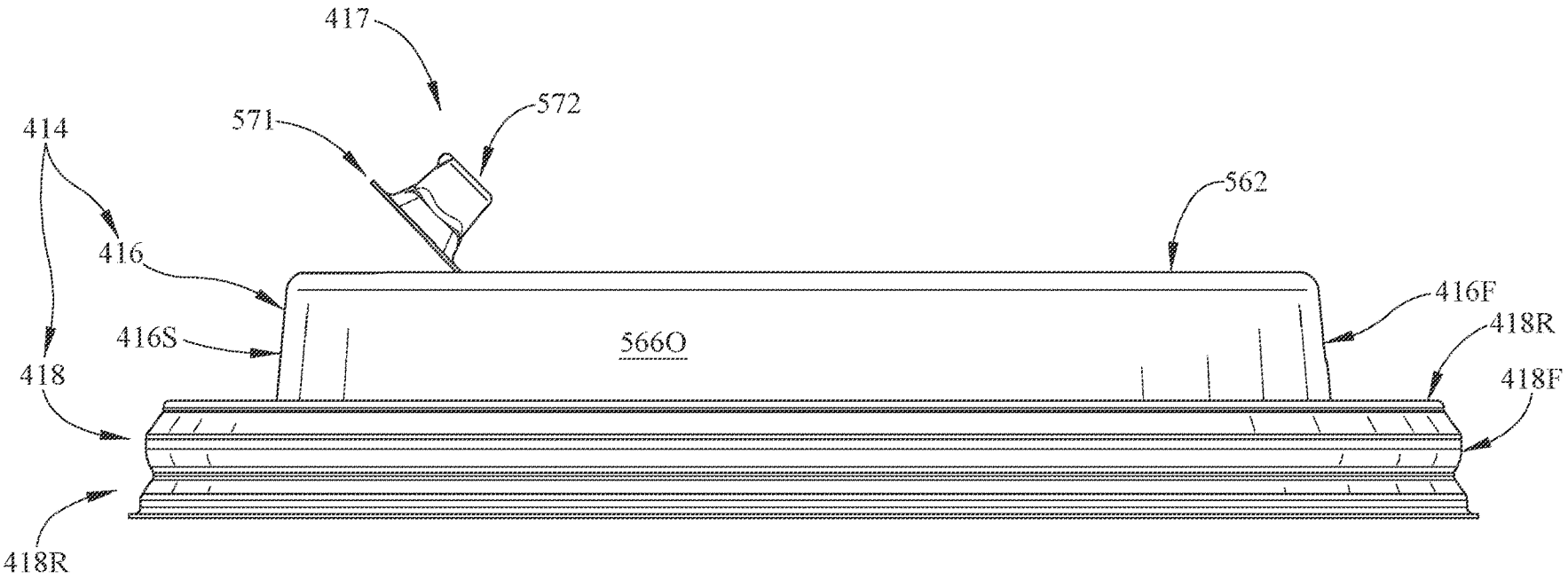
FIG. 15B is a view similar to FIG. 14A showing the orientation of the outlet closure during pivoting movement of the outlet closure from the outlet-closing position shown in FIGS. 11-13 and 15A and an outlet-opening position shown in FIGS. 14, 15B, and 15C.
Figure 15C:
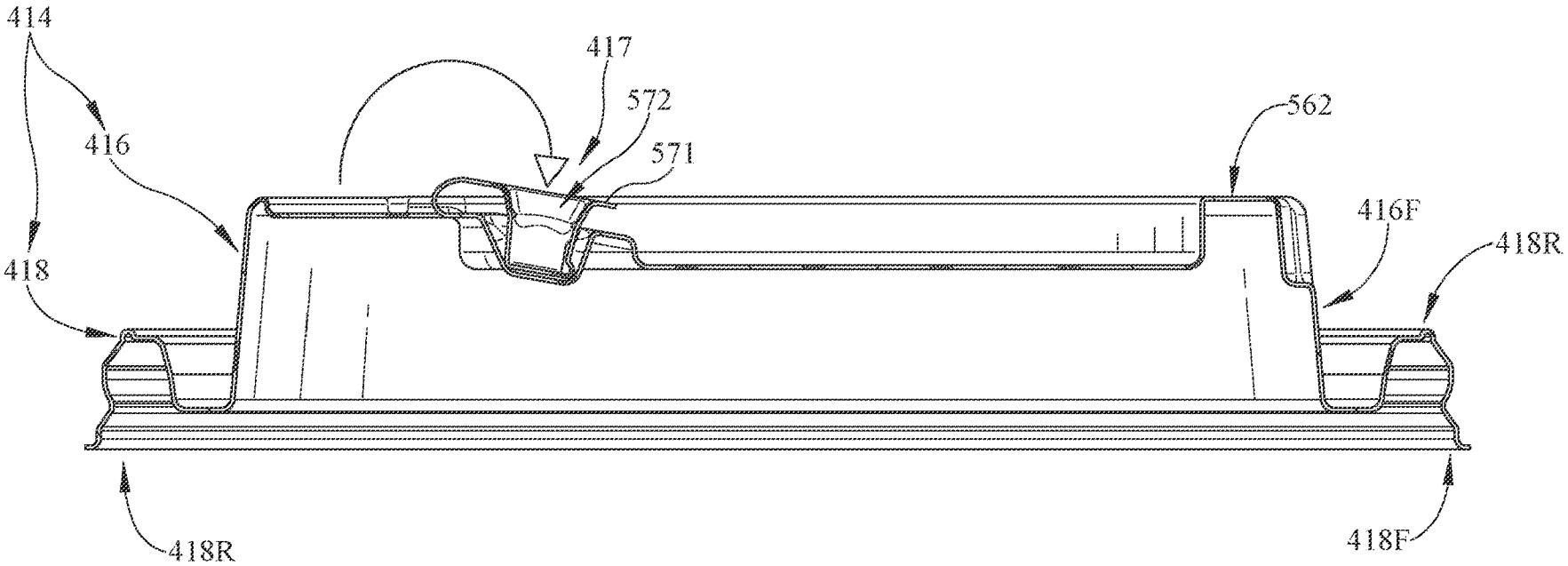
FIG. 15C is a cross sectional view through line 15C in FIG. 13 showing the orientation of the outlet closure upon arrival at the outlet-opening position shown in FIGS. 14, 15B, and 15C.

The closure retainer 568 is formed to include the upwardly facing lug-receiving cavity 568C that is sized to receive the tip of the closure-anchor lug 572 of outlet closure 417 therein when outlet closure 417 is pivoted by the user to the opened position shown in FIGS. 14, 15B, and 15C. The lug-receiving cavity 568C is bounded by at least four cavity side walls 568S1, 568S2, 568S3, and 568S4 and a generally horizontal floor 568F coupled to lower edges of each of the cavity side walls 568S1-4 as suggested in FIG. 13. These cavity side walls cooperate to define interference-fit means for temporarily retaining the closure-anchor lug 572 of the outlet closure 417 in the lug-receiving the cavity 568 upon movement of the outlet closure 417 to the opened position shown, for example, in FIGS. 14 and 15C. It is within the scope of the present disclosure to vary the shape of the lug-receiving cavity 568 and bordering portions of the annular top wall 562 to rigidify or reinforce the lug-receiving cavity 568 to minimize deformation of the lug-receiving cavity 568 and a surrounding border region during insertion of the closure-anchor lug 572 into the lug-receiving cavity 568C.

The closure retainer 568 is coupled to the annular top wall 562 and is formed to include a forwardly facing lug-receiving cavity 568C and side walls 568S1-4 as suggested in FIG. 13 that cooperate to provide detent means for retaining the retention ridges 5721 of the closure-anchor lug 572 in the lug-receiving cavity 568C upon movement of the outlet closure 417 to the opened position as suggested in FIGS. 13-15C. The outlet closure 417 is mounted for pivotable movement through an angle of about 150°-170° about pivot axis 417A between a closed position closing the liquid-discharge outlet 564 and an opened position opening the liquid-discharge outlet 564 and mating with a closure retainer 568 formed in central closure 416 as shown, for example, in FIG. 13.

The dimensional scale of the embodiments of the liquid container described herein are accurately reflected in the drawings, in particular in FIGS. 1-15C. Thus, all illustrations included herein accurately represent the dimensions of the liquid container, including distances and angles. As such, all possible dimensions of the embodiments of the liquid container are disclosed in the illustrations.

The invention claimed is:

1. A drink cup lid comprising a ring-shaped brim mount adapted to mate with a brim of a drink cup, a central closure surrounded by the ring-shaped brim mount and including an annular top wall formed to include a top aperture and an adjacent liquid-discharge outlet and an outer wall arranged to extend around an entirety of a circumferential extent of the annular top wall and downwardly from the annular top wall toward an interior region surrounded by the ring-shaped brim mount, an outlet closure coupled to the annular top wall of the central closure for movement about a horizontally extending pivot axis between a closed position arranged to close the liquid-discharge outlet formed in the annular top wall of the central closure and an opened position arranged to extend away from the liquid-discharge outlet, and a closure retainer aligned with the top aperture and coupled to the annular top wall of the central closure and configured to retain the outlet closure in a stationary position relative to the outer wall upon movement of the outlet closure from the closed position to the opened position, wherein at least half of the circumferential extent of the annular top wall has a constant radial width, wherein the annular top wall includes a radially outer circumferential edge and a radially inner circumferential edge, wherein the outer wall is appended to the radially outer circumferential edge of the annular top wall, and wherein the central closure further includes an inner wall appended to and arranged to extend downwardly away from the radially inner circumferential edge of the annular top wall to a generally annular basin floor, the inner wall extending around an entirety of the circumferential extent of the annular top wall, and wherein the annular top wall includes a sunken portion located at a rear side of the annular top wall and an elevated portion extending around a remainder of the circumferential extent of the annular top wall and located at a higher vertical height than the sunken portion, the liquid-discharge outlet and the top aperture are formed in the sunken portion, and the sunken portion extends about a quarter of the circumferential extent of the annular top wall.

2. The drink cup lid of claim 1, wherein a radial width of the elevated portion of the annular top wall is at least about three-quarters of less than a maximum radial width of the annular top wall along an entirety of a circumferential extent of the elevated portion between a first transition surface and a second transition surface sunken portion.

3. The drink cup lid of claim 2, wherein the central closure further includes a recess located diametrically opposite of the outlet closure, the recess is formed in the outer wall and is arranged to extend radially inwardly and into the annular top wall.

4. The drink cup lid of claim 3, wherein the radial width of the elevated portion of the annular top wall is constant between the first transition surface and the recess and between the second transition surface and the recess.

5. The drink cup lid of claim 1, wherein the outlet closure includes a closure plate, an upstanding closure-anchor lug coupled to the closure plate, and a hinge coupled to the closure plate and to the annular top wall and configured to establish the horizontal pivot axis.

6. The drink cup lid of claim 5, wherein the hinge is coupled to a portion of the annular top wall between the liquid-discharge outlet and the top aperture, and the width of the closure plate measured in a direction of the horizontal pivot axis is greater than a width of the hinge in the direction of the horizontal pivot axis.

7. The drink cup lid of claim 5, wherein the closure retainer is formed to include an upwardly facing lug-receiving cavity aligned with the top aperture formed in the annular top wall, cavity side walls arranged to bound the lug-receiving cavity, and at least one recess retention indentation of the closure anchor lug configured to retain receive at least one vertical ridge of the closure anchor lug in the lug-receiving cavity upon movement of the outlet closure to the opened position.

8. The drink cup lid of claim 1, wherein the outlet closure includes a closure anchor lug arranged to extend downwardly through the top aperture formed in the annular top wall and to mate with the closure retainer and remain in a stationary position relative to the central closure upon movement of the outlet closure to the opened position, and the closure anchor lug includes at least one vertical ridge retention indentation formed in a side wall of the closure anchor lug.

9. The drink cup lid of claim 1, wherein the generally annular basin floor is planar and defines a first horizontal plane, the annular top wall is planar and defines a second horizontal plane, and the first horizontal plane is parallel to the second horizontal plane.

10. The drink cup lid of claim 1, wherein the ring-shaped brim mount includes a top ridge, the outer wall of the central closure includes an annular lower edge, a ring-shaped low-elevation liquid-retention channel extends between and interconnects the ring-shaped brim mount and the annular lower edge of the outer wall, and the ring-shaped low-elevation liquid-retention channel is arranged lower than the top ridge of the ring-shaped brim mount.

11. The drink cup lid of claim 10, wherein the ring-shaped low-elevation liquid-retention channel defines a first horizontal plane, the liquid-discharge surface of the sunken portion of the annular top wall defines a second horizontal plane, the elevated portion of the annular top wall defines a third horizontal plane, and the generally annular basin defines a fourth horizontal plane, and wherein the first, second, third, fourth horizontal planes are generally parallel.

12. A drink cup lid comprising a ring-shaped brim mount adapted to mate with a brim of a drink cup, a central closure surrounded by the ring-shaped brim mount and including an annular top wall formed to include a top aperture and an adjacent liquid-discharge outlet and an outer wall arranged to extend around an entirety of a circumferential extent of the annular top wall and downwardly from the annular top wall toward an interior region surrounded by the ring-shaped brim mount, an outlet closure coupled to the annular top wall of the central closure for movement about a horizontally extending pivot axis between a closed position arranged to close the liquid-discharge outlet formed in the annular top wall of the central closure and an opened position arranged to extend away from the liquid-discharge outlet, and a closure retainer aligned with the top aperture and coupled to the annular top wall of the central closure and configured to retain the outlet closure in a stationary position relative to the outer wall upon movement of the outlet closure from the closed position to the opened position, wherein the annular top wall includes a sunken portion located at a rear side of the annular top wall and an elevated portion extending around a remainder of the annular top wall and located at a higher vertical height than the sunken portion, the liquid-discharge outlet and the top aperture are formed in the sunken portion, and wherein the sunken portion of the annular top wall includes a liquid-discharge surface in which the liquid-discharge outlet is formed and a top aperture surface in which the top aperture is formed, and the top aperture surface is angled inwardly to extend away from the elevated portion and the liquid-discharge outlet.

13. The drink cup lid of claim 12, wherein the annular top wall includes a radially outer circumferential edge and a radially inner circumferential edge, wherein the outer wall is appended to the radially outer circumferential edge of the annular top wall, and wherein the central closure further includes an inner wall appended to and arranged to extend downwardly away from the radially inner circumferential edge of the annular top wall to a generally annular basin floor, the inner wall extending around an entirety of the circumferential extent of the annular top wall.

14. The drink cup lid of claim 12, wherein an edge of the top aperture surface has a serpentine shape and a varying height from the elevated portion.

15. The drink cup lid of claim 12, wherein the top aperture is formed entirely in the top aperture surface.

16. The drink cup lid of claim 12, wherein the top aperture is formed partially in the top aperture surface and partially in the liquid-discharge surface.

17. A drink cup lid comprising a ring-shaped brim mount adapted to mate with a brim of a drink cup, a central closure surrounded by the ring-shaped brim mount and including an annular top wall formed to include a top aperture and an adjacent liquid-discharge outlet, an outer wall arranged to extend around an entirety of a circumferential extent of the annular top wall and downwardly from a radially outer circumferential edge of the annular top wall toward an interior region surrounded by the ring-shaped brim mount, and an inner wall appended to and extending downwardly away from a radially inner circumferential edge of the annular top wall to a generally annular basin floor, the inner wall extending around an entirety of the circumferential extent of the annular top wall, the annular top wall including a sunken portion located at a rear side of the annular top wall and extending only partway around the circumferential extent of the annular top wall and an elevated portion extending around a remainder of the circumferential extent of the annular top wall and located at a higher vertical height than the sunken portion, the liquid-discharge outlet formed in the sunken portion, the inner wall having a constant vertical height along an entirety of a portion of the inner wall that extends from the elevated portion, an outlet closure coupled to the annular top wall of the central closure for movement about a horizontally extending pivot axis between a closed position closing the liquid-discharge outlet formed in the annular top wall of the central closure and an opened position away from the liquid-discharge outlet, and a closure retainer aligned with the top aperture and coupled to the annular top wall of the central closure and configured to retain the outlet closure in a stationary position relative to the outer wall upon movement of the outlet closure from the closed position to the opened position.

18. The drink cup lid of claim 17, wherein the liquid-discharge outlet and the top aperture are formed in the sunken portion, and the sunken portion extends about a quarter of the circumferential extent of the annular top wall.

19. The drink cup lid of claim 18, wherein the annular top wall includes a first transition surface between the sunken surface and a first circumferential end of the elevated surface and a second transition surface between the sunken surface and a second circumferential end of the elevated surface.

20. The drink cup lid of claim 19, wherein a front portion of the inner wall that extends along the elevated portion of the annular top wall between the first transition surface and the second transition surface has a generally constant first vertical height and a rear portion of the inner wall that extends along the sunken portion has a varying second vertical height.

* * * * *